US007156717B2

(12) United States Patent
Molnar

(10) Patent No.: US 7,156,717 B2
(45) Date of Patent: Jan. 2, 2007

(54) SITU FINISHING AID CONTROL

(76) Inventor: Charles J. Molnar, 12 Malvern Ct., Devon, Wilmington, DE (US) 19810

( * ) Notice: Subject to any disclaimer, the term of this patent is extended or adjusted under 35 U.S.C. 154(b) by 381 days.

(21) Appl. No.: 10/724,535

(22) Filed: Nov. 29, 2003

(65) Prior Publication Data

US 2004/0115841 A1 Jun. 17, 2004

Related U.S. Application Data

(63) Continuation-in-part of application No. 09/956,687, filed on Sep. 20, 2001, now Pat. No. 6,656,023.

(51) Int. Cl.
*B24B 29/02* (2006.01)

(52) U.S. Cl. ..... 451/5; 451/36; 451/41; 438/690

(58) Field of Classification Search ..... 451/4, 451/5, 8–11, 41, 285, 286–290; 438/690–693, 438/745, 753, 756, 757; 216/38, 88, 89; 252/79.1; 156/345
See application file for complete search history.

(56) References Cited

U.S. PATENT DOCUMENTS

| | | | | | |
|---|---|---|---|---|---|
| 4,421,068 | A | * | 12/1983 | Aral | 122/448.3 |
| 5,069,002 | A | * | 12/1991 | Sandhu et al. | 451/1 |
| 5,107,445 | A | * | 4/1992 | Jensen et al. | 374/161 |
| 5,137,544 | A | | 8/1992 | Medellin | 51/308 |
| 5,154,512 | A | | 10/1992 | Schietinger | 374/9 |
| 5,166,080 | A | | 11/1992 | Schietinger | 437/7 |
| 5,196,353 | A | | 3/1993 | Sandhu | 437/7 |
| 5,308,438 | A | | 5/1994 | Cote | 156/636 |
| 5,314,843 | A | | 5/1994 | Yu | 437/225 |
| 5,340,370 | A | | 8/1994 | Cadien | 51/38 |
| 5,352,277 | A | | 10/1994 | Sasaki | 106/6 |
| 5,413,941 | A | | 5/1995 | Koos | 437/8 |
| 5,537,325 | A | | 7/1996 | Iwakiri et al. | 364/468.28 |
| 5,595,526 | A | | 1/1997 | Yau | 451/8 |
| 5,597,442 | A | | 1/1997 | Chen | 156/626.1 |
| 5,609,511 | A | | 3/1997 | Moriyama | 451/5 |
| 5,609,517 | A | | 3/1997 | Lofaro | 451/529 |
| 5,614,444 | A | | 3/1997 | Farkas | 437/225 |
| 5,639,388 | A | | 6/1997 | Kimura | 216/84 |

(Continued)

FOREIGN PATENT DOCUMENTS

| | | |
|---|---|---|
| WO | WO 98/08919 | 3/1998 |

(Continued)

OTHER PUBLICATIONS 6204181 withdrawn from issue, Molnar, filed Nov. 5, 1999, published Mar. 20, 2001, U.S. Appl. No. 09/438,180.

(Continued)

*Primary Examiner*—Lee D. Wilson
*Assistant Examiner*—Anthony Ojini

(57) ABSTRACT

A method of using finishing aids for advanced finishing control is described. A finishing surface is used generally to induce frictional wear. The finishing aids with preferred in situ control can improve control of the coefficient of friction, the tangential force of friction, a finishing rate, a regional finishing rate(s), a differential finishing rate, and help reduce unwanted defects. A finishing aid can reduce friction. A lubricant is an illustrative finishing aid. The method uses finishing control subsystem having a multiplicity of operative process sensors along with tracked information to improve in situ control of finishing. Differential finishing rate methods are described to differentially finish semiconductor wafers. Differential lubricating film methods are described to differentially finish semiconductor wafers. Planarization and localized finishing can be improved using differential lubricating boundary layer methods of finishing with improved real time control.

139 Claims, 14 Drawing Sheets

U.S. PATENT DOCUMENTS

| | | | | |
|---|---|---|---|---|
| 5,643,060 | A | 7/1997 | Sandhu | 451/285 |
| 5,647,952 | A | 7/1997 | Chen | 156/636.1 |
| 5,667,629 | A | 9/1997 | Pan | 438/13 |
| 5,685,766 | A | 11/1997 | Mattingly | 451/36 |
| 5,691,895 | A | 11/1997 | Kurtzberg et al. | 364/148 |
| 5,695,384 | A | 12/1997 | Beratan | 451/28 |
| 5,695,660 | A | 12/1997 | Litvak | 216/85 |
| 5,722,879 | A | 3/1998 | Cronin | 451/281 |
| 5,728,308 | A | 3/1998 | Muroyama | 216/88 |
| 5,733,176 | A | 3/1998 | Robinson | 451/41 |
| 5,733,819 | A | 3/1998 | Kodama | 438/692 |
| 5,735,036 | A | 4/1998 | Barr | 29/603.12 |
| 5,738,562 | A | 4/1998 | Doan | 451/5 |
| 5,740,033 | A | 4/1998 | Wassick et al. | 364/149 |
| 5,743,784 | A | 4/1998 | Birang | 451/21 |
| 5,749,769 | A | 5/1998 | Church | 451/5 |
| 5,759,917 | A | 6/1998 | Grover et al. | 438/690 |
| 5,762,537 | A | 6/1998 | Sandhu | 451/7 |
| 5,783,489 | A | 7/1998 | Kaufman | 438/692 |
| 5,830,280 | A | 11/1998 | Sato | 134/2 |
| 5,833,519 | A | 11/1998 | Moore | 451/56 |
| 5,842,909 | A | 12/1998 | Sandhu | 451/7 |
| 5,858,813 | A | 1/1999 | Scherber | 438/693 |
| 5,860,847 | A | 1/1999 | Sakurai et al. | 451/10 |
| 5,876,266 | A | 3/1999 | Miller | 451/56 |
| 5,876,490 | A | 3/1999 | Ronay | 106/3 |
| 5,885,137 | A | 3/1999 | Ploessl | 106/3 |
| 5,885,334 | A | 3/1999 | Suzuki | 438/639 |
| 5,906,754 | A | 5/1999 | Appel | 216/88 |
| 5,910,041 | A | 6/1999 | Duescher | 451/28 |
| 5,916,855 | A | 6/1999 | Avanzino | 51/307 |
| 5,919,082 | A | 7/1999 | Walker | 451/41 |
| 5,934,978 | A | 8/1999 | Burke | |
| 5,945,347 | A | 8/1999 | Wright | 438/692 |
| 5,954,975 | A | 9/1999 | Cadien | 216/38 |
| 5,954,997 | A | 9/1999 | Kaufman | 252/79.1 |
| 5,958,794 | A | 9/1999 | Bruxvoort | 438/692 |
| 5,968,280 | A | 10/1999 | Ronay | 134/2 |
| 5,972,793 | A | 10/1999 | Tseng | 438/692 |
| 5,985,045 | A | 11/1999 | Kobayashi | 148/240 |
| 5,993,298 | A | 11/1999 | Duescher | 451/56 |
| 6,121,143 | A | 9/2000 | Messner et al. | 438/692 |
| 6,197,604 | B1 | 3/2001 | Miller | 438/14 |
| 6,257,953 | B1 | 7/2001 | Gittis et al. | 451/5 |
| 6,263,255 | B1 | 7/2001 | Tan et al. | 700/121 |
| 6,267,644 | B1 | 7/2001 | Molnar | 451/41 |
| 6,268,641 | B1 | 7/2001 | Yano et al. | 257/260 |
| 6,283,829 | B1 | 9/2001 | Molnar | 451/8 |
| 6,291,349 | B1 | 9/2001 | Molnar | 438/609 |
| 6,293,851 | B1 * | 9/2001 | Molnar | 451/41 |
| 6,298,470 | B1 | 10/2001 | Breiner et al. | 716/4 |
| 6,346,202 | B1 * | 2/2002 | Molnar | 216/88 |
| 6,428,388 | B1 * | 8/2002 | Molnar | 451/8 |
| 6,568,989 | B1 * | 5/2003 | Molnar | 451/5 |
| 6,634,927 | B1 * | 10/2003 | Molnar | 451/8 |
| 6,641,463 | B1 * | 11/2003 | Molnar | 451/41 |
| 6,656,023 | B1 * | 12/2003 | Molnar | 451/41 |

FOREIGN PATENT DOCUMENTS

| | | |
|---|---|---|
| WO | WO 99/64527 | 12/1999 |
| WO | WO 00/00561 | 1/2000 |
| WO | WO 00/00567 | 1/2000 |

OTHER PUBLICATIONS

Berman, Mike et al., "Review of in Situ and in Line Detection for CMP Applic.", Semiconductor Fabtech, 8th edition, pp. 267-274.

Bibby, Thomas, "Endpoint Detection for CMP", Journal of Electronic Materials, vol. 27, #10, 1998, pp. 1073-1081.

"Understanding and Using Cost of Ownership", Wright Williams & Kelly, Dublin, CA, rev. 0595-1.

"Intermetal Dielectric Cost-of-Ownership", Case, C.B. and Case, C. J., *Semiconductor International*, Jun. 1995, pp 83-88.

"Using COO to select Nitride PECVD clean cycle", Anderson, Bob, et al., Semiconductor International, Oct. 1993, pp 86-88.

"The application of cost of ownership simulation to wafer sort and final test", Jimez, D. W. et al., SEMI's Manufacturing test Conference, Jul., 1993.

"Reducing Tungsten Deposition equipment cost of ownership through in situ contamination prevention and reduction", Burghard, R. W. et al., *Microcontamination*, Oct. 1992, pp 23-25.

"Reducing ion-implant equipment cost of ownship through in situ contamination prevention and control", Burghard, R. W., et al., *Microcontamination*, Sep. 1992, pp 33-36.

"Reducing tungsten-etch equipment cost of ownership through in sity contamination prevention and reduction", Burghard, R. W., et al., *Microcontamination*, Jun. 1992, pp 33-36.

"Reducing process equipment cost of ownership through in situ contamination prevention and reduction", Burghard, R. W., et al., *Microcontamination*, May. 1992, pp 21-24.

"Cost of ownership for inspection equipment", Dance D. and Bryson, P., Sematech, Austin, Texas, date unknown.

* cited by examiner

SITU FINISHING AID CONTROL

CROSS REFERENCE TO RELATED APPLICATIONS

This application claims the benefit of Provisional Application serial No. 60/107,298 filed on Nov. 6, 1998 entitled "Fixed abrasive finishing method using lubricants for electronics"; Provisional Application Ser. No. 60/111,118 filed on Dec. 7, 1998 entitled "Fixed abrasive finishing method using an aqueous emulsion composition for electronics"; and Provisional Application Ser. No. 60/118,966 filed on Feb. 6, 1999 entitled "Fixed abrasive finishing method using lubricating composition for semiconductor wafers". This application claims benefit of U.S. patent application Ser. No. 09/434,722 filed on Nov. 5, 1999 with title "Fixed abrasive finishing method using lubricants" now U.S. Pat. No. 6,293,851, and U.S. patent application Ser. No. 09/956,687 filed Sep. 20, 2001 with title "In situ control with lubricant and tracking" and expected to issue as U.S. Pat. No. 6,656,023.

Provisional Applications and Regular patent applications which this patent claims benefit of are included herein by reference in their entirety.

BACKGROUND OF INVENTION

Chemical mechanical polishing (CMP) is generally known in the art. For example U.S. Pat. No. 5,177,908 to Tuttle issued in 1993 describes a finishing element for semiconductor wafers, having a face shaped to provide a constant, or nearly constant, surface contact rate to a workpiece such as a semiconductor wafer in order to effect improved planarity of the workpiece. U.S. Pat. No. 5,234,867 to Schultz et. al. issued in 1993 describes an apparatus for planarizing semiconductor wafers which in a preferred form includes a rotatable platen for polishing a surface of the semiconductor wafer and a motor for rotating the platen and a non-circular pad is mounted atop the platen to engage and polish the surface of the semiconductor wafer. Fixed abrasive finishing elements are known for polishing semiconductor layers. An example is WO 98/18159 PCT application by Minnesota Mining and Manufacturing.

Semiconductor wafer fabrication generally requires the formation of layers of material having particularly small thickness. A typical conductor layer, such as a metal layer, is generally 2,000 to 6,000 angstroms thick and a typical insulating layer, for example an oxide layer, is generally 3,000 to 5,000 angstroms thick. The actual thickness is at least partially dependent on the function of the layer along with the function and design of the semiconductor wafer. A gate oxide layer can be less than 100 angstroms while a field oxide is in the thousands of angstroms in thickness. In higher density and higher value semiconductor wafers the layers can be below 500 angstroms in thickness. Generally during semiconductor fabrication, layers thicker than necessary are formed and then thinned down to the targeted tolerances with techniques needed such as Chemical Mechanical Polishing. Because of the strict tolerances, extreme care is given to attaining the targeted thinned down tolerances. As such, it is particularly preferred to accurately determine just when enough of the layer has been removed to reach the targeted tolerances, this is the end point for the thinning or polishing operation. One method to remove selected amounts of material is to remove the semiconductor wafer periodically from polishing for measurements such as thickness layer measurements. Although this can be done it is time consuming and adds extra expense to the operation. Further the expensive wafers can be damaged during transfer to or from the measurement process further decreasing process yields and increasing costs.

BRIEF SUMMARY OF INVENTION

An objective of polishing of semiconductor layers is to make the semiconductor layers as nearly perfect as possible. Abrasive finishing of sensitive microelectronic surfaces can suffer from overly harsh finishing on a workpiece causing unwanted scratching or other unwanted surface damage thus reducing the perfection of the surface. Further, finishing pad finishing surface can suffer from having a higher than necessary coefficient of friction when finishing a workpiece causing higher than desired coefficient(s) of friction in the operative finishing interface. This higher than necessary coefficient of friction can lead to other unwanted surface damage. Further, fixed abrasive finishing pads can have abrasive particles unexpectedly break away from their surface during finishing and these broken away abrasive particles can scratch or damage the workpiece surface. Still further, during finishing a particle can break away from the workpiece surface forming a workpiece abrasive particle which can scratch or damage the workpiece surface. These unwanted effects are particularly important and deleterious to yield when manufacturing electronic wafers which require extremely close tolerances in required planarity and feature sizes.

It is an advantage of this invention to reduce the harshness of abrasive finishing on the workpiece surface during finishing. It is an advantage of this invention to reduce unwanted scratching or other unwanted surface damage on the workpiece surface during finishing. It is further an advantage of this invention to reduce the coefficient(s) of friction during finishing a workpiece to help reduce unwanted surface damage. It is an advantage of this invention to reduce unwanted damage to the workpiece surface when during finishing with a fixed abrasive finishing element an abrasive particle unexpectedly breaks away from their surface. It is an advantage of the invention to reduce unwanted damage to the workpiece surface when an abrasive workpiece particle breaks away workpiece surface during finishing. It is an advantage to use tracking the workpiece as it undergoes multiple finishing steps to update and change a preferred model used for advanced real time control to reduce unwanted workpiece defects. It is further an advantage of this invention to help improve yield for workpieces having extremely close tolerances such as semiconductor wafers.

Addition of lubricants to the interface between the workpiece surface being finished and the finishing pad finishing surface can improve finishing and can also changes the friction at this interface. Providing a finishing aid to change the tangential for a friction can aid in reducing defects and improving finishing. Providing a finishing aid to change the finishing rate measured in angstroms per minute can also aid in reducing defects and improving finishing. In situ process control where finishing aids, preferably lubricants, are added or changed during the finishing process can change finishing performance. Friction can change due to real time changes to the workpiece surface, the finishing element finishing surface, lubricant changes, and changes to process control parameter set points. A method which use a plurality of process sensors to gain information about finishing progress and uses this information for improved finishing control is preferred. Further, the preferred real time tangential force of friction and/or coefficient of friction control can change due to the specific structure and/or topography to the workpiece being finished. By tracking the workpiece during manufacture, improved information for in real time (in situ) control of lubricant changes, tangential force of friction, and/or coefficient of friction can be effected. By tracking the workpiece during manufacture, improved information for in real time (in situ) control of finishing rate(s) and differential finishing rate(s) measured in angstroms per minute can be effected. A method to further improve control in situ process changes due to a finishing aid and/or lubricant additions and/or changes is needed in the industry. A method to track a workpiece during manufacture and to use tracking information during finishing is needed. A method which can also help improve the cost of manufacture of the semiconductor wafers during a finishing cycle time having real time finishing rate changes and/or friction changes would be generally desirable.

These and other advantages of the invention will become readily apparent to those of ordinary skill in the art after reading the following disclosure of the invention. Preferred embodiments have one, preferably two, and even more preferably a multiplicity of the advantages disclosed herein.

A preferred embodiment of this invention is directed to a method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface; a step 4) of providing a finishing control subsystem having at least three operative process sensors for sensing in situ process information during the finishing cycle time, access to the tracked information, and a processor to evaluate the in situ process information and the tracked information; a step 5) of applying an operative finishing motion in the interface forming at least one region having the finishing aid and wherein the at least one region has a tangential force of friction; and a step 6) of changing a plurality of control parameters in response to an evaluation of both the in situ process information sensed with the at least three operative process sensors and the tracked information and wherein changing the control parameters changes the tangential force of friction in the at least one region having the finishing aid during at least a portion of the finishing cycle time.

A preferred embodiment of this invention is directed to a method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface; a step 4) of providing a finishing control subsystem having at least three operative process sensors for sensing in situ process information during the finishing cycle time, access to the tracked information, and a processor to evaluate the in situ process information and the tracked information; a step 5) of applying an operative finishing motion in the interface formed between the finishing surface and the semiconductor wafer surface forming at least one region having the finishing aid which reacts with the semiconductor wafer surface and wherein the at least one region has a tangential force of friction; and a step 6) of changing a plurality of control parameters in response to an evaluation of both the in situ process information sensed with the at least three operative process sensors and the tracked information and wherein changing the control parameters changes the tangential force of friction in the at least one region having the finishing aid which reacts with the semiconductor wafer surface during at least a portion of the finishing cycle time.

A preferred embodiment of this invention is directed to a method for finishing a semiconductor wafer having tracked information, the method comprising a step (A) providing a semiconductor wafer having heterogeneous semiconductor wafer surface comprising at least a first uniform region and a second uniform region; a step (B) providing a finishing surface; a step (C) providing a finishing aid proximate the semiconductor wafer; a step (D) providing at least one finishing control subsystem having at least three operative process sensors, at least one processor, and a controller and wherein the at least one processor for processing (i) the tracked information, and (ii) historical performance including a quantity of historical performance of prior semiconductor wafers; a step (E) applying an operative finishing motion to an interface between the heterogeneous semiconductor wafer surface and the finishing surface and wherein the interface includes at least one uniform region having the finishing aid; a step (F) sensing an in situ finishing information with the at least three operative process sensors during a finishing cycle time; a step (G) evaluating a multiplicity finishing information, and each having varying effects on the finishing with the finishing aid; a step (H) determining a change for at least two process control parameter using (i) the tracked information, (ii) the historical performance including the quantity of historical performance of prior semiconductor wafers, (iii) the in situ finishing information, and (iv) the step (G) of evaluating the multiplicity of finishing information; and a step (I) changing the at least two of control parameters changes the tangential force of friction in the at least one uniform region having the finishing aid during at least a portion of the finishing cycle time.

A preferred embodiment of this invention is directed to a method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface having a first uniform region and a second uniform region; a step 4) of providing a finishing control subsystem having at least three operative process sensors for sensing in situ process information during the finishing cycle time, access to the tracked information, and a processor to evaluate the in situ process information and the tracked information; a step 5) of applying an operative finishing motion in the interface forming a first uniform region having the finishing aid and wherein the first and the second uniform regions have different finishing rates measured in angstroms per minute; and a step 6) of changing a plurality of control parameters in response to an evaluation of both the in situ process information sensed with the at least three operative process sensors and the tracked information and wherein changing the control parameters changes the a finishing rate measured in angstroms per minute in at least one uniform region during at least a portion of the finishing cycle time.

A preferred embodiment of this invention is directed to a method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface; a step 4) of providing a finishing control subsystem having at least three operative process sensors for sensing in situ process information during the finishing cycle time, access to the tracked information, and a processor to evaluate the in situ process information and the tracked information; a step 5) of applying an operative finishing motion in a finishing interface having a first region and a second region and wherein at least the first uniform region has a finishing aid and wherein the first and the second regions have different finishing rates measured in angstroms per minute; a step 6) evaluating both the in situ process information sensed with the at least three operative process sensors and the tracked information; and a step 7) of changing a plurality of control parameters to change the finishing rate measured in angstroms per minute in at least one of the regions during the finishing cycle time.

A preferred embodiment of this invention is directed to a method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface; a step 4) of providing a finishing control subsystem having at least five operative process sensors for sensing in situ process information during the finishing cycle time, access to the tracked information, and a processor to evaluate the in situ process information and the tracked information; a step 5) of applying an finishing motion in the interface forming at least one uniform region having the finishing aid and a differential finishing rate measured in angstroms per minute on the semiconductor wafer surface; a step 6) of evaluating both the in situ process information sensed with the at least five operative process sensors and the tracked information; and a step 7) of changing a plurality of control parameters to change the differential finishing rate measured in angstroms per minute on the semiconductor wafer surface during the finishing cycle time.

A preferred embodiment of this invention is directed to a method for finishing a semiconductor wafer at least one uniform region and having tracked information, the method comprising a step (A) providing a semiconductor wafer; a step (B) providing a finishing surface; a step (C) providing a finishing aid proximate the semiconductor wafer and wherein the finishing aid comprises a reactive finishing aid which reacts with at least portion of the semiconductor wafer surface changing the finishing rate in angstroms per minute when compared to the finishing rate under identical finishing conditions but in the absence of the reactive finishing aid; a step (D) providing at least one finishing control subsystem having at least three operative process sensors, at least one processor, and a controller and wherein the at least one processor for processing (i) tracked information, and (ii) historical performance; a step (E) applying an operative finishing motion to an interface between the semiconductor wafer and the finishing surface and wherein the interface includes the finishing aid; a step (F) sensing an in situ finishing information with the at least three operative process sensors during a finishing cycle time; a step (G) evaluating a multiplicity finishing information, and each having varying effects on the finishing with the finishing aid; a step (H) determining a change for at least two process control parameter using (i) tracked information, (ii) historical performance, (iii) the in situ finishing information, and (iv) the step (G) of evaluating the multiplicity of finishing information; and a step (I) changing the at least two control parameters changes the finishing rate measured in angstroms per minute in the at least portion of the semiconductor wafer during the finishing cycle time.

A preferred embodiment of this invention is directed to a method for finishing a semiconductor wafer having tracked information, the method comprising a step (A) providing a semiconductor wafer; a step (B) providing a finishing surface; a step (C) providing a finishing aid proximate the semiconductor wafer and wherein the finishing aid differentially reacts with heterogeneous regions of a semiconductor wafer surface being finished; a step (D) providing at least one finishing control subsystem having at least three operative process sensors, at least one processor, and a controller and wherein the at least one processor for processing (i) the tracked information, and (ii) historical performance including a quantity of historical performance of prior semiconductor wafers; a step (E) applying an operative finishing motion to an interface between the semiconductor wafer and the finishing surface and wherein the interface includes the finishing aid; a step (F) sensing an in situ finishing information with the at least three operative process sensors during a finishing cycle time; a step (G) evaluating a multiplicity finishing information, and each having varying effects on the finishing with the finishing aid; a step (H) determining a change for at least two process control parameter using (i) the tracked information, (ii) the historical performance including the quantity of historical performance of prior semiconductor wafers, (iii) the in situ finishing information, and (iv) the step (G) of evaluating the multiplicity of finishing information; and a step (I) changing the at least two of control parameters to change a finishing rate measured in angstroms per minute on at least one region of semiconductor wafer surface during the finishing cycle time.

A preferred embodiment of this invention is directed to a method for finishing a semiconductor wafer having tracked information, the method comprising a step (A) providing a semiconductor wafer and wherein the semiconductor wafer surface has a first uniform region and a second uniform region; a step (B) providing a finishing surface; a step (C) providing a finishing aid proximate the semiconductor wafer; a step (D) providing at least one finishing control subsystem having at least three operative process sensors, at least one processor, and a controller and wherein the at least one processor for processing (i) the tracked information, and (ii) historical performance including a quantity of historical tracked information of the workpiece and a quantity of historical tracked information of prior workpieces; a step (E) applying an operative finishing motion to an interface between the semiconductor wafer and the finishing surface and wherein the interface includes the finishing aid in the first uniform region; a step (F) sensing an in situ finishing information with the at least three operative process sensors during a finishing cycle time; a step (G) evaluating a multiplicity finishing information, and each having varying effects on the finishing with the finishing aid; a step (H) determining a change for at least two process control parameter using (i) the tracked information, (ii) historical performance including the quantity of historical tracked information of the workpiece and the quantity of historical tracked information of prior workpieces, (iii) the in situ finishing information, and (iv) the step (G) of evaluating the multiplicity of finishing information; and a step (I) changing the at least two of control parameters to change a finishing rate measured in angstroms per minute on at least the first uniform region of semiconductor wafer surface during the finishing cycle time; a step (J) storing at a least a portion of the information in the step (H) forming a family of stored information; a step (K) using the family of stored information to determine a change for at least one particular member of the family of stored information; a step (L) changing the at least one particular member in the family of stored information forming a changed family of stored information; and a step (M) using the changed family of stored information.

A preferred embodiment of this invention is directed to a method for finishing a semiconductor wafer having tracked information, the method comprising a step (A) providing a semiconductor wafer and wherein the semiconductor wafer surface has a first uniform region and a second uniform region; a step (B) providing a finishing surface; a step (C) providing a finishing aid proximate the semiconductor wafer; a step (D) providing at least one finishing control subsystem having at least three operative process sensors, at least one processor, and a controller and wherein the at least one processor for processing (i) the tracked information, and (ii) historical performance including a quantity of historical tracked information of the workpiece and a quantity of historical tracked information of prior workpieces; a step (E) applying an operative finishing motion to an interface between the semiconductor wafer and the finishing surface and wherein the interface includes the finishing aid in the first uniform region; a step (F) sensing an in situ finishing information with the at least three operative process sensors during a finishing cycle time; a step (G) evaluating a multiplicity finishing information, and each having varying effects on the finishing with the finishing aid; a step (H) determining a change for at least two process control parameter using (i) the tracked information, (ii) historical performance including the quantity of historical tracked information of the workpiece and the quantity of historical tracked information of prior workpieces, (iii) the in situ finishing information, and (iv) the step (G) of evaluating the multiplicity of finishing information; a step (I) changing the at least two of control parameters to change a tangential force of friction in at least the first uniform region of semiconductor wafer surface during the finishing cycle time; a step (J) storing at a least a portion of the information in the step (H) forming a family of stored information; a step (K) using the family of stored information to determine a change for at least one particular member of the family of stored information; a step (L) changing the at least one particular member in the family of stored information forming a changed family of stored information; and a step (M) using the changed family of stored information.

Evaluations for control using mathematical expressions, fuzzy logic, and/or neural networks are preferred. Use of in situ or real time finishing information is preferred. Use of tracked information to aid control is also preferred. Use of a processor-readable, program storage device encoded with instructions that, when executed by a processor, performs or executes the preferred methods can be used effectively. Use of a process controller at least in part controlled by a processor having a processor readable medium with processor readable instructions can perform or execute the preferred embodiments can also be used effectively.

After executing a preferred embodiment such as those described herein storing at a least a portion of the information (for example finishing information) forming a family of stored information, then using the family of stored finishing information to determine a change for at least one particular member of the family of stored information and then changing the at least one particular member in the family of stored information forming a changed family of stored information can be preferred for some control processes. Subsequently using the changed information is also preferred such as for further determining and/evaluating the control of the finishing of semiconductor wafer.

Other preferred embodiments are discussed herein.

REFERENCE NUMERALS IN DRAWINGS

Figure 1:
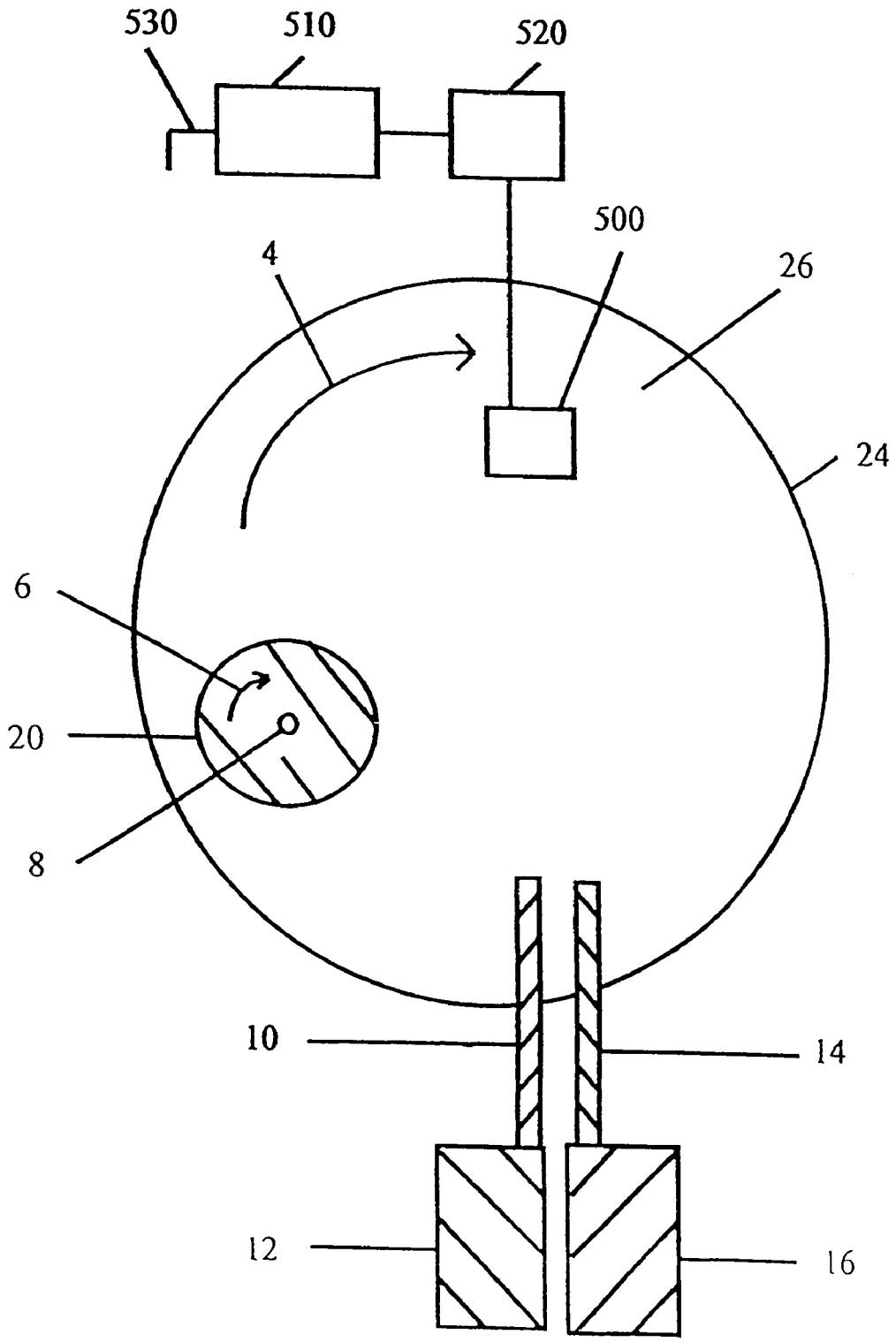
FIG. 1 is an artist's drawing of the interrelationships of the different materials when finishing according to this invention.

Reference Numeral 4 direction of rotation of the finishing element finishing surface Reference Numeral 6 direction of rotation of the workpiece being finished Reference Numeral 8 center of the rotation of the workpiece Reference Numeral 10 lubricant feed line for adding a lubricant composition Reference Numeral 12 a reservoir of lubricant Reference Numeral 14 finishing composition feed line for adding other chemicals Reference Numeral 16 reservoir of finishing composition Reference Numeral 16 rotating carrier for the workpiece Reference Numeral 18 operative contact element Reference Numeral 20 workpiece Reference Numeral 21 workpiece surface facing away from the workpiece surface being finished.

Reference Numeral 22 surface of the workpiece being finished

Reference Numeral 23 raised surface perturbation

Reference Numeral 24 finishing element

Reference Numeral 26 finishing element finishing surface

Reference Numeral 28 finishing element surface facing away from workpiece surface being finished Reference Numeral 30 polishing composition Reference Numeral 32 operative finishing motion Reference Numeral 33 pressure applied to the operative finishing interface substantially perpendicular to the finishing motion Reference Numeral 40 platen Reference Numeral 42 surface of the platen facing the finishing element Reference Numeral 44 surface of the platen facing away from the finishing element Reference Numeral 54 base support structure Reference Numeral 56 surface of the base support structure facing the platen Reference Numeral 60 carrier housing Reference Numeral 62 pressure distributive element Reference Numeral 500 operative sensor Reference Numeral 510 processor Reference Numeral 520 controller Reference Numeral 530 operative connections Reference Numeral 800 portion of a semiconductor wafer surface having two unwanted raised regions.

Reference Numeral 802 unwanted raised regions on the semiconductor surface being finished.

Reference Numeral 804 lower local regions on the semiconductor surface being finished proximate to the unwanted raised regions.

Reference Numeral 810 finishing surface contacting unwanted raised regions

Reference Numeral 812 finishing element surface local region displaced from but proximate to and lower than the unwanted raised local regions.

Reference Numeral 900 boundary layer lubrication.

Reference Numeral 902 thinner regions of boundary layer lubrication

Reference Numeral 904 thicker regions of boundary layer lubrication

DETAILED DESCRIPTION OF THE INVENTION

The book *Chemical Mechanical Planarization of Microelectric Materials* by Steigerwald, J. M. et al published by John Wiley & Sons, ISBN 0471138274 generally describes chemical mechanical finishing and is included herein by reference in its entirety for general background. In chemical mechanical finishing the workpiece is generally separated from the finishing element by a polishing slurry. The workpiece surface being finished is in parallel motion with finishing element finishing surface disposed towards the workpiece surface being finished. The abrasive particles such as that found in a polishing slurry interposed between these surfaces generally aid in finishing the workpiece.

Discussion of some of the terms useful to aid in understanding this invention are now presented. Finishing is a term used herein for both planarizing and polishing. Planarizing is the process of making a surface which has raised surface perturbations or cupped lower areas into a planar surface and thus involves reducing or eliminating the raised surface perturbations and cupped lower areas. Planarizing changes the topography of the work piece from non planar to ideally perfectly planar. Polishing is the process of smoothing or polishing the surface of an object and tends to follow the topography of the workpiece surface being polished. A finishing element is a term used herein to describe a pad or element for both polishing and planarizing. A finishing element finishing surface is a term used herein for a finishing element surface used for both polishing and planarizing. A finishing element planarizing surface is a term used herein for a finishing element surface used for planarizing. A finishing element polishing surface is a term used herein for a finishing element surface used for polishing. Workpiece surface being finished is a term used herein for a workpiece surface undergoing either or both polishing and planarizing. A workpiece surface being planarized is a workpiece surface undergoing planarizing. A workpiece surface being polished is a workpiece surface undergoing polishing. The finishing cycle time is the elapsed time in minutes that the workpiece is being finished. A portion of a finishing cycle time is about 5% to 95% of the total finishing cycle time in minutes and a more preferred portion of a finishing cycle time is 10% to 90% of the total finishing cycle time in minutes. The planarizing cycle time is the elapsed time in minutes that the workpiece is being planarized. The polishing cycle time is the elapsed time in minutes that the workpiece is being polishing.

As used herein, an emulsion is a fluid containing a microscopically heterogeneous mixture of two (2) normally immiscible liquid phases, in which one liquid forms minute droplets suspended in the other liquid. As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. A hydrocarbon oil is a non limiting example. As used herein, soluble means capable of mixing with a liquid (dissolving) to form a homogeneous mixture (solution).

As used herein, a dispersion is a fluid containing a microscopically heterogeneous mixture of solid phase material dispersed in a liquid and in which the solid phase material is in minute particles suspended in the liquid. As used herein, a surfactant is a surface active substance, i.e., alters (usually reduces) the surface tension of water. Non limiting examples of surfactants include ionic, nonionic, and cationic. As used herein, a lubricant is an agent that reduces friction between moving surfaces. As used herein, soluble means capable of mixing with a liquid (dissolving) to form a homogeneous mixture (solution).

Figure 2:
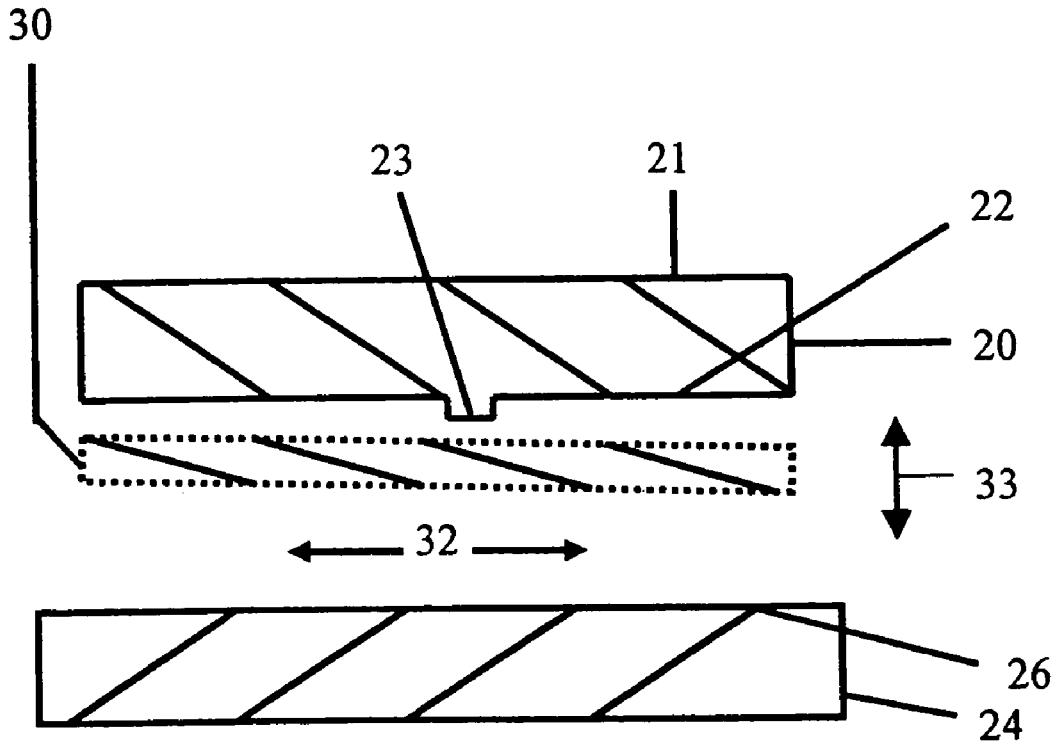
FIG. 2 is an artist's drawing of a particularly preferred embodiment of this invention including the interrelationships of the different objects when finishing according to this invention.
Figure 3:
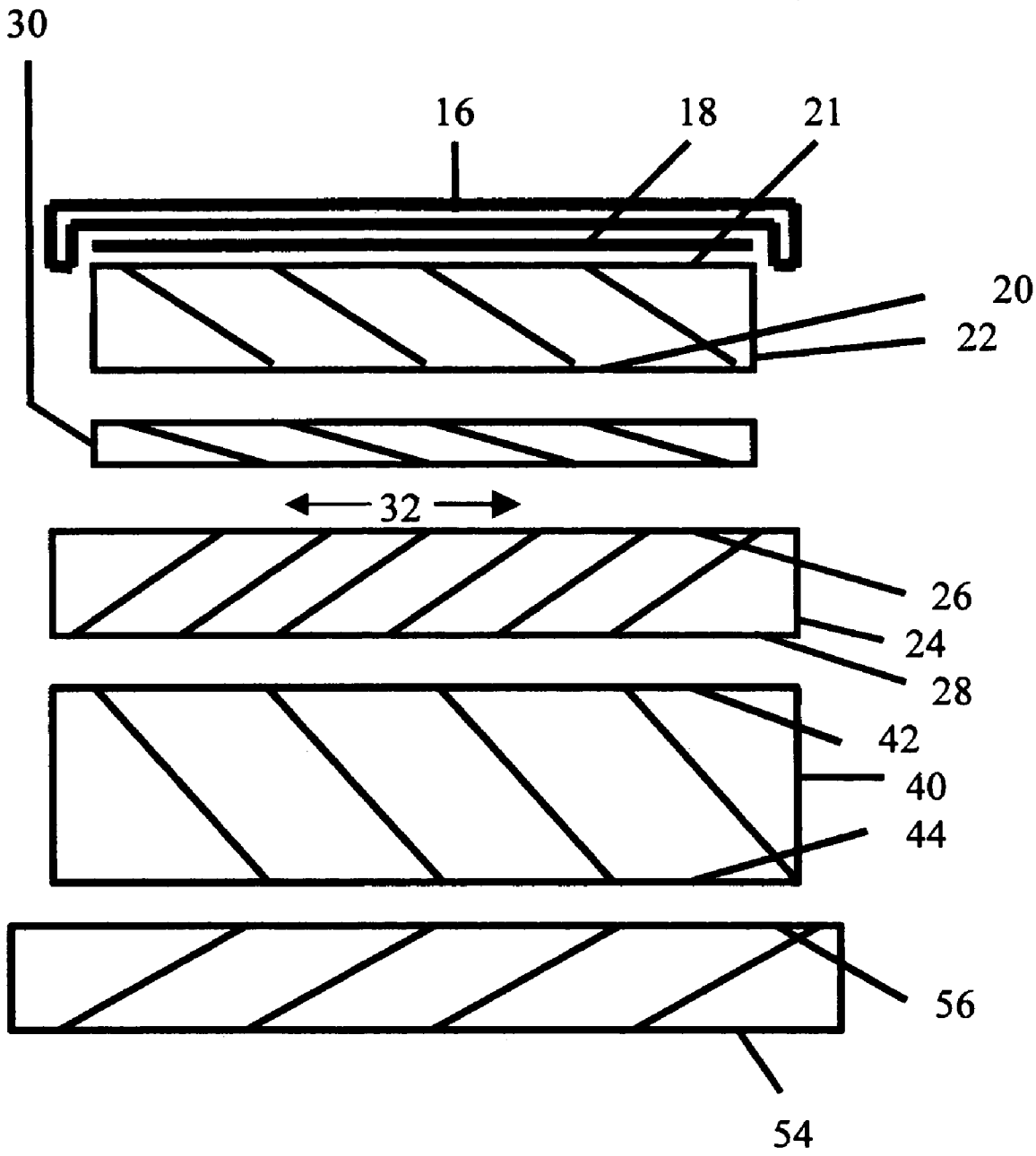
FIG. 3 is a closeup drawing of a preferred embodiment of this invention

As used herein, a die is one unit on a semiconductor wafer generally separated by scribe lines. After the semiconductor wafer fabrication steps are completed, the die are separated into units generally by sawing. The separated units are generally referred to as "chips". Each semiconductor wafer generally has many die which are generally rectangular. The terminology semiconductor wafer and die are generally known to those skilled in the arts. As used herein, within die uniformity refers to the uniformity of within the die. As used herein, local planarity refers to die planarity unless specifically defined otherwise. Within wafer uniformity refers to the uniformity of finishing of the wafer. As used herein, wafer planarity refers to planarity across a wafer. Multiple die planarity is the planarity across a defined number of die. As used herein, global wafer planarity refers to planarity across the entire semiconductor wafer planarity. Planarity is important for the photolithography step generally common to semiconductor wafer processing, particularly where feature sizes are less than 0.25 microns. As used herein, a device is a discrete circuit such as a transistor, resistor, or capacitor. As used herein, pattern density is ratio of the raised (up) area in square millimeters to the to area in square millimeters of region on a specific region such as a die or semiconductor wafer. As used herein, pattern density is ratio of the raised (up) area in square millimeters to the total area in square millimeters of region on a specific region such as a die or semiconductor wafer. As used herein, line pattern density is the ratio of the line width to the pitch. As used herein, pitch is line width plus the oxide space. As an illustrative example, pitch is the copper line width plus the oxide spacing. Oxide pattern density, as used herein, is the volume fraction of the oxide within an infinitesimally thin surface of the die. FIGS. 1–3 are now discussed to better illustrate the invention.

FIG. 1 is an artist's drawing of a particularly preferred embodiment of this invention when looking from a top down perspective including the interrelationships of some particularly preferred objects when finishing according to the method of this invention. Reference Numeral 24 represents a finishing element. An abrasive finishing element is preferred. The finishing element finishing surface can comprise inorganic abrasive particles for some applications. The finishing element finishing surface can comprise organic abrasive particles for some applications. The finishing element finishing surface can be free of inorganic abrasive particles for some applications. The finishing element finishing surface can free of organic abrasive particles for some applications. The finishing element finishing surface can comprise an abrasive polymer. The finishing element finishing surface can comprise a polymer free of abrasivity. Generally, a finishing surface having abrasive particles therein is a more aggressive finishing surface and can be preferred for some applications, particularly where higher cutting rates are preferred. Generally, a finishing surface free of abrasive particles therein can be preferred for finishing such as wherein an abrasive slurry is used. A finishing element finishing surface, preferably abrasive finishing element finishing surface, free of fluorocarbon matter can be preferred for some types of finishing because the fluorocarbon matter can be difficult to clean from some workpiece surfaces after finishing, particularly with aqueous cleaning compositions. Reference Numeral 26 represents the finishing element finishing surface. An abrasive finishing element finishing surface is generally preferred for some applications. A finishing surface having an abrasive polymer is preferred and having an abrasive organic polymer is more preferred. Reference Numeral 26 represents the finishing element finishing surface. The finishing surface can comprise a plurality of synthetic polymers. The finishing element finishing surface can comprise a plurality of synthetic polymers. Reference Numeral 4 represents the direction of rotation of the finishing element finishing surface. Reference Numeral 20 represents the workpiece being finished. The workpiece surface facing the finishing element finishing surface is the workpiece surface being finished. Reference Numeral 6 represents the direction of rotation of the workpiece being finished. Reference Numeral 8 is the center of the rotation of the workpiece. Reference Numeral 10 represents an optional finishing aid or an optional lubricant feed line for adding an optional finishing aid or an optional lubricant composition to the workpiece surface to improve the quality of finishing. The lubricant feed line can have a plurality of exit orifices. A lubricant feed line which supplies the lubricant adjacent or near the point of use is preferred. The lubricant feed line can also have other finishing chemicals such as acids, bases, buffers, finishing aids, and the like. An organic finishing aid is an example of a preferred finishing aid. An organic synthetic finishing aid is an example of a preferred finishing aid. An organic lubricating aid is an example of a preferred finishing aid. A lubricant is an example of a preferred finishing aid. An organic lubricant is an example of a preferred finishing aid. An organic polymeric lubricant is an example of a preferred finishing aid. An organic reactive finishing aid is an example of a preferred finishing aid. Finishing aids and there use are discussed further elsewhere herein. Thus the lubricant feed line is not limited to lubricant feeds but also feed other reagents and the like also. Reference Numeral 12 represents a reservoir of lubricant to be fed to workpiece surface. A fluid borne lubricant is preferred and a water borne lubricant is more preferred. Not shown is the feed mechanism for the lubricant such as variable air or gas pressure or pump mechanism. Supplying a finishing composition without abrasives is preferred and supplying a finishing composition without abrasive particles is more preferred for some applications such as where a fixed abrasive finishing element finishing surface is used for finishing. Supplying a lubricant which is free of an encapsulating film or encapsulating thin resin structure is preferred. Encapsulating lubricants is an expensive and complex step which is unnecessary. Further, encapsulated lubricants tend to burst on breaking and can deliver higher than desired localized lubricants. The encapsulated lubricants can prematurely burst releasing their contents during manufacture of the slurry and/or finishing element. This can contaminate the slurry and/or finishing element and adversely affect their respective finishing performance. Alternate reagents in the lubricant can be stored in the lubricant reservoir or mixed on the fly in the lubricant feed line. Reference Numeral 14 represents a finishing composition feed line for adding other chemicals to the surface of the workpiece such as acids, bases, buffers, other chemical reagents, additional abrasive particles if desired, and the like. Reference Numeral 16 represents a reservoir of finishing composition to be fed to workpiece surface. Not shown is the feed mechanism for the finishing composition such as a variable air or gas pressure or pump mechanism. A preferred embodiment of this invention is to feed liquids from both the lubricant feed line and the finishing composition line which are free of abrasive particles. Feeding a lubricant composition without abrasives is preferred and feeding a lubricant composition without abrasive particles is more preferred. Supplying a lubricant composition without abrasives is preferred and supplying a lubricant composition without abrasive particles is more preferred. Feeding a water borne finishing composition having a lubricant which is free of abrasive particles is also preferred and feeding a water borne finishing composition having a lubricant which is free of abrasive particles is particularly preferred. A lubricant free of separated from the abrasive particles is preferred. A lubricant free of separated from and unconnected to the abrasive particles is preferred. Another preferred embodiment, not shown, is to have a wiping element, preferably an elastomeric wiping element, to uniformly distribute the lubricant across the finishing element finishing surface. Nonlimiting examples of some preferred slurry dispensing systems and slurry wiping elements is found in U.S. Pat. No. 5,709,593 to Guthrie et. al., U.S. Pat. No. 5,246,525 to Junichi, and U.S. Pat. No. 5,478,435 to Murphy et. al. and are included herein by reference in their entirety for general guidance and appropriate modifications by those generally skilled in the art for supplying lubricants. Alternately supplying the lubricant or finishing composition through pores or holes in the finishing element finishing surface to effect a uniform distribution of the lubricant is also effective. Reference Numeral 500 represents an optionally preferred plurality of operative process sensors. Reference Numeral 510 represents a preferred operative processor. Reference Numeral 520 represents a preferred operative controller. Reference Numeral 530 represents some preferred operative connections such as the operative processor to the controller, operative processor to the sensor, controller to the finishing apparatus. The plurality of operative process sensors, the operative processor, and the operative controller together represent a preferred finishing control subsystem which communicates with the sensors, the processor, and the controller to communicate with and control the finishing apparatus. Operative connections are generally known to those skilled in the art. Reference Numerals 500, 510, 520, and 530 can represent a preferred finishing control subsystem. Processors having access to memory look-up tables and databases and the like are generally known to those skilled in the art. A finishing control subsystem having access to at least one processor and/integrated circuit is preferred and to a plurality of processors and/or integrated circuits is more preferred and to a multiplicity of processors and/or integrated circuits is even more preferred. A finishing control subsystem having direct access to a processor(s) and/integrated circuit(s) is preferred. A finishing control subsystem having local access to a processor(s) and/integrated circuit(s) is preferred. A finishing control subsystem having remote access to a processor(s) and/integrated circuit(s) is preferred. Direct access to memory can be preferred. Local access to memory can be preferred. Remote access to memory can be preferred. Sequential access to memory can be preferred. Memory look-up tables are a non-limiting illustrative example of preferred memory. A shared accessible storage means can be a preferred memory. A shared directly accessible storage means can be a preferred memory. A random access memory can be a preferred memory. A random access buffer memory can be a preferred memory. Preferred access can generally depend on the specific application and/or process objective. Direct access is generally faster for high speed needs. Remote access can be generally lower cost for some applications. A combination of direct access and remote access can be generally be used for some process control to reduce unwanted workpiece defects, finishing rates measured in angstroms per minute, and/or advantageously change the cost of manufacture. Memory look-up tables can be integrated with processor and/or in operatively connected memory devices. Operative commercial computers are generally known to those skilled in the art. Illustrative preferred examples include controlling the operative finishing motion. Further examples are discussed herein below. FIGS. 2 and 3 will now provide an artists' expanded view of some relationships between the workpiece and the fixed abrasive finishing element.

FIG. 2 is an artist's closeup drawing of the interrelationships of some of the particularly preferred aspects when finishing according to a preferred embodiment of this invention. Reference Numeral 20 represents the workpiece. Reference Numeral 21 represents the workpiece surface facing away from the workpiece surface being finished. Reference Numeral 22 represents the surface of the workpiece being finished. Reference Numeral 23 represents a high region (unwanted raised region) on the workpiece surface being finished. During finishing, the high region is preferably substantially removed and more preferably, the high region is removed and surface polished. Reference Numeral 24 represents the abrasive finishing element. A fixed abrasive finishing element is particularly preferred. Reference Numeral 26 represents the surface of the finishing element facing the workpiece and is often referred to herein as the finishing element finishing surface. Reference Numeral 30 represents a lubricant and optionally, a finishing composition disposed between the workpiece surface being finished and finishing element finishing surface. A finishing composition comprising a water based composition is preferred. A finishing composition comprising an water based composition which is substantially free of abrasive particles is preferred. The workpiece surface being finished is in operative finishing motion relative to the finishing element finishing surface. The workpiece surface being finished in operative finishing motion relative to the finishing element finishing surface is an example of a preferred operative finishing motion. Reference Numeral 32 represents a preferred operative finishing motion between the surface of the workpiece being finished and finishing element finishing surface. Reference Numeral 33 represents a pressure applied to the operative interface perpendicular to operative finishing motion.

FIG. 3 is an artist's closeup drawing of a preferred embodiment of this invention showing some further interrelationships of the different objects when finishing according to the method of this invention. Reference Numeral 16 represents a carrier for the workpiece and in this particular embodiment, the carrier is a rotating carrier. The rotating carrier is operable to rotate the workpiece against the finishing element which rests against the platen and optionally has a motor. Optionally, the rotating carrier can also be designed to move the workpiece laterally, in an arch, figure eight, or orbitally to enhance uniformity of polishing. The workpiece is in operative contact with the rotating carrier and optionally, has an operative contact element (Reference Numeral 18) to effect the operative contact. An illustrative example of an operative contact element is a workpiece held in place to the rotating carrier with a bonding agent (Reference Numeral 18). A hot wax is an illustrative example of a preferred bonding agent. Alternately, a porometric film can be placed in the rotating carrier having a recess for holding the workpiece. A wetted porometric film (Reference Numeral 18) will hold the workpiece in place by surface tension. An adherent thin film is another preferred example of placing the workpiece in operative contact with the rotating carrier. Reference Numeral 20 represents the workpiece. Reference Numeral 21 represents the workpiece surface facing away from the workpiece surface being finished. Reference Numeral 22 represents the surface of the workpiece being finished. Reference Numeral 24 represents the finishing element. Reference Numeral 26 represents the finishing element finishing surface. Reference Numeral 28 represents the surface of the finishing element facing away from the workpiece surface being finished. Reference Numeral 30 represents the lubricant and optionally, the finishing composition supplied between the workpiece surface being finished and surface of the finishing element facing the workpiece. For some applications the finishing composition and the lubricant can be combined into one feed stream, preferably free of abrasive particles. Reference Numeral 32 represents a preferred direction of the operative finishing motion between the surface of the workpiece being finished and the finishing element finishing surface. Reference Numeral 40 represents the platen or support for the finishing element. The platen can also have an operative finishing motion relative to the workpiece surface being finished. Reference Numeral 42 represents the surface of the platen facing the finishing element. The surface of the platen facing the finishing element is in support contact with the finishing element surface facing away from the workpiece surface being finished. The finishing element surface facing the platen can, optionally, be connected to the platen by adhesion. Frictional forces between the finishing element and the platen can also retain the finishing element against the platen. Reference Numeral 44 is the surface of the platen facing away from the finishing element. Reference Numeral 54 represents the base support structure. Reference Numeral 56 represents the surface of the base support structure facing the platen. The rotatable carrier (Reference Number 16) can be operatively connected to the base structure to permit improved control of pressure application at the workpiece surface being finished (Reference Numeral 22).

Applicant currently believes that the higher than desirable defects in the workpiece surface being finished is due to the fact that the abrasive in a fixed abrasive finishing element tends to scratch or gouge the surface as compared to abrasive particles in a fluid slurry which are free to roll and move during finishing. Further, since the fixed abrasive finishing element has fixed abrasive particles in a constant relative position versus the workpiece surface being finished, applicant believes it is easier for finishing surface of the abrasive particles to become dull or less effective at finishing the workpiece surface being finished when compared to abrasive particles in a slurry. Still further, the fixed abrasive finishing element finishing surface tends to have a higher coefficient of friction than necessary with the workpiece being finished which can lead to destructive surface forces on the workpiece surface being finished such as chatter. Each of the above situations can lead to less than desirable surface quality on the workpiece surface being finished and earlier than necessary wear on the expensive fixed abrasive finishing element finishing surface. Applicant currently believes that proper choice and supply of a lubricant to the interface of the workpiece surface being finished and the finishing element finishing surface can reduce or eliminate the high tendency to scratch and/or damage workpiece surface being finished. Applicant currently believes that proper choice and supply of a lubricant to the interface of the workpiece surface being finished and the finishing element finishing surface can reduce or eliminate the negative effects of high coefficient of friction such as chatter. Applicant currently believes that proper choice and supply of a lubricant to the interface of the workpiece surface being finished and the finishing element finishing surface can extend the useful life of the finishing element finishing surface by reducing erosive forces. The lubricant reduces the wear to the tips of the abrasive particles due to attrition wear and tribochemical wear. Thus the lubricant can help to maintain the "cutting ability" of the abrasive particles. Supplying the lubricant at the point of use and free of abrasive slurry particles can reduce or prevent negative interactions between the finishing composition and the lubricant such as causing instability in either the lubricant composition or finishing composition (and optional slurry particles therein). Supplying the lubricant proximate to workpiece surface being finished is preferred. By supplying the lubricant separate from the finishing composition interactions which can destabilize the finishing composition and/or the fluid lubricant feed are minimized or totally avoided. This increases both lubricant and finishing composition flexibility. Supplying an organic boundary lubricant to the operative finishing interface (located between finishing element finishing surface and the workpiece surface being finished) can further reduce the of chatter, micro localized distortions in the finishing element finishing surface, and also increases the uniformity of finishing across the surface of the workpiece surface being finished. Forming the lubricating boundary layer differentially can improve local planarity and enhance finishing flexibility as discussed herein. Lubrication reduces abrasive wear to the abrasive particles and to the finishing element finishing surface by reducing friction forces. Differential boundary lubrication can enhance localized finishing rates to improve the semiconductor wafer surface. Supplying the lubricant uniformly over the finishing element finishing surface further can reduce risks of chatter, micro localized distortions in the finishing element finishing surface, and also increases the uniformity of finishing across the surface of the workpiece surface being finished. Lubrication reduces breaking away of the abrasive particles from the surface of the fixed abrasive finishing element by reducing friction forces. Higher than needed tangential frictional forces can cause mechanical failure in some semiconductor wafers such as those having a plurality of metal layers, even more particularly when low-k dielectric layers are also incorporated in the semiconductor wafer structure. Differential film lubrication and/or boundary lubrication can enhance localized finishing rates to improve the semiconductor wafer surface while helping to control overall friction forces. Supply of an organic lubricating film is preferred. A marginal amount of organic lubricating film layer or boundary lubricating layer often can help meeting a plurality of these objectives simultaneously. Lubrication reduces the friction which reduces adverse forces particularly on a high speed belt fixed abrasive finishing element which under high friction can cause belt chatter, localized belt stretching, and/or belt distortions, high tendency to scratch and/or damage workpiece surface being finished. Localized and or micro localized distortions to the surface of a fixed abrasive finishing element and chatter can also occur with other finishing motions and/elements and lubrication can reduce or eliminate these.

Supply of lubricant to the interface of the workpiece surface being finished and the finishing element finishing surface to extend the finishing element finishing surface useful life is preferred. Supply of lubricant to the interface of the workpiece surface being finished and the finishing element finishing surface to reduce unwanted surface defects in the workpiece surface being finished is preferred. Supply of lubricant at the point of use is preferred and supply of lubricant with a substantially uniform way to the operative finishing interface at the point of use is currently more preferred. An effective amount of finishing aid from the finishing element finishing surface often can help meeting a plurality of these objectives simultaneously. Supply of a thin lubricating boundary layer is particularly preferred. Supply of lubricant to the interface of the workpiece surface being finished and the finishing element finishing surface to reduce unwanted breaking away of abrasive particles from the fixed abrasive finishing element finishing surface is preferred. An effective amount of boundary lubricant often can help meeting a plurality of these advantages simultaneously.

Control with a finishing process subsystem having at least three process sensors can be used to improve finishing by sensing multiple changes in the operative finishing interface during real time and then calculating and adjusting for these changes in real time (in situ). By combining the information from at least in situ three process sensors with tracked information in real time, the semiconductor wafer tracked information such as micro and macro topography can be used to further enhance finishing control. Different data types can be preferred in the tracked information such as data types relating to prior process conditions and/or micro or macro topography information. This process information when coupled with tracked information can help improve in situ control when finishing a workpiece such as semiconductor wafer with lubricant. By controlling the change the coefficient of friction in the operative interface a multiple times during the finishing cycle time, finishing can generally be improved. By controlling or changing finishing rate measured in angstroms per minute in the operative finishing interface multiple times during the finishing cycle time, finishing can generally be improved. By controlling or changing the finishing of the workpiece in the interface multiple times during the finishing cycle time, finishing can generally be more versatile and hence, generally improved. Finishing can be controlled and/or changed on the workpiece and/or in uniform regions of the workpiece.

The new problem recognition and unique solution are new and considered part of this invention.

Finishing Element

A finishing element having chemical mechanical finishing are known. A finishing element having a finishing surface for finishing is generally also known. Commercial abrasive finishing elements are known. Illustrative commercial finishing elements are marketed by Rodel, Cabot Microelectronics, Ebara, and 3M. As used herein a fixed abrasive finishing element is a integral abrasive finishing element. Some nonlimiting illustrative examples of finishing elements, their construction, and some preferred components are found in U.S. Pat. No. 6,390,890 to Molnar, U.S. Pat. No. 6,413,153 to Molnar, and U.S. Pat. No. 6,641,463 to Molnar and they are included by reference in their entirety for all purposes and guidance and appropriate modification by those skilled in the arts. A finishing surface which is a abrasive particle free can be preferred for some applications. A finishing surface having abrasive particles can be preferred for some applications. The integral abrasive finishing element having abrasives particles connected to at least the surface of the finishing element is preferred. The integral abrasive finishing element having abrasives particles connected to at least the surface of the finishing element and which is substantially free of unconnected abrasive particles except for those formed during the actual finishing process itself is more preferred. A three dimensional fixed abrasive finishing element as used herein is a fixed abrasive finishing element having multiple abrasive particles dispersed throughout at least as portion of its thickness such that if some of the surface is removed additional abrasive particles are exposed on the newly exposed surface. A fixed abrasive finishing element which applies a substantially uniform distribution of abrasive particles over the workpiece surface being finished is preferred.

A fixed abrasive finishing element comprising at least one material selected from the group consisting of an organic synthetic resin, an inorganic polymer, and combinations there of is preferred. A preferred example of organic synthetic resin is an thermoplastic resin. Another preferred example of an organic synthetic resin is a thermoset resin. Preferred examples of organic synthetic resins consist of materials selected from the group consisting of polyurethanes, polyolefins, polyesters, polyamides, polystyrenes, polycarbonates, polyvinyl chlorides, polyimides, epoxies, chloroprene rubbers, ethylene propylene elastomers, butyl resins, polybutadienes, polyisoprenes, EPDM elastomers, and styrene butadiene elastomers. Preferred stiff finishing surfaces can comprise polyphenylene sulfide, polysulfone, and polyphenylene oxide polymers. Phenolic polymers can also be used. Copolymer resins are also preferred. Polyolefin resins are particularly preferred for their generally low cost. Polyurethanes are preferred for the inherent flexibility in formulations. A finishing element comprising a foamed organic synthetic resins are particularly preferred. Finishing elements comprising compressible and porous material is preferred.

A fixed abrasive finishing element comprised of a synthetic resin composition is preferred. A fixed abrasive finishing element comprising at least one layer of a soft synthetic resin is preferred. A fixed abrasive finishing element comprising at least one layer of a elastomeric synthetic resin is preferred. A fixed abrasive finishing element comprising at least one layer of a thermoset elastomeric synthetic resin is preferred.

The fixed abrasive firmly attached to the finishing element finishing surface is preferred. The abrasive can be firmly attached to the finishing element finishing surface with known adhesives and/or mixed into a surface layer of a polymeric layer, preferably an organic polymeric layer. Particular abrasive surface topographies can be preferred for specific applications. Fixed abrasive finishing elements are generally known to those skilled in the art. Some nonlimiting examples include U.S. Pat. No. 4,966,245 to Callinan, U.S. Pat. No. 5,692,950 to Rutherford, U.S. Pat. No. 5,823,855 to Robinson, WO 98/06541 to Rutherford and WO 98/181159 to Hudson are included herein for general guidance and modification of fixed abrasive finishing elements by those skilled in the art.

An abrasive finishing element having abrasive asperities on the finishing element finishing surface is preferred. An abrasive finishing element having abrasive asperities having a height from 0.5 to 0.005 micrometers is preferred and an abrasive finishing element having abrasive asperities having a height from 0.3 to 0.005 micrometers is more preferred and an abrasive finishing element having abrasive asperities having a height from 0.1 to 0.01 micrometers is even more preferred and an abrasive finishing element having abrasive asperities having a height from 0.05 to 0.005 micrometers is more particularly preferred, the asperities are preferably firmly attached to the finishing element finishing surface and asperities which are an integral part of the finishing element finishing surface are more preferred. Polymeric abrasive asperities can be preferred for some finishing operations. Inorganic abrasive asperities can be preferred also for some finishing operations. Polymeric abrasive asperities, such as abrasive polymeric particles and/or abrasive polymeric material, are generally preferred for finishing softer workpieces and inorganic abrasive asperities are generally preferred for finishing harder workpiece surfaces. A finishing surface capable of inducing frictional wear to the workpiece surface being finished is preferred and a finishing surface capable of inducing tribochemical reactions on the workpiece surface during finishing is also preferred. An abrasive finishing surface capable of inducing frictional wear to the workpiece surface being finished is preferred and an abrasive finishing surface capable of inducing tribochemical reactions on the workpiece surface during finishing is also preferred. A wear inducing finishing surface capable of inducing frictional wear to the workpiece surface being finished is even more preferred and a wear inducing finishing surface capable of inducing tribochemical reactions on the workpiece surface during finishing is also even more preferred. A wear inducing finishing surface capable of inducing plastic deformation of a workpiece surface comprised of a polymer is preferred and a wear inducing finishing surface capable of inducing plastic deformation of a workpiece surface comprised at least in part of an organic synthetic polymer is more preferred. An abrasive finishing element having small asperities can finish a workpiece surface to fine tolerances.

Some illustrative nonlimiting examples of preferred finishing elements for use in the invention are also discussed. A finishing element having at least a layer of an elastomeric material having a Shore A hardness of at least 30 A is preferred. ASTM D 676 is used to measure hardness. A porous finishing element is preferred to more effectively transfer the polishing slurry to the surface of the workpiece being finished. A finishing element comprising a synthetic resin material is preferred. A finishing element comprising a thermoset resin material is more preferred. A finishing element having layers of different compositions is preferred to improve the operative finishing motion on the workpiece surface being finished. As an example, a finishing element having two layers, one a hard layer and one a soft layer, can better transfer the energy of operative finishing motion to the workpiece surface being finished than a similar thickness finishing element of only a very soft layer. A thermoset synthetic resin is less prone to elastic flow and thus is more stable in this application. A finishing element which is thin is preferred because it generally transfers the operative finishing motion to the workpiece surface being finished more efficiently. A finishing element having a thickness from 0.5 to 0.002 cm is preferred and a thickness from 0.3 to 0.005 cm is more preferred and a finishing element having a thickness from 0.2 to 0.01 cm is even more preferred. Current synthetic resin materials can be made quite thin now. The minimum thickness will be determined by the finishing element's integrity and longevity during polishing which will depend on such parameters as tensile and tear strength. A finishing element having sufficient strength and tear strength for chemical mechanical finishing is preferred.

An abrasive finishing element having a flex modulus in particular ranges is also preferred. An abrasive finishing element having a high flex modulus is generally more efficient for planarizing. An abrasive finishing element having a low flex modulus is generally more efficient for polishing. Further a continuous belt fixed abrasive finishing element can have a different optimum flex modulus than a fixed abrasive finishing element disk. One also needs to consider the workpiece surface to be finished in selecting the flex modulus. A fixed abrasive finishing element comprising a synthetic resin having flex modulus of at most 1,000,000 psi is preferred and having flex modulus of at most 800,000 psi is more preferred and 500,000 psi is more preferred. Flex modulus is preferably measured with ASTM 790 B at 73 degrees Fahrenheit. Fixed abrasive finishing elements comprising a synthetic resin having a very low flex modulus are also generally known to those skilled in the art such as elastomeric polyurethanes which can also be used. A finishing element having a flex modulus of greater than 1,000,000 psi can be preferred for some particular planarizing applications.

For some embodiments, polishing pad designs and equipment such as in U.S. Pat. No. 5,702,290 to Leach, a polishing pad having a high flexural modulus can be effective and preferred. A finishing element having a continuous phase of material imparting resistance to local flexing is preferred. A preferred finishing element has a finishing surface comprising a multiphase polymeric finishing surface. A more preferred finishing element has a finishing surface comprising a multiphase polymeric finishing surface having at least two synthetic polymers (e.g. separate polymeric components). An even more preferred finishing element has a finishing comprising a multiphase polymeric finishing surface having at least three synthetic polymers (e.g. separate polymeric components). A preferred continuous phase of material is a synthetic polymer, more preferably an organic synthetic polymer. An organic synthetic polymer having a flexural modulus of at least 50,000 psi is preferred and having a flexural modulus of at least 100,000 psi is more preferred and having a flexural modulus of at least 200,000 psi is even more preferred for the continuous phase of synthetic polymer in the finishing element. An organic synthetic polymer having a flexural modulus of at most 5,000,000 psi is preferred and having a flexural modulus of at most 3,000,000 psi is more preferred and having a flexural modulus of at most 2,000,000 psi is even more preferred for the continuous phase of synthetic polymer in the finishing element. For some less demanding applications (such as die with a lower pattern density), a flexural modulus of at least 20,000 psi is preferred. These ranges of flexural modulus for the synthetic polymers provide useful performance for finishing a semiconductor wafer and can improve local planarity in the semiconductor. Flexural modulus is preferably measured with ASTM 790 B at 73 degrees Fahrenheit. Pounds per square inch is psi. By increasing the stiffness of the finishing element finishing surface, the pressure applied to the unwanted raised region can be increased. Flexural modulus as measured by ASTM 790 B at 73 degrees Fahrenheit is a useful guide to help raise the stiffness of a polymer finishing element.

An abrasive finishing element having Young's modulus in particular ranges is also preferred. An abrasive finishing element having a high Young's modulus is generally more efficient for planarizing. An abrasive finishing element having a low Young's modulus is generally more efficient for polishing. Further a continuous belt fixed abrasive finishing element can have a different optimum Young's modulus than a fixed abrasive finishing element disk. One also needs to consider the workpiece surface to be finished in selecting the Young's modulus. For a flexible abrasive finishing element having a Young's modulus from 100 to 700,000 psi (pounds per square in inch) is preferred and having a Young's modulus from 300 to 200,000 psi (pounds per square in inch) is more preferred and having a Young's modulus from 300 to 150,000 psi (pounds per square in inch) is even more preferred. Particularly stiff abrasive finishing elements can have a preferred Young's modulus of at least 700,000 psi. For particularly flexible abrasive finishing elements, a Young's modulus of less than 100,000 psi are preferred and less than 50,000 psi is more preferred.

Illustrative preferred abrasive particles comprising silica, silicon nitride, alumina, and ceria are preferred. Fumed silica is particularly preferred. A metal oxide is a type of preferred abrasive particle. A particularly preferred particulate abrasive is an abrasive selected from the group consisting of iron (III) oxide, iron (II) oxide, magnesium oxide, barium carbonate, calcium carbonate, manganese dioxide, silicon dioxide, cerium dioxide, cerium oxide, chromium (III) trioxide, and aluminum trioxide. Abrasive particles having an average diameter of less than 0.5 micrometers is preferred and less than 0.3 micrometer is more preferred and less than 0.1 micrometer is even more preferred and less than 0.05 micrometers is even more particularly preferred. Abrasive particles having an average diameter of from 0.5 to 0.01 micrometer is preferred and between 0.3 to 0.01 micrometer is more preferred and between 0.1 to 0.01 micrometer is even more preferred.

Abrasive particles having a different composition from the finishing element body are preferred. An abrasive particle having a Knoops hardness of less than diamond is particularly preferred to reduce microscratches on workpiece surface being finished and a Knoops hardness of less than 50 GPa is more particularly preferred and a Knoops hardness of less than 40 GPa is even more particularly preferred and a Knoops hardness of less than 35 GPa is especially particularly preferred. An abrasive particle having a Knoops hardness of at least 1.5 GPa is preferred and having a Knoops hardness of at least 2 is preferred. An abrasive particle having a Knoops hardness of from 1.5 to 50 GPa is preferred and having a Knoops hardness of from 2 to 40 GPa is preferred and having a Knoops hardness of from 2 to 30 GPa is even more preferred. A fixed abrasive finishing element having a plurality of abrasive particles having at least two different Knoops hardnesses can be preferred.

Figure 4A:
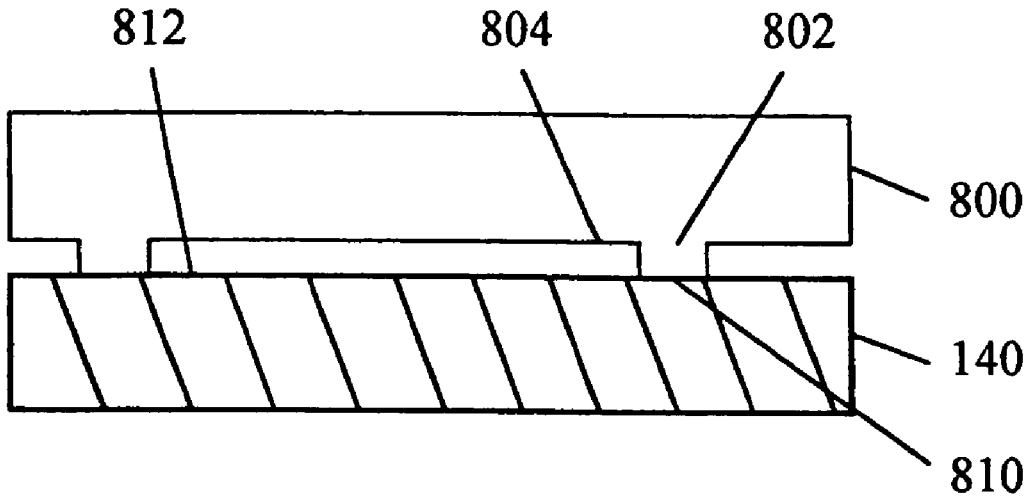
FIG. 4 is an artist's representation of finishing some unwanted raised regions and some regions below the unwanted raised regions with differential boundary lubrication.
Figure 4B:
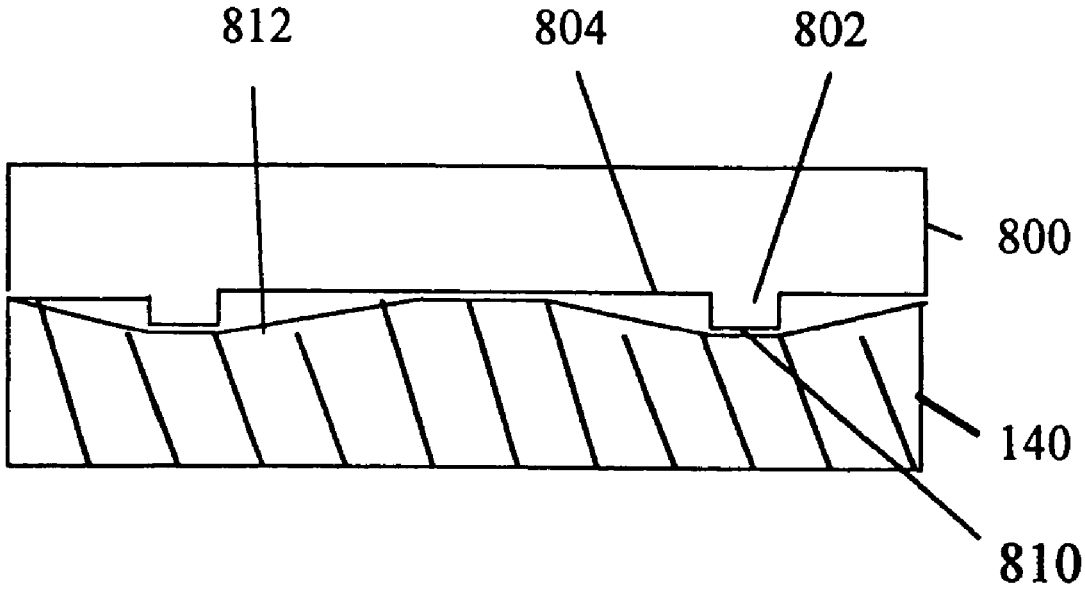

FIG. 4 is an artist's representation of finishing some unwanted raised regions and some regions below the unwanted raised regions. Reference Numeral 800 represents a portion of a semiconductor wafer surface having two unwanted raised regions. Reference Numeral 802 represent unwanted raised regions on the semiconductor surface being finished. Reference Numeral 804 represent lower local regions on the semiconductor surface being finished proximate to the unwanted raised regions. Reference Numeral 810 represents the finishing element finishing surface in local contact with the unwanted raised regions (Reference Numeral 802). Reference Numeral 812 represents the finishing element surface local region displaced from but proximate to and lower than the unwanted raised local regions. As shown the finishing element finishing surface can reduce pressure and/or lose actual contact with the lower local regions on the semiconductor proximate to the unwanted raised local regions. This leads to unwanted raised regions having higher pressure which in turn can reduce the lubricating boundary layer thickness (or lubricating film layer thickness) in the unwanted raised regions. Reducing the boundary layer thickness (or lubricating film layer thickness) generally increases local tangential friction forces, raises the finishing rate measured in angstroms per minute on the unwanted raised regions. Also the pressure in lower regions proximate the unwanted raised regions have lower pressure applied which in turn can increase lubricating boundary layer thickness (or lubricating film layer thickness) in these lower regions. Increasing the lubricating boundary layer thickness (or lubricating film layer thickness) generally decreases local tangential forces lowering the finishing rate measured in angstroms per minute in these lower regions proximate the unwanted raised regions. By increasing finishing rate in the unwanted raised regions and lowering the finishing rate in the proximate lower regions the planarity of the semiconductor is generally improved. This generally helps the unwanted raised regions to have higher finishing rates when measured in angstroms per minute and improves within die nonuniformity. As shown in the FIG. 4, the region of contact with the unwanted raised region is small which in turn raises the finishing pressure applied by the finishing elements having a higher flexural modulus and this increased pressure increases the finishing rate measured in angstroms per minute at the unwanted raised region. This higher pressure on the unwanted raised region also increases frictional heat which can further increase finishing rate measured in angstroms per minute in the unwanted raised region. Boundary lubrication (or lubricating film layer thickness) on the unwanted raised region can be reduced due to the higher temperature and/or pressure which further increases friction and finishing rate measured in angstroms per minute. Higher stiffness finishing element finishing surfaces apply higher pressures to the unwanted raised local regions which can further improve planarization, finishing rates, and within die nonuniformity. Finishing using finishing elements of this in invention wherein the unwanted raised regions have a finishing rate measured in angstroms per minute of at least 1.6 times faster than in the proximate low local region measured in angstroms per minute is preferred and wherein the unwanted raised regions have a finishing rate of at least 2 times faster than in the proximate low local region is more preferred and wherein the unwanted raised regions have a finishing rate of at least 4 times faster than in the proximate low local region is even more preferred. Where there is no contact with the proximate low local region, the finishing rate in the low local region can be very small and thus the ratio between the finishing rate in the unwanted raised region to finishing rate in the low local region can be large. Using boundary lubrication control methods of this in invention wherein the unwanted raised regions have a finishing rate measured in angstroms per minute of from 1.6 to 500 times faster than in the proximate low local region measured in angstroms per minute is preferred and wherein the unwanted raised regions have a finishing rate of from 2 to 300 times faster than in the proximate low local region is more preferred and wherein the unwanted raised regions have a finishing rate of from 2 to 200 times faster than in the proximate low local region is even more preferred and wherein the unwanted raised regions have a finishing rate of from 4 to 200 times faster than in the proximate low local region is even more preferred.

By increasing the stiffness of the finishing element finishing surface, the pressure applied to the unwanted raised region can be increased. Flexural modulus as measured by ASTM 790 B at 73 degrees Fahrenheit is a useful guide to help raise the stiffness of a polymer finishing element. By adjusting the flexural modulus as measured by ASTM 790 B at 73 degrees Fahrenheit the pressure can be increased on the unwanted raised regions to increase finishing rates measured in Angstroms per minute. Applying at least two times higher pressure to the unwanted raised region when compared to the applied pressure in a lower region proximate unwanted raised region is preferred and applying at least three times higher pressure to the unwanted raised region when compared to the applied pressure in a lower region proximate unwanted raised region is more preferred and applying five times higher pressure to the unwanted raised region when compared to the applied pressure in a lower region proximate unwanted raised region is even more preferred. Because the lower region proximate the unwanted raised region can have a very low pressure, at most 100 times higher pressure in the unwanted raised regions compared to the pressure in a lower region proximate the unwanted raised region is preferred and at most 50 times higher pressure in the unwanted raised regions compared to the pressure in a lower region proximate the unwanted raised region is more preferred. Applying 2 to 100 times higher pressure to the unwanted raised region when compared to the applied pressure in a lower region proximate unwanted raised region is preferred and applying at least 3 to 100 times higher pressure to the unwanted raised region when compared to the applied pressure in a lower region proximate unwanted raised region is more preferred and applying 5 to 50 times higher pressure to the unwanted raised region when compared to the applied pressure in a lower region proximate unwanted raised region is even more preferred. Applying an operative finishing motion wherein the unwanted raised regions have a temperature of at least 3 degrees centigrade higher than in the proximate low local region is preferred and finishing wherein the unwanted raised regions have a temperature of at least 7 degrees centigrade higher than in the proximate low local region is more preferred and finishing wherein the unwanted raised regions have a temperature of at least 10 degrees centigrade higher than in the proximate low local region is even preferred. Finishing wherein the unwanted raised regions have a temperature from 3 to 50 degrees centigrade higher than in the proximate low local region is preferred and finishing wherein the unwanted raised regions have a temperature from 7 to 45 degrees centigrade higher than in the proximate low local region is more preferred and finishing wherein the unwanted raised regions have a temperature of from 10 to 40 degrees centigrade higher than in the proximate low local region is even more preferred. By adjusting the flexural modulus of the finishing element finishing surface, lubricating film layer and preferably lubricating boundary layer, and the other control parameters discussed herein, finishing and planarization of semiconductor wafer surfaces can be accomplished. By adjusting the flexural modulus of the finishing element finishing surface, lubricating boundary layer, and the other control parameters discussed herein, finishing and planarization of semiconductor wafer surfaces can be accomplished. The lubricating boundary layer will now be illustrated in FIG. 5.

Figure 5:
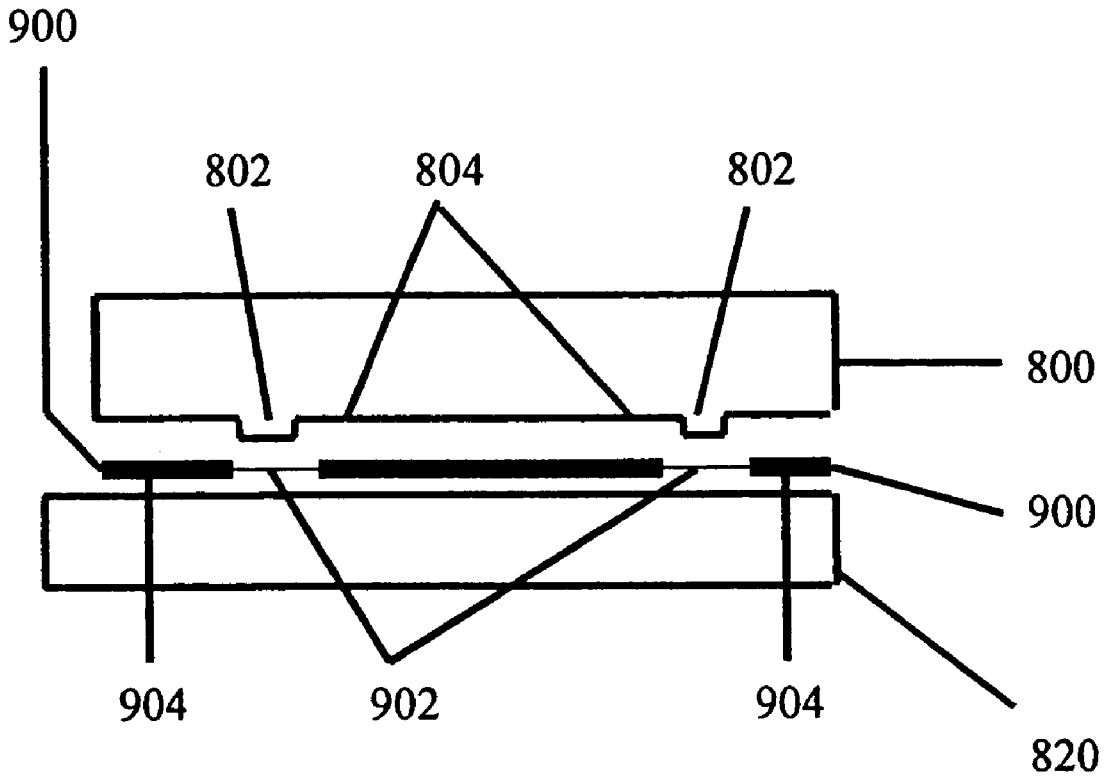
FIG. 5 is an artist's representation of an example of the effects on the boundary layer lubrication.

FIG. 5 is an artist's representation of an example of the effects on the boundary layer lubrication discussed herein above. As discussed herein, it is not drawn to scale so the boundary layer thickness can be illustrated in simple fashion for helpful guidance. Reference Numeral 800 represents a cross-sectional view of a semiconductor wafer having two unwanted raised regions (Reference Numeral 802). Reference Numeral 804 represents a cross-sectional view of a semiconductor wafer having lower regions proximate to the two unwanted raised regions (Reference Numeral 802). Reference Numeral 900 represents the lubricating boundary layer. Reference Numeral 902 represents thinner regions of lubricating boundary layer (for instance having a thickness of 4 molecules). Note that the thinner regions of a lubricating boundary layer can occur proximate the unwanted raised regions on the semiconductor wafer surface being finished. Reference Numeral 904 represents a thicker region of lubricating boundary layer which can generally occur in regions proximate to and below the unwanted raised regions. Reference Numeral 820 represents a small cross-section of finishing element. The different local regions having different lubricating boundary layers and lubricating properties is referred to herein as differential boundary lubrication. Differential boundary lubrication can improve planarization for some semiconductor wafers (particularly at the die level).

Workpiece

A workpiece needing finishing is preferred. A semiconductor wafer made by a preferred method is preferred. A homogeneous surface composition is a workpiece surface having one composition throughout and is preferred for some applications. A workpiece needing polishing is preferred. A workpiece needing planarizing is especially preferred. A workpiece having a microelectronic surface is preferred. A workpiece surface having a heterogeneous surface composition is preferred. A heterogeneous surface composition has different regions with different compositions on the surface. A workpiece having a microelectronic surface having both conductive regions and nonconductive regions is more preferred and is an example of a preferred heterogeneous workpiece surface. Illustrative examples of conductive regions can be regions having copper or tungsten and other known conductors, especially metallic conductors. Metallic conductive regions in the workpiece surface including metals selected from the group consisting of copper, aluminum, and tungsten or combinations thereof are particularly preferred. A semiconductor device is a preferred workpiece. A substrate wafer is a preferred workpiece. A semiconductor wafer having a polymeric layer requiring finishing is preferred because a lubricant can be particularly helpful in reducing unwanted surface damage to the softer polymeric surfaces. An example of a preferred polymer is a polyimide. Polyimide polymers are commercially available from E. I. DuPont Co. in Wilmington, Del.

This invention is particularly preferred for workpieces requiring a highly flat surface. Finishing a workpiece surface to a surface to meet the specified semiconductor industry circuit design rule is preferred and finishing a workpiece surface to a surface to meet the 0.35 micrometers feature size semiconductor design rule is more preferred and finishing a workpiece surface to a surface to meet the 0.25 micrometers feature size semiconductor design rule is even more preferred and finishing a workpiece surface to a to meet the 0.18 micrometers semiconductor design rule is even more particularly preferred. An electronic wafer finished to meet a required surface flatness of the wafer device rule in to be used in the manufacture of ULSIs (Ultra Large Scale Integrated Circuits) is a particularly preferred workpiece made with a method according to preferred embodiments of this invention. The design rules for semiconductors are generally known to those skilled in the art. Guidance can also be found in the "The National Technology Roadmap for Semiconductors" published by SEMATECH in Austin, Tex.

Supplying finishing aid to a semiconductor wafer during finishing having a diameter of at least 200 mm is preferred and supplying a finishing aid to a semiconductor wafer during finishing having a diameter of at least 300 mm is more preferred. Supplying reactive finishing aid to a semiconductor wafer during finishing having a diameter of at least 200 mm is even more preferred and supplying reactive finishing aid to a semiconductor wafer during finishing having a diameter of at least 300 mm is more preferred. Supplying an organic finishing aid to a semiconductor wafer during finishing having a diameter of at least 200 mm is preferred and supplying an organic finishing aid to a semiconductor wafer during finishing having a diameter of at least 300 mm is more preferred. Supplying an organic reactive finishing aid to a semiconductor wafer during finishing having a diameter of at least 200 mm is even more preferred and supplying an organic reactive finishing aid to a semiconductor wafer during finishing having a diameter of at least 300 mm is more preferred. Supplying an organic lubricant to a semiconductor wafer during finishing having a diameter of at least 200 mm is preferred and supplying an organic lubricant to a semiconductor wafer during finishing having a diameter of at least 300 mm is more preferred. Supplying reactive lubricant to a semiconductor wafer during finishing having a diameter of at least 200 mm is even more preferred and supplying reactive lubricant to a semiconductor wafer during finishing having a diameter of at least 300 mm is more preferred. Large semiconductor wafers can generally be finished more effectively with a finishing aid and/or an aqueous lubricating composition. Friction, finishing rates, and heat generation can generally be more effectively controlled.

For finishing of semiconductor wafers having low-k dielectric layers (low dielectric constant layers), finishing aids, more preferably lubricating aids, are preferred. Illustrative nonlimiting examples of low-k dielectrics are low-k polymeric materials, low-k porous materials, and low-k foam materials. As used herein, a low-k dielectric has at most a k range of less than 3.5 and more preferably less than 3.0 and even more preferably less than 2.5 and even more especially preferred is less than 2.0. Illustrative examples include doped oxides, organic polymers, highly fluorinated organic polymers, and porous materials. A porous low-k dielectric layer is a preferred low-k dielectric layer. Low-k dielectric materials are generally known to those skilled in the semiconductor wafer arts. Abrasive organic synthetic resin particles can be effective to finishing low-dielectric materials. Abrasive organic synthetic resin asperities can be effective to finishing low-dielectric materials. Multilevel semiconductor wafers such as those having low-k dielectric layers and multilevel metal layers are generally known by those skilled in the semiconductor arts and U.S. Pat. No. 6,153,833 to Dawson et al. is included herein by reference for general non-limiting guidance for those skilled in the art. Since low-k dielectric layers generally have lower mechanical strength, the lower coefficient of friction that is offered by organic lubricating boundary layers is particularly preferred. A semiconductor wafer having a plurality of low-k dielectric layers is a preferred workpiece and a semiconductor wafer having at least 3 of low-k dielectric layers is a more preferred workpiece and a semiconductor wafer having at least 5 of low-k dielectric layers is an even more preferred workpiece. Providing a finishing aid to a semiconductor having at least 3 low-k dielectric layers during finishing is preferred and to a semiconductor having at least 5 low-k dielectric layers is even more preferred. Supplying a lubricant to a plurality of the low-k dielectric layers during finishing of the same semiconductor wafer is preferred and supplying a lubricant to at least 3 of the low-k dielectric layers during finishing of the same semiconductor wafer is more preferred and supplying a lubricant to at least 5 of the low-k dielectric layers during finishing of the same semiconductor wafer is even more preferred. A semiconductor wafer having at most 10 low-k dielectric layers is currently preferred but in the future this can increase. Semiconductor wafers for logic integrated circuits are particularly preferred. Defects caused during finishing can be reduced by supplying a lubricant.

A semiconductor wafer having multiple logic die with multiple low-k dielectric layers is a preferred workpiece. A semiconductor wafer having multiple memory die with multiple low-k dielectric layers is a preferred workpiece. These workpieces can be improved by reducing unwanted surface damage and/or unwanted tangential forces of friction during finishing.

A semiconductor wafer having a plurality of metal layers is a preferred workpiece and a semiconductor wafer having at least 3 metal layers is a more preferred workpiece and a semiconductor wafer having at least 5 metal layers is an even more preferred workpiece. A semiconductor wafer having at most 10 metal layers is currently preferred but in the future this will increase. A semiconductor wafer having logic chips or logic die is particularly preferred because they can have multiple metal layers for supplying lubricants such as preferred lubricants during finishing. Providing a finishing aid to a plurality of finishing layers of the same semiconductor wafer is preferred and providing a finishing aid to at least 3 of finishing layers of the same semiconductor wafer is more preferred and providing a finishing aid to at least 5 of finishing layers of the same semiconductor wafer is more preferred. Supplying a lubricant to a plurality of finishing layers of the same semiconductor wafer is preferred and supplying a lubricant to at least 3 of finishing layers of the same semiconductor wafer is more preferred and supplying a lubricant to at least 5 of finishing layers of the same semiconductor wafer is more preferred. A semiconductor wafer with at most 12 layers is currently generally preferred but the number of layers will increase in the future. Defects caused during finishing can be reduced by supplying a finishing aid and/or a lubricant. Semiconductor wafers having a plurality of metal layers or dielectric layers are generally known to those skilled in the semiconductor wafer arts and U.S. Pat. No. 5,516,346 to Cadien et al. and U.S. Pat. No. 5,836,806 to Cadien et al. are included herein in their entirety for general illustrative guidance. Further, defects in the first finished layer can cause defects in the second finished layer (and so on). In other words, defects in a prior layer can cause defects in a latter layer. Preferred in situ control can help reduce unwanted defects. Thus by supplying a lubricant during finishing (with preferred situ control), one can improve yields by minimizing unwanted defects in both the current and subsequent layers. A method which updates the cost of manufacture control parameters, look-up tables, algorithms, or control logic consistent with the current manufacturing step is preferred. A method which updates the cost of manufacture control parameters, look-up tables, algorithms, or control logic consistent with the current manufacturing step while evaluating prior manufacturing steps (such as completed manufacturing steps) is preferred. A method which updates the cost of manufacture control parameters, look-up tables, algorithms, or control logic consistent with the current manufacturing step while evaluating future manufacturing steps is preferred. A method which updates the cost of manufacture control parameters, look-up tables, algorithms, or control logic consistent with the current manufacturing step while evaluating both prior and future manufacturing steps is more preferred. The semiconductor wafer can be tracked for each finishing step during processing with a tracking means such as tracking code. As an illustrative example, a semiconductor wafer can be assigned with a trackable UPC code. U.S. Pat. No. 5,537,325 issued to Iwakiri, et al. on Jul. 16, 1997 teaches a method to mark and track semiconductor wafers sliced from an ingot through the manufacturing process and is included for by reference in its entirety for general guidance and appropriate modification by those skilled in the art. As a nonlimiting example, Cognex Corporation in Natick, Mass. markets commercial tacking means for tracking semiconductor wafers. As further illustration of preferred tracking codes include 2D matrix (such as SEMI 2D matrix), alphanumeric, and bar codes. Processes, performance, and preferred lubrication conditions and information can be tracked and stored by wafer (and/or wafer batches) with this technology when used with the new disclosures herein.

Finishing in preferred value ranges of the coefficient of friction and/or effective coefficient of friction is generally advantageous. Using the coefficient of friction and/or effective coefficient of friction to manage, control, and improve finishing results by reducing unwanted surface defects and improving semiconductor wafer processing costs is a particularly preferred embodiment of this invention. Using the coefficient of friction and/or effective coefficient of friction to control in situ, real time finishing is particularly preferred.

Preferred semiconductor wafer surfaces can be heterogeneous. A heterogeneous semiconductor preferably has different uniform regions such as conductive regions and non-conductive regions. Another preferred example is a having more conductive regions and less conductive regions. During finishing it is often the case that one of the uniform regions is particularly preferred during finishing. Also, because of differences such as surface energy, preferred marginal lubrication may be more preferred for one uniform region or the other uniform region. A preferred uniform region in some applications is the conductive region. A preferred uniform region in some applications is the non-conductive region. Heterogeneous semiconductor wafer surfaces are generally known to those skilled in the semiconductor wafer processing arts.

Finishing Composition

A finishing composition having a lubricant can be preferred for finishing when an abrasive medium, abrasive finishing element finishing surface, or fixed abrasive finishing element finishing surface is employed for finishing semiconductor wafer surfaces.

Finishing compositions are generally known for fixed abrasive finishing. A chemical mechanical polishing slurry can also be used as finishing composition. Alternately, a finishing composition can be modified by those skilled in the art by removing the abrasive particles to form a finishing composition free of abrasive particles. A finishing composition substantially free of abrasive particles is preferred and a finishing composition free of abrasive particles is more preferred. Finishing compositions have their pH adjusted carefully, and generally comprise other chemical additives are used to effect chemical reactions and/other surface changes to the workpiece. A finishing composition having dissolved chemical additives is particularly preferred. Illustrative examples preferred dissolved chemical additives include dissolved acids, bases, buffers, oxidizing agents, reducing agents, stabilizers, and chemical reagents. A finishing composition which substantially reacts with material from the workpiece surface being finished is particularly preferred. A finishing composition which selectively chemically reacts with only a portion of the workpiece surface is particularly preferred. A finishing composition which preferentially chemically reacts with only a portion of the workpiece surface is particularly preferred.

Some illustrative nonlimiting examples of polishing slurries which can be used and/or modified by those skilled in the art are now discussed. An example slurry comprises water, a solid abrasive material and a third component selected from the group consisting of $HNO_3$, $H_2SO_4$, and $AgNO_3$ or mixtures thereof. Another polishing slurry comprises water, aluminum oxide, and hydrogen peroxide mixed into a slurry. Other chemicals such as KOH (potassium hydroxide) can also be added to the above polishing slurry. Still another illustrative polishing slurry comprises $H_3PO_4$ at from about 0.1% to about 20% by volume, $H_2O_2$ at from 1% to about 30% by volume, water, and solid abrasive material. Still another polishing slurry comprises an oxidizing agent such as potassium ferricyanide, an abrasive such as silica, and has a pH of between 2 and 4. Still another polishing slurry comprises high purity fine metal oxides particles uniformly dispersed in a stable aqueous medium. Still another polishing slurry comprises a colloidal suspension of $SiO_2$ particles having an average particle size of between 20 and 50 nanometers in alkali solution, demineralized water, and a chemical activator. U.S. Pat. No. 5,209,816 to Yu et. al. issued in 1993, U.S. Pat. No. 5,354,490 to Yu et. al. issued in 1994, U.S. Pat. No. 5,540,810 to Sandhu et. al. issued in 1996, U.S. Pat. No. 5,516,346 to Cadien et. al. issued in 1996, U.S. Pat. No. 5,527,423 to Neville et. al. issued in 1996, U.S. Pat. No. 5,622,525 to Haisma et. al. issued in 1997, and U.S. Pat. No. 5,645,736 to Allman issued in 1997 comprise illustrative nonlimiting examples of slurries contained herein for further general guidance and modification by those skilled in the arts. Commercial CMP polishing slurries are also available from Rodel Manufacturing Company in Newark, Del. Application WO 98/18159 to Hudson gives general guidance for those skilled in the art for modifying current slurries to produce an abrasive free finishing composition.

In a preferred mode, the finishing composition is free of abrasive particles. However as the fixed abrasive finishing element wears down during finishing, some naturally worn fixed abrasive particles can be liberated from the fixed abrasive finishing element can thus temporarily be present in the finishing composition until drainage or removal.

Finishing Aids and Lubricants

A method to add a finishing aid or lubricants with a fluid can be particularly preferred because the amount and timing can be controlled for the particular finishing at hand. Fluid based lubricants can be preferred for finishing when a fixed abrasive finishing pad finishing surface is employed. A water based lubricant is preferred because of environmental friendliness reasons. A water based lubricant can also reduce concerns for contamination in the clean room fabrication of semiconductor wafers. A water based lubricant formed with purified water is preferred and deionized water is particularly preferred. A water based lubricant formed with water which has low sodium content is also preferred because sodium can have a adverse performance effect on the preferred semiconductor parts being made. A lubricant free of sodium is a preferred lubricant. As used herein a lubricant fluid free of sodium means that the sodium content is below the threshold value of sodium which will adversely impact the performance of a semiconductor wafer or semiconductor parts made therefrom.

Supplying a lubricant at least a portion of the finishing cycle time is preferred, particularly where polishing of the workpiece surface is generally an objective.

Supplying an effective amount of lubricant which reduces the coefficient of friction between the finishing element finishing surface and the workpiece surface being finished is preferred. Supplying an effective amount of lubricant which reduces the unwanted surface damage to the surface of the workpiece being finished during finishing is preferred. Supplying an effective amount of lubricant which differentially lubricates different regions of the work piece and reduces the unwanted surface damage to at least a portion of the surface of the workpiece being finished during finishing is preferred. By providing an effective amount of finishing aid, preferably an organic lubricating aid, to the surface of the workpiece, advantageous changes generally to process control and/or the cost of manufacture can generally be effected.

The lubricants can help reduce the formation of surface defects for high precision part finishing. Fluid based lubricants can help reduction of brittle fracture at the workpiece surface being finished. A method of finishing which adds an effective amount of fluid based lubricant is preferred. A preferred effective amount of fluid based lubricant reduces the occurrence of unwanted surface defects. A preferred effective amount of fluid based lubricant can reduce the coefficient of friction between the work piece surface being finished and the finishing element finishing surface.

A reactive organic lubricant is preferred. A reactive organic lubricating film is more preferred. A lubricant comprising a reactive lubricant is preferred. A lubricant comprising a boundary lubricant is also preferred. A lubricating boundary layer is particularly preferred. A preferred reactive lubricant is a lubricant which chemically reacts with the workpiece surface being finished.

A fluid based lubricant which is water soluble is preferred. A fluid based lubricant which is more soluble in hot water is more preferred. A fluid based lubricant which is substantially more soluble in hot water is even more preferred. A water based lubricant is more preferred. A degradable lubricant is also preferred and a biodegradable lubricant is even more preferred. Certain finishing process are designed to recycle the finishing composition and for these, a lubricant which is stable to recycling conditions is preferred.

Certain particularly preferred workpieces in the semiconductor industry have regions of high conductivity and regions of low conductivity. The higher conductivity regions are often comprised of metallic materials such as tungsten, copper, aluminum, and the like. An illustrative example of a common lower conductivity region is silicon and silicon oxide. A fluid based lubrication which differentially lubricates the two regions is preferred and a fluid based lubricant which substantially differentially lubricates two regions is more preferred. An example of a differential lubrication is if the coefficient of friction is changed by different amounts in one region versus the other region during finishing. An example of differential lubrication is where the boundary lubricant reacts differently with different chemical compositions to create regions having different local regions of tangential friction force and different coefficients of friction. Another example is where the semiconductor surface being finished topography (for instance unwanted raised regions) interact within the operative finishing interface to create local regions having different tangential friction forces and different coefficients of friction (see for example FIG. 4 discussion herein). For instance one region (or area) can have the coefficient of friction reduced by 20% and the other region (or area) reduced by 40%. This differential change in lubrication can be used to help in differential finishing of the two regions. An example of differential finishing is a differential finishing rate between the two regions. For example, a first region can have a finishing rate of "X" angstroms/minute and a second region can have a finishing rate of "Y" angstroms per minute before lubrication and after differential lubrication, the first region can have a finishing rate of 80% of "X" and the second region can have a finishing rate of 60% of "Y". As a further illustrative example, if the finishing rate in a first uniform region is 2500 angstroms per minute at a first set of finishing conditions and if the finishing rate in a second uniform region is 1000 angstroms per minute at the same set of finishing conditions, then the differential finishing rate is 1500 angstroms per minute. As a further illustrative example, if the finishing rate in a first uniform region is 3000 angstroms per minute at second set of finishing conditions and if the finishing rate in a second uniform region is 500 angstroms per minute at same second set finishing conditions, then the differential finishing rate is 2500 angstroms per minute. In this case, differential finishing rate measured in angstroms per minute changed from the first set of finishing conditions to the second set of finishing conditions. An example of where this will occur is when the lubricant tends to adhere to one region because of physical or chemical surface interactions (such as a metallic conductive region) and not adhere or not adhere as tightly to the an other region (such as a non metallic, non conductive region). Different regions can have different lubricating boundary layer thicknesses. Changing the finishing control parameters to change the differential lubrication during finishing of the workpiece is a preferred method of finishing. Changing the finishing control parameters to change the differential lubrication during finishing of the workpiece which in turn changes the region finishing rates in the workpiece is a more preferred method of finishing. Changing the finishing control parameters with in situ process control to change the differential lubrication during finishing of the workpiece which in turn changes the region finishing rates in the workpiece is an even more preferred method of finishing. A secondary friction sensor probe can aid in a particularly preferred way in detecting and controlling differential lubrication in the workpieces having heterogeneous surface compositions needing finishing.

A lubricant comprising a reactive lubricant is preferred. A lubricant comprising a boundary lubricant is also preferred. A reactive lubricant is a lubricant which chemically reacts with the workpiece surface being finished. A boundary layer lubricant is a preferred example of a lubricant which can form a lubricating film on the surface of the workpiece surface. As used herein a boundary lubricant is a thin layer on one or more surfaces which prevents or at least limits, the formation of strong adhesive forces between the workpiece being finished and the finishing element finishing surface and therefore limiting potentially damaging friction junctions between the workpiece surface being finished and the finishing element finishing surface. A boundary layer film has a comparatively low shear strength in tangential loading which reduces the tangential force of friction between the workpiece being finished and the finishing element finishing surface which can reduce surface damage to the workpiece being finished. In other words, boundary lubrication is a lubrication in which friction between two surfaces in relative motion, such as the workpiece surface being finished and the finishing element finishing surface, is determined by the properties of the surfaces, and by the properties of the lubricant other than the viscosity. Organic lubrication layers wherein the friction between two surfaces is dependent on lubricant properties other than viscosity is preferred. Different regional boundary layers on a semiconductor wafer surface being finished can be preferred for some finishing—particularly planarizing. A boundary film generally forms a thin film, perhaps even several molecules thick, and the boundary film formation depends on the physical and chemical interactions with the surface. A boundary lubricant which forms of thin film is preferred. A boundary lubricant forming a film having a thickness from 1 to 10 molecules thick is preferred and a boundary lubricant forming a film having a thickness from 1 to 6 molecules thick is more preferred and a boundary lubricant forming a film having a thickness from 1 to 4 molecules thick is even more preferred. A boundary lubricant forming a film having a thickness from 1 to 10 molecules thick on at least a portion of the workpiece surface being finished is particularly preferred and a boundary lubricant forming a film having a thickness from 1 to 6 molecules thick on at least a portion of the workpiece surface being finished is more particularly preferred and a boundary lubricant forming a film having a thickness from 1 to 4 molecules thick on at least a portion of the workpiece surface being finished is even more particularly preferred. A boundary lubricant forming a film having a thickness of at most 10 molecules thick on at least a portion of the workpiece surface being finished is particularly preferred and a boundary lubricant forming a film having a thickness of at most 6 molecules thick on at least a portion of the workpiece surface being finished is more particularly preferred and a boundary lubricant forming a film having a thickness of at most 4 molecules thick on at least a portion of the workpiece surface being finished is even more particularly preferred. An operative motion which continues in a substantially uniform direction can improve boundary layer formation and lubrication. A discontinuous operative motion can be used to change the lubricating boundary layer. Friction sensor subsystems and finishing sensor subsystems having the ability to control the friction probe motions and workpiece motions are preferred and uniquely able to improve finishing in many real time lubrication changes to the operative finishing interface. Boundary lubricants, because of the small amount of required lubricant, are particularly effective lubricants for inclusion in finishing elements. The molecular thickness of lubricating boundary layers can be measured with generally known frictional force measures and/or energy change sensors discussed herein. Changing the pressure in the operative finishing interface and/or in the secondary friction sensor interface can be used to determine molecular thickness. Controls can also be used by using various generally known analytical techniques such as spectroscopy and these results used to calibrate target energy change sensors and frictional force measures. Thermal analysis can also be used to measure the quantity of organic boundary layer on a surface and then the thickness calculated. Thermal analysis can be used to determine the efficacy of a particular lubricating boundary layer including solid boundary lubricant zone, boundary liquid lubricant zone, and boundary lubricant desorbed zone and the transition temperatures therebetween.

Heterogeneous lubricating boundary layers can improve finishing and planarizing of some semiconductor wafers where a differential finishing rate is desired in different regions. A semiconductor wafer surface having at least one unwanted raised region wherein the lubricating boundary layer thickness is at most one half the molecular layer thickness of the lubricating boundary layer thickness proximate to the unwanted raised region is preferred. A semiconductor wafer surface having at least one unwanted raised region wherein the boundary lubrication thickness is at most one third the molecular layer thickness of the lubricating boundary layer thickness proximate to the unwanted raised region is more preferred. A semiconductor wafer surface having at least one unwanted raised region wherein the lubricating boundary layer thickness is at most one quarter the molecular layer thickness of the lubricating boundary layer thickness proximate to the unwanted raised region is more preferred. Applications of this technology are further discussed herein elsewhere.

Controlling the thickness of the lubricating boundary layer by changing at least one control parameter in a manner that changes the tangential force of friction in at least one region of the semiconductor wafer surface in response to an in situ control signal is preferred. Controlling the thickness of the lubricating boundary layer by changing at least one control parameter in a manner that changes the tangential force of friction in at least two different regions of the semiconductor wafer surface in response to an in situ control signal is more preferred. Preferably the unwanted raised regions are related to a repeating pattern in the semiconductor wafer die. A plurality of die each having the same repeating pattern on the semiconductor wafer surface being finished is more preferred. These repeating patterns are generally created during semiconductor wafer manufacture and can be related to pattern densities. This is because small changes in lubricating boundary layers can change finishing rate, finishing rate selectivity, and finished surface quality.

Changing the lubrication at least once during the finishing cycle time to change the coefficient of friction between the finishing element finishing surface and the workpiece surface being finished is preferred. Changing the lubrication a plurality of times during the finishing cycle time to change the coefficient of friction between the finishing element finishing surface and the workpiece surface being finished a plurality of times during the finishing cycle time is more preferred. Changing the amount of lubricant at the operative finishing interface is a preferred method to change the lubrication. Changing the composition of the lubricant at the operative finishing interface is a preferred method to change the lubrication. Changing the number of lubricants in the operative finishing interface is a preferred method to change the lubrication. Changing the number of organic lubricating boundary layers in the operative finishing interface is a preferred method to change the lubrication. Changing the composition of organic lubricating boundary layer(s) at the operative finishing interface is a preferred method to change the lubrication. Changing the number of organic lubricating films in the operative finishing interface is a preferred method to change the lubrication. Changing the composition of organic lubricating film(s) in the operative finishing interface is a preferred method to change the lubrication. Changing the form of the organic lubricating boundary layer(s) is a preferred method to change the lubrication. Changing the form of the organic lubricating film(s) is a preferred method to change the lubrication. Supplying an effective amount of lubricant which reduces the unwanted surface damage to the surface of the workpiece being finished during finishing is preferred. Changing the lubrication during the finishing cycle time can improve finishing control and improve finishing performance, particularly where using in situ control as discussed elsewhere herein. Changing lubrication in situ with a control subsystem is particularly preferred. Changing the coefficient of friction in a uniform region of the workpiece is preferred and changing the coefficient of friction in a plurality of uniform regions of the workpiece is more preferred.

A plurality of operative sensors, preferably friction sensors, can aid in an a particularly preferred way in detecting and controlling differential lubrication in the workpieces having heterogeneous surface compositions needing finishing. Differential lubrication with a plurality of lubricants can be preferred because it can improve lubrication and coefficient of friction control. Differential lubrication with a plurality of organic lubricating films can be more preferred because it can further improve lubrication and coefficient of friction control. Differential lubrication with a plurality of organic lubricating boundary layers can be even more preferred because it can further improve lubrication and coefficient of friction control.

An organic lubricating film which interacts with the semiconductor wafer surface is preferred. An organic lubricating film which adheres to the semiconductor wafer surface is preferred. An organic lubricating film which interacts with and adheres to the semiconductor wafer surface is more preferred. An organic lubricating film which interacts with the uniform region of the semiconductor wafer surface is preferred. An organic lubricating film which adheres to the uniform region of the semiconductor wafer surface is preferred. An organic lubricating film which interacts with and adheres to the uniform region of the semiconductor wafer surface is more preferred. A uniform functional region is a preferred uniform region. A conductive region is a preferred uniform functional region. A nonconductive region is a preferred uniform functional region. By having the organic lubricating film interact with and adhere to a uniform region of the semiconductor wafer surface, localized finishing control can be improved and unwanted surface defects can generally be reduced using the teaching and guidance herein.

A lubricating aid comprising a reactive lubricant is preferred. A lubricating aid comprising a boundary lubricant is also preferred. A reactive lubricant is a lubricant which chemically reacts with the workpiece surface being finished. A boundary layer lubricant is a preferred example of a lubricant which can form a lubricating film on the surface of the workpiece surface. An organic lubricating film is a preferred lubricating film. An organic lubricating film which adheres to the workpiece surface being finished is preferred and an organic lubricating film which interacts with and adheres to the workpiece surface being finished is more preferred. An organic lubricating boundary layer is preferred example of an organic lubricating film. A lubricating film having a low shear strength in tangential loading which reduces the tangential force of friction between the workpiece being finished and the finishing element finishing surface is preferred.

An organic lubricating film having a thickness from 1 to 10 molecules thick is preferred and an organic lubricating film having a thickness from 1 to 6 molecules thick is more preferred and an organic lubricating film having a thickness from 1 to 4 molecules thick is even more preferred. An organic lubricating film having a thickness from 1 to 10 molecules thick on at least a portion of the workpiece surface being finished is particularly preferred and an organic lubricating film having a thickness from 1 to 6 molecules thick on at least a portion of the workpiece surface being finished is more particularly preferred and an organic lubricating film having a thickness from 1 to 4 molecules thick on at least a portion of the workpiece surface being finished is even more particularly preferred. An organic lubricating film having a thickness of at most 10 molecules thick on at least a portion of the workpiece surface being finished is particularly preferred and an organic lubricating film having a thickness of at most 6 molecules thick on at least a portion of the workpiece surface being finished is more particularly preferred and an organic lubricating film having a thickness of at most 4 molecules thick on at least a portion of the workpiece surface being finished is even more particularly preferred. Thin organic lubricating films can help reduce unwanted surface damage and aid in heterogeneous lubrication.

Controlling the thickness of a lubricating film by changing at least one lubrication control parameter in a manner that changes the coefficient of friction in at least two different regions in the operative finishing interface in response to an in situ control signal is preferred. Controlling the thickness of the lubricating film by changing at least two process control parameters in situ based on feed back information from a lubrication control subsystem having a friction sensor is also preferred. Controlling at least once the thickness of the lubricating film which changes the coefficient of friction in the operative finishing interface by changing at least one process control parameter in situ based on feed back information from a control subsystem during the finishing cycle time is preferred. A semiconductor wafer surface having at least a first region wherein the lubricating film is at most one half the molecular layer thickness compared to the lubricating film thickness on a second, different region is preferred and a semiconductor wafer surface having at least a first region wherein the lubricating film thickness is at most one third the molecular layer thickness compared to the lubricating film on a second, different region is more preferred when controlling the coefficient of friction, particularly when controlling the changes in the coefficient of friction. Controlling the thickness of the lubricating film by changing at least one process control parameter in situ based on feed back information from a control subsystem during the finishing cycle time and wherein the control subsystem tracks and updates the feed back information for finishing a plurality of the metal layers is even more preferred for semiconductor wafers having multiple functional levels. An organic lubricating film is preferred. Lubricating films, preferably lubricating boundary layers, because of the small amount of preferred lubricant, are particularly effective lubricants for inclusion in finishing elements and/or the operative finishing interface.

A reactive boundary lubricant is a preferred lubricant. A lubricating boundary layer comprising physical adsorption (physisorption) of the lubricant molecules to the semiconductor surface being finished is a preferred lubricating boundary layer. Van der Waals surface forces are a preferred example of physical adsorption. Dipole-dipole interaction between the boundary lubricant and the semiconductor wafer surface being finished is a preferred example of physical adsorption. A reversible dipole-dipole interaction between the boundary lubricant and the semiconductor wafer surface is an example of a more preferred physical adsorption lubricating boundary layer. An organic alcohol is an illustrative preferred example. A polar organic molecule containing the hetereoatom oxygen is preferred. An organic boundary lubricating layer which is a solid film generally has a greater ability to separate the finishing element finishing surface from the semiconductor wafer surface being finished. A heat of adsorption of from 2,000 to 10,000 cal/mole is preferred for physisorption. A physisorption organic boundary lubricating layer is a preferred reversible lubricating layer.

A lubricating boundary layer comprising chemisorption of lubricant molecules to the semiconductor wafer being finished is a preferred lubricating boundary layer. In chemisorption, chemical bonds hold the boundary lubricants to the semiconductor wafer surface being finished. As an illustrative example, a reaction of stearic acid forms a "metal soap" thin film on a metal surface. An organic carboxylic acid is a preferred example. Further, the "metal soap" can have a higher melting temperature and thus form regional areas of an organic boundary layer having higher temperature lubricating capacity as discussed further herein below. A heat of absorption of between 10,000 to 100,000 cal/mole is preferred for chemisorption.

A solid film organic boundary lubricating layer generally has a greater ability to separate the finishing element finishing surface from the semiconductor wafer surface being finished. A solid film organic boundary lubricating layer can thus help reduce finishing rates as measured in angstroms per minute (compared to a liquid film). A liquid film organic boundary lubricating layer generally has a lower ability to separate the finishing element finishing surface from the semiconductor wafer surface being finished can thus help increase finishing rates as measured in angstroms per minute (compared to a solid film). The same boundary lubricant can form either solid film organic boundary lubricating layer or a liquid film organic boundary lubricating layer depending on the operative finishing interface process conditions. A reversible organic boundary lubricating layer (which can change from solid to liquid to solid depending on processing conditions such as temperature) is preferred. Finishing a heterogeneous semiconductor wafer surface having at least one unwanted raised region wherein the lubricating boundary layer comprises a liquid film on the unwanted raised region and the lubricating boundary layer comprises a solid film in the region below and proximate to the unwanted raised region is preferred. Finishing a heterogeneous semiconductor wafer surface having at least one unwanted raised region wherein the lubricating boundary layer comprises a higher temperature liquid film on the unwanted raised region and the lubricating boundary layer comprises a lower temperature solid film in the region below and proximate to the unwanted raised region is preferred. Applying an operative finishing motion to the operative finishing interface forming a heterogeneous temperature profile on the semiconductor wafer surface being finishing and wherein the temperature is higher on a plurality of unwanted raised regions of the heterogeneous semiconductor wafer surface and the temperature is lower proximate to and below the plurality of unwanted raised regions of the heterogeneous semiconductor wafer surface and further the plurality of unwanted raised regions have a liquid lubricating films on them and the regions proximate to and below the plurality of unwanted raised regions solid lubricating films on them. See for instance Reference Numerals 802 (unwanted raised region) and 804 (region proximate to and below the unwanted raised region) for further helpful guidance. An example is octadecyl alcohol forms a solid lubricant film on copper at about 20 to 55 degrees centigrade and a liquid film on copper at about 65 to 110 degrees centigrade. An organic boundary lubricating layer that is capable of changing from a solid film to a liquid film in the operative finishing interface temperature range during a finishing cycle time is preferred. An organic boundary lubricating layer that is capable of changing from a solid film to a different physical form in the operative finishing interface temperature range during a finishing cycle time is preferred. An organic boundary lubricating layer that is capable of changing from a liquid film to a different physical form in the operative finishing interface temperature range during a finishing cycle time is preferred. An organic boundary lubricating layer that is capable of changing from a solid film to a liquid film in the temperature range from 20 to 100 degrees centigrade is more preferred. By increasing the finishing rate in the unwanted raised region and lowering the finishing rate in the region proximate to and below the unwanted raised region, planarization can be improved. Changing the lubricating boundary layer film physical form by changing at least one lubrication control parameter in situ based on feed back information from a lubrication control subsystem having an energy change sensor is preferred. Controlling the lubricating boundary layer film physical form by changing at least one lubrication control parameter in situ based on feed back information from a lubrication control subsystem having an energy change sensor is more preferred. Increasing temperature on the unwanted raised region on the semiconductor wafer surface compared to the temperature on the region below the unwanted raised region forming the lubricating boundary layer liquid film on the unwanted raised region and the lubricating boundary layer solid film on at least a portion of the semiconductor wafer surface below the raised region is preferred. Increasing temperature with frictional heat on the unwanted raised region on the semiconductor wafer surface compared to the temperature on the region below the unwanted raised region forming the lubricating boundary layer liquid film on the unwanted raised region and the lubricating boundary layer solid film on at least a portion of the semiconductor wafer surface below the raised region is more preferred. Using and controlling the lubricating boundary layer physical form can help customize finishing for the particular semiconductor wafers needing finishing. The operative motion interacts with the lubricating boundary layer in a new and useful way to finish a workpiece surface, preferably a semiconductor wafer surface.

A boundary lubricant which forms a thin lubricant film on the metal conductor portion of a workpiece surface being finished is particularly preferred. A nonlimiting preferred group of example boundary lubricants include at least one lubricant selected from the group consisting of fats, fatty acids, esters, and soaps. A preferred group of boundary lubricants comprise organic boundary lubricants. Another preferred group of boundary lubricants comprise organic synthetic lubricants. A phosphorous containing compound can be an effective preferred boundary lubricant. A phosphate ester is an example of a preferred phosphorous containing compound which can be an effective boundary lubricant. A chlorine containing compound can be an effective preferred boundary lubricant. A sulfur containing compound can be an effective preferred boundary lubricant. A nitrogen containing compound can be an effective preferred boundary lubricant. An amine derivative of a polyglycol can be a preferred boundary lubricant. A diglycol amine is a preferred amine derivative of a polyglycol. A compound containing atoms selected from the group consisting of at least one of the following elements oxygen, fluorine, nitrogen, or chlorine can be a preferred lubricant. A compound containing atoms selected from the group consisting of at least two of the following elements oxygen, fluorine, nitrogen, or chlorine can be a more preferred lubricant. A synthetic organic polymer containing atoms selected from the group consisting of at least one of the following elements oxygen, fluorine, nitrogen, or chlorine can be a preferred lubricant. A synthetic organic polymer containing atoms selected from the group consisting of at least two of the following elements oxygen, fluorine, nitrogen, or chlorine can be a more preferred lubricant. A lubricant free of sodium is a preferred lubricant. As used herein a lubricant free of sodium means that the sodium content is below the threshold value of sodium which will adversely impact the performance of a semiconductor wafer or semiconductor parts made therefrom. A synthetic organic polymer containing atoms selected from the group consisting of at least two of the following elements oxygen, fluorine, nitrogen, or chlorine can be a preferred lubricant. A sulfated vegetable oil and sulfurized fatty acid soaps are preferred examples of a sulfur containing compound. A lubricant which reacts physically with at least a portion of the workpiece surface being finished is a preferred lubricant. A lubricant which reacts chemically with at least a portion of the workpiece surface being finished is often a more preferred lubricant because it is often a more effective lubricant and can also aid at times directly in the finishing. A lubricant which reacts chemically with at least a portion of the workpiece surface being finished and which is non-staining is a particularly preferred lubricant because it is often a more effective lubricant, is generally easily cleaned from the workpiece, and can also aid directly in the finishing as discussed herein.

A marginally effective lubricant between the workpiece being finished and the finishing element finishing surface is preferred. As used herein, a marginally effective lubricant is a lubricant and amount which does not perfectly lubricant and stop all wear but allows some wear while reducing or eliminating especially deleterious wear.

Limited zone lubrication between the workpiece being finished and the finishing element finishing surface is preferred. As used herein, limited zone lubricating is lubricating to reduce friction between two surfaces while simultaneously having wear occur. Limited zone lubricating which simultaneously reduces friction between the operative finishing interface while maintaining a cut rate on the workpiece surface being finished is preferred. Limited zone lubricating which simultaneously reduces friction between the operative finishing interface while maintaining an acceptable cut rate on the workpiece surface being finished is more preferred. Limited zone lubricating which simultaneously reduces friction between the operative finishing interface while maintaining a finishing rate on the workpiece surface being finished is preferred. Limited zone lubricating which simultaneously reduces friction between the operative finishing interface while maintaining an acceptable finishing rate on the workpiece surface being finished is more preferred. Limited zone lubricating which simultaneously reduces friction between the operative finishing interface while maintaining a planarizing rate on the workpiece surface being finished is preferred. Limited zone lubricating which simultaneously reduces friction between the operative finishing interface while maintaining an acceptable planarizing rate on the workpiece surface being finished is more preferred. Limited zone lubricating which simultaneously reduces friction between the operative finishing interface while maintaining a polishing rate on the workpiece surface being finished is preferred. Limited zone lubricating which simultaneously reduces friction between the operative finishing interface while maintaining an acceptable polishing rate on the workpiece surface being finished is preferred. Lubricant types and concentrations are preferably controlled during limited zone lubricating. Limited zone lubricating offers the advantages of controlled wear along with reduced unwanted surface damage.

Lubricants which are polymeric can be very effective lubricants. A boundary lubricant comprising organic synthetic polymers are preferred lubricants. Supplying a lubricant to the interface of the workpiece surface being finished and the finishing element finishing surface wherein the lubricant is from 0.1 to 15% by weight of the total fluid between the interface is preferred and from 0.2 to 12% by weight of the total fluid between the interface is more preferred and from 0.3 to 12% by weight of the total fluid between the interface is even more preferred and from 0.3 to 9% by weight of the total fluid between the interface is even more particularly preferred. These preferred ranges are given for general guidance and help to those skilled in the art. Lubricants outside this range are currently believed to be useful but not as economical to use.

A lubricant having functional groups containing elements selected from the group consisting of chlorine, sulfur, and phosphorous is preferred and a boundary lubricant having functional groups containing elements selected from the group consisting of chlorine, sulfur, and phosphorous is more preferred. A lubricant comprising a fatty acid substance is a preferred lubricant. An preferred example of a fatty substance is a fatty acid ester or salt. Fatty acid salts of plant origin can be particularly preferred. A lubricant comprising a synthetic polymer is preferred and a lubricant comprising a boundary lubricant synthetic polymer is more preferred and a lubricant comprising a boundary lubricant synthetic polymer and wherein the synthetic polymer is water soluble is even more preferred. A polymer having a number average molecular weight from 400 to 150,000 is preferred and having a number average molecular weight from 1,000 to 100,000 is more preferred and having a number average molecular weight from 1,000 to 50,000 is even more preferred.

A lubricant comprising a polyalkylene glycol polymer is a preferred composition. A polymer of polyoxyalkylene glycol monoacrylate or polyoxyalkylene glycol monomethacrylate is very useful as a base of lubricant. A fatty acid ester can be an effective lubricant. A polyethylene glycol having a molecular weight of 400 to 1000 can be an effective lubricant. Synthetic oligomers can be an effective lubricant. A lubricant comprising a fatty acid ester or salt and cyclodextrin and derivatives of cyclodextrin is a preferred lubricant. A lubricant comprising salts formed from metals, an organic amine or amomnia and aliphatic saturated or unsaturated fatty acid having from 8 to 25 carbon atoms is a preferred. An ester formed from at least one acid selected from the group consisting essentially of lauric, myristic, palmitic, stearic, hydroxystearic, arachidic, behenic, erucic, lignoceric, citric and lactic, and at least one alcohol selected from the group consisting essentially of lauryl, myristyl, palmityl, stearyl, arachidyl, behenyl, erucyl, lignoceryl, glycerol, polyglycerol, trimethylolpropane, ethylene glycols, propylene glycols, sorbitols and polysorbitols is preferred and wherein the ester formed has a melting point of above 100 degrees C. is more preferred and wherein the ester formed is soluble in hot water is even more preferred. An ester formed from the groups selected from the group consisting essentially of ethoxylated C12–C18 fatty acids having 2–10 moles of ethylene oxide and ethoxylated C9–C18 fatty alcohols having 2–10 moles of ethylene oxide is preferred and wherein the ester has a melting point of greater than 100 degrees C. is more preferred and wherein the ester is hot water soluble is even more preferred. An ethoxylated long chain ester is a preferred lubricant. A lubricant selected from the group consisting of an ester of pentaerythritol, a fatty acid ester, a trimethylolpropane ester, a dimer diol ester, and mixtures thereof is a preferred lubricant. A glycol etherol is a preferred lubricant. A polyalkylene glycol polymer is a preferred lubricant. A lubricant comprising polyaspartic acid and salts thereof are preferred. Polyaspartic acid and salts are generally biodegradable.

A lubricant material selected from the group consisting of an ester of pentacrythritol, a fatty acid ester, a trimethylolpropane ester, a dimer diol ester, and mixtures thereof can be preferred for some applications. Still another group of lubricants include a lubricant comprising using a polycarboxlyic acid esters of C4 to C10 monohydric alcohols and polyhydric alcohols. A lubricant comprising fatty acids containing from C8 to C22 carbon atoms and ester derivatives thereof. Examples of fatty acids include caproic, caprylic, capric, lauric, myristic, palmitic, stearic, palmitoliec, oleic, erucic, and linoleic acids. Examples of polyhydric alcohols include ethylene glycol, diethylene glycol, triethylene glycol, and hexylene glycol. As used herein, the shorthand C4–C10 means a carbon chain from 4 to 10 carbons long and is generally known to those skilled in the art.

Another group of lubricants for use consist of lubricants selected from the group consisting of vegetable and animal oils, fats, tallows, and waxes or mixtures thereof. Another group of suitable lubricants include lubricants selected from the group consisting of mineral and synthetic lubricants. Non limiting examples of preferred synthetic lubricants include aliphatic and aromatic carboxylates, polymeric esters, and polyalkene oxides. Still another group of preferred lubricants include lubricants selected from the group consisting of poly alpha-olefins, ester based lubricants, phosphates, and polyalkyleneglycols and mixtures thereof with water. Another group of preferred boundary lubricants consists of lubricants selected from the group consisting of lard oil, overbased sulfonates, esters, soaps, and sulfated oils. Water based oils can preferably contain naphthenic or paraffinic oil with viscosities of at most 130 SUS (Saybolt universal seconds) at 100 degrees Fahrheit.

A preferred type of finishing aid is a finishing aid which can be included in the finishing element. A finishing aid distributed in at least a portion of the finishing element proximate to the finishing element finishing surface is preferred and a finishing aid distributed substantially uniformly in at least a portion of the finishing element proximate to the finishing element finishing surface is more preferred and a finishing aid distributed uniformly in at least a portion of the finishing element proximate to the finishing element finishing surface is even more preferred. A finishing aid selected from the group consisting of liquid and solid lubricants and mixtures thereof is a preferred lubricant. A finishing aid(s) can thus be provided to an operative finishing interface by inclusion in the finishing element and/or finishing surface to generally aid finishing and finishing control.

A preferred type of lubricant is a lubricant which can be included in the finishing element. A lubricant distributed in at least a portion of the finishing element proximate to the finishing element finishing surface is preferred and a lubricant distributed substantially uniformly in at least a portion of the finishing element proximate to the finishing element finishing surface is more preferred and a lubricant distributed uniformly in at least a portion of the finishing element proximate to the finishing element finishing surface is even more preferred. A lubricant selected from the group consisting of liquid and solid lubricants and mixtures thereof is a preferred lubricant. A lubricant can thus be provided to an operative finishing interface by including the lubricant in the finishing surface to generally aid finishing and finishing control.

A finishing element finishing surface can have a lubricant in the finishing surface. A combination of a liquid lubricant and ethylene vinyl acetate, particularly ethylene vinyl acetate with 15 to 50% vinyl acetate by weight, can be a preferred effective lubricant additive. Preferred liquid lubricants include paraffin of the type which are solid at normal room temperature and which become liquid during the production of the finishing element. Typical examples of desirable liquid lubricants include paraffin, naphthene, and aromatic type oils, e.g. mono- and polyalcohol esters of organic and inorganic acids such as monobasic fatty acids, dibasic fatty acids, phthalic acid and phosphoric acid.

Non limiting illustrative examples of lubricants are included in U.S. Pat. No. 4,332,689 to Tanizaki, U.S. Pat. No. 4,522,733 to Jonnes, U.S. Pat. No. 4,544,377 to Schwen, U.S. Pat. No. 4,636,321 to Kipp et. al., U.S. Pat. No. 4,767,554 to Malito et. al., U.S. Pat. No. 4,950,415 to Malito, U.S. Pat. No. 5,225,249 to Biresaw, U.S. Pat. No. 5,368,757 to King, U.S. Pat. No. 5,401,428 to Kalota, U.S. Pat. No. 5,433,873 to Camenzind, U.S. Pat. No. 5,496,479 to Videau et. al., and U.S. Pat. No. 5,614,482 to Baker et. al. are included for guidance and modification by those skilled in the art and are included by reference in their entirety herein. Some preferred suppliers of lubricants include Dow Chemical, Huntsman Corporation, and Chevron Corporation.

Generally those skilled in the art know how to measure the kinetic coefficient of friction. A preferred method is ASTM D 3028-95 and ASTM D 3028-95 B is particularly preferred. Those skilled in the art can modify ASTM D 3028-95 B to adjust to appropriate finishing velocities and to properly take into consideration appropriate fluid effects due to the lubricant and finishing composition. Preferred lubricants and finishing compositions do not corrode the workpiece or localized regions of the workpiece. Corrosion can lead to workpiece failure even before the part is in service. ASTM D 130 is a is a useful test for screening lubricants for particular workpieces and workpiece compositions. As an example a metal strip such as a copper strip is cleaned and polished so that no discoloration or blemishes detectable. The finishing composition to be tested is then added to a test tube, the copper strip is immersed in the finishing composition and the test tube is then closed with a vented stopper. The test tube is then heated under controlled conditions for a set period of time, the metal strip is removed, the finishing composition removed, and the metal strip is compared to standards processed under identical conditions to judge the corrosive nature and acceptableness of the finishing composition. ASTM D 1748 can also be used to screen for corrosion. These test methods are included herein by reference in their entirety.

Supplying an effective marginal lubrication to the interface between the workpiece surface being finished and the finishing element finishing surface is preferred and supplying an effective marginal boundary lubrication to the interface between the workpiece surface being finished and the finishing element finishing surface is more preferred. Marginal lubrication is less than complete lubrication and facilitates controlling frictional wear and tribochemical reactions. Independent control of the lubricant control parameters aids in controlling an effective amount of marginal lubrication and in situ control of the lubricant control parameters is more preferred.

Operative Finishing Motion

Chemical mechanical finishing during operation has the finishing element in operative finishing motion to the surface of the workpiece being finished. A relative lateral parallel motion of the finishing element to the surface of the workpiece being finished is an operative finishing motion. Lateral parallel motion can be over very short distances or macro-distances. A parallel circular motion of the finishing element relative to the workpiece surface being finished can be effective. A tangential finishing motion can also be preferred. U.S. Pat. No. 5,177,908 to Tuttle issued in 1993, U.S. Pat. No. 5,234,867 to Schultz et. al. issued in 1993, U.S. Pat. No. 5,522,965 to Chisholm et. al. issued in 1996, U.S. Pat. No. 5,735,731 to Lee in 1998, and U.S. Pat. No. 5,962,947 to Talieh issued in 1997 comprise illustrative nonlimiting examples of operative finishing motion contained herein for further general guidance of those skilled in the arts.

Some illustrative nonlimiting examples of preferred operative finishing motions for use in the invention are also discussed. This invention has some particularly preferred operative finishing motions of the workpiece surface being finished and the finishing element finishing surface. Moving the finishing element finishing surface in an operative finishing motion to the workpiece surface being finished is a preferred example of an operative finishing motion. Moving the workpiece surface being finished in an operative finishing motion to the finishing element finishing surface is a preferred example of an operative finishing motion. Moving the finishing element finishing surface in a parallel circular motion to the workpiece surface being finished is a preferred example of an operative finishing motion. Moving the workpiece surface being finished in a parallel circular motion to the finishing element finishing surface is a preferred example of an operative parallel. Moving the finishing element finishing surface in a parallel linear motion to the workpiece surface being finished is a preferred example of an operative finishing motion. Moving the workpiece surface being finished in a parallel linear motion to the finishing element finishing surface is a preferred example of an operative parallel. The operative finishing motion performs a significant amount of the polishing and planarizing.

High speed finishing of the workpiece surface with fixed abrasive finishing elements can cause surface defects in the workpiece surface being finished at higher than desirable rates because of the higher forces generated. As used herein, high speed finishing involves relative operative motion having an equivalent linear velocity of greater than 300 feet per minute and low speed finishing involves relative operative motion having an equivalent linear velocity of at most 300 feet per minute. The relative operative speed is measured between the finishing element finishing surface and the workpiece surface being finished. Supplying a lubricant between the interface of finishing element finishing surface and the workpiece surface being finished when high speed finishing is preferred to reduce the level of surface defects. Supplying a lubricant between the interface of a fixed abrasive cylindrical finishing element and a workpiece surface being finished is a preferred example of high speed finishing. Supplying a lubricant between the interface of a fixed abrasive belt finishing element and a workpiece surface being finished is a preferred example of high speed finishing. Nonlimiting illustrative examples of a belt finishing element and a cylindrical finishing element are found in patents U.S. Pat. No. 5,735,731 to Lee and U.S. Pat. No. 5,762,536 to Pant and which can be modified by those skilled in the art as appropriate. U.S. Pat. No. 5,735,731 to Lee and U.S. Pat. No. 5,762,536 to Pant are included herein by reference in their entirety.

Platen

The platen is generally a stiff support structure for the finishing element. The platen surface facing the workpiece surface being finished is parallel to the workpiece surface being planarized and is flat and generally made of metal. The platen reduces flexing of the finishing element by supporting the finishing element, optionally a pressure distributive element can also be used. The platen surface during polishing is in operative finishing motion to the workpiece surface being finished. The platen surface can be static while the workpiece surface being finished is moved in an operative finishing motion. The platen surface can be moved in a parallel motion fashion while the workpiece surface being finished is static. Optionally, both the platen surface and the workpiece being finished can be in motion in a way that creates operative finishing motion between the workpiece and the finishing element. Other types of platens are generally known in the industry and functional.

Base Support Structure

The base support structure forms structure which can indirectly aid in applying pressure to the workpiece surface being finished. It generally forms a support surface for those members attached to it directly or operatively connected to the base support structure. Other types of base support structure are generally known in the industry and functional.

Workpiece Finishing Sensor

A workpiece finishing sensor is a sensor which senses the finishing progress to the workpiece in real time so that an in situ signal can be generated. A workpiece finishing sensor is preferred. A workpiece finishing sensor which facilitates measurement and control of finishing is preferred. A workpiece finishing sensor probe which generates a signal which can be used cooperatively with the secondary friction sensor signal to improve finishing is more preferred.

The change in friction during finishing can be accomplished using technology generally familiar to those skilled in the art. A change in friction can be detected by rotating the workpiece being finished and the finishing element finishing surface with electric motors and measuring current changes on one or both motors. The current changes related to friction changes can then be used to produce a signal to operate the finishing control subsystem. A change in friction can be detected by rotating the workpiece finishing surface with the finishing element finishing surface with electric motors and measuring power changes on one or both motors. Changes in friction can also be measured with thermal sensors. A thermistor is a non-limiting example of preferred non-optical thermal sensor. A thermal couple is another preferred non-optical thermal sensor. An optical thermal sensor is a preferred thermal sensor. A infrared thermal sensor is a preferred thermal sensor. A sensors to measure friction in workpieces being finished are generally known to those skilled in the art. Energy change sensors are a preferred type of sensor for feed back of in situ control information. Non limiting examples methods to measure friction in friction sensor probes are described in the following U.S. Pat. No. 5,069,002 to Sandhu et. al., U.S. Pat. No. 5,196,353 to Sandhu, U.S. Pat. No. 5,308,438 to Cote et. al., U.S. Pat. No. 5,595,562 to Yau et. al., U.S. Pat. No. 5,597,442 to Chen, U.S. Pat. No. 5,643,050 to Chen, and U.S. Pat. No. 5,738,562 to Doan et. al. and are included by reference herein in their entirety for guidance and can be advantageously modified by those skilled in the art for use in this invention. Thermal sensors are available commercially from Terra Universal, Inc. in Anaheim, Calif. and Hart Scientific in American Fork, Utah. Measuring the changes in friction at the interface between the workpiece being finished and the finishing element finishing surface to generate an in situ signal for control is particularly preferred because the it can be effectively combined with the a secondary friction sensor further improve finishing control.

A workpiece finishing sensor for the workpiece being finished is preferred. A sensor for the workpiece being finished selected from the group consisting of friction sensors, thermal sensors, optical sensors, acoustical sensors, and electrical sensors are preferred sensors for the workpiece being finished. Workpiece thermal sensors and workpiece friction sensors are non-limiting examples of preferred workpiece friction sensors. As used herein, a workpiece friction sensor can sense the friction between the interface of the workpiece being finished and the finishing element finishing surface during operative finishing motion.

Additional non-limiting preferred examples of workpiece sensors will now be discussed. Preferred optical workpiece sensors are discussed. Preferred non-optical workpiece sensors are also discussed. The endpoint for planarization can be effected by monitoring the ratio of the rate of insulator material removed over a particular pattern feature to the rate of insulator material removal over an area devoid of an underlying pattern. The endpoint can be detected by impinging a laser light onto the workpiece being polished and measuring the reflected light versus the expected reflected light as an measure of the planarization process. A system which includes a device for measuring the electrochemical potential of the slurry during processing which is electrically connected to the slurry, and a device for detecting the endpoint of the process, based on upon the electrochemical potential of the slurry, which is responsive to the electrochemical potential measuring device. Endpoint detection can be determined by an apparatus using an interferometer measuring device to direct at an unpatterned die on the exposed surface of the wafer to detect oxide thickness at that point. A semiconductor substrate and a block of optical quartz are simultaneously polished and an interferometer, in conjunction with a data processing system are then used to monitor the thickness and the polishing rate of the optical block to develop an endpoint detection method. A layer over a patterned semiconductor is polished and analyzed using optical methods to determine the end point. An energy supplying means for supplying prescribed energy to the semiconductor wafer are used to develop a detecting means for detecting a polishing end point tot the polishing of film by detecting a variation of the energy supplied tot the semiconductor wafer. The use of sound waves can be used during chemical mechanical polishing by measuring sound waves emanating from the chemical mechanical polishing action of the substrate against the finishing element. A control subsystem can maintain a wafer count, corresponding to how many wafers are finished and the control subsystem regulates the backside pressure applied to each wafer in accordance with a predetermined function such that the backside pressure increases monotonically as the wafer count increases. The above methods are generally known to those skilled in the art. U.S. Pat. No. 5,081,796 to Schultz, U.S. Pat. No. 5,439,551 to Meikle et al., U.S. Pat. No. 5,461,007 to Kobayashi, U.S. Pat. No. 5,413,941 to Koos et. al., U.S. Pat. No. 5,637,185 Murarka et al., U.S. Pat. No. 5,643,046 Katakabe et al., U.S. Pat. No. 5,643,060 to Sandhu et al., U.S. Pat. No. 5,653,622 to Drill et al., and U.S. Pat. No. 5,705,435 to Chen. are included by reference in their entirety and included herein for general guidance and modification by those skilled in the art.

Changes in lubrication, particularly active lubrication, at the operative finishing interface can significantly affect finishing rates and finishing performance in ways that current workpiece sensors cannot handle as effectively as desired. For instance, current workpiece sensors are less effective for monitoring and controlling multiple real time changes in lubrication, particularly active lubrication, and changes in finishing such as finishing rates. This renders prior art workpiece sensors less effective for controlling and stopping finishing where friction is adjusted or changed in real time. Secondary friction sensor subsystems as indicated above can help to improve real time control wherein the lubrication is changed during the finishing cycle time. An operative friction sensor which is separated from and free of contract with the workpiece surface while in operative contact with the finishing element finishing surface is preferred. Preferred secondary friction sensors include optical friction sensors and non-optical friction sensors. An optical friction sensor is a preferred friction sensor. Non-limiting preferred examples of optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Electrical performance versus temperature such as conductivity, voltage, and resistance is measured. Those skilled in the thermal measurement arts are generally familiar with non-optical thermal sensors and their use. A change in friction can be detected by rotating the friction sensor probe in operative friction contact with the finishing element finishing surface with electric motors and measuring current changes on one or both motors. The current changes related to friction changes can then be used to produce a signal to operate the friction sensor subsystem. Secondary friction detectors can be used to sense changes in friction and tangential friction forces. A secondary friction detector comprises a probe that can sense friction at the interface between a material which is separated from the workpiece surface being finished. A preferred secondary friction detector is a friction sensor probe. A friction sensor probe comprises a probe that can sense friction at the interface between a material which is separate and unconnected to the workpiece surface being finished and the finishing element finishing surface. Some illustrative secondary friction sensor motions are pulsed direction changes, pulsed pressure changes, continuous motion such as circular, elliptical, and linear. An operative secondary friction sensor motion is an operative secondary friction sensor motion between the secondary friction sensor surface and the finishing element finishing surface. Secondary friction sensors are a preferred operative process sensor and a preferred operative friction sensor. Differential calculations with the operative friction sensor information to determine differential lubrication is a preferred evaluation. Illustrative nonlimiting operative process sensors, operative friction sensors, tracked information, and illustrated uses are found in Provisional Patent Application with PTO Serial No. 60/107,300 filed on the Nov. 6, 1998 and having the title "In Situ Friction Detector for finishing workpieces", U.S. Pat. No. 6,568,989 filed Mar. 29, 2000, and in a U.S. Pat. No. 6,283,829 to Molnar and they are included in their entirety by reference for general guidance and modification of those skilled in the art. Where the material changes with depth during the finishing of workpiece being finished, one can monitor friction changes with the secondary friction sensor having dissimilar materials even with active lubrication and therefore readily detect the end point. As an additional example, the finishing rate can be correlated with the instantaneous lubrication at the operative finishing interface, a mathematical equation can be developed to monitor finishing rate with instantaneous lubrication information from the secondary sensor and the processor then in real time calculates finishing rates and indicates the end point to the controller.

Cost of Manufacture Information

Figure 6:
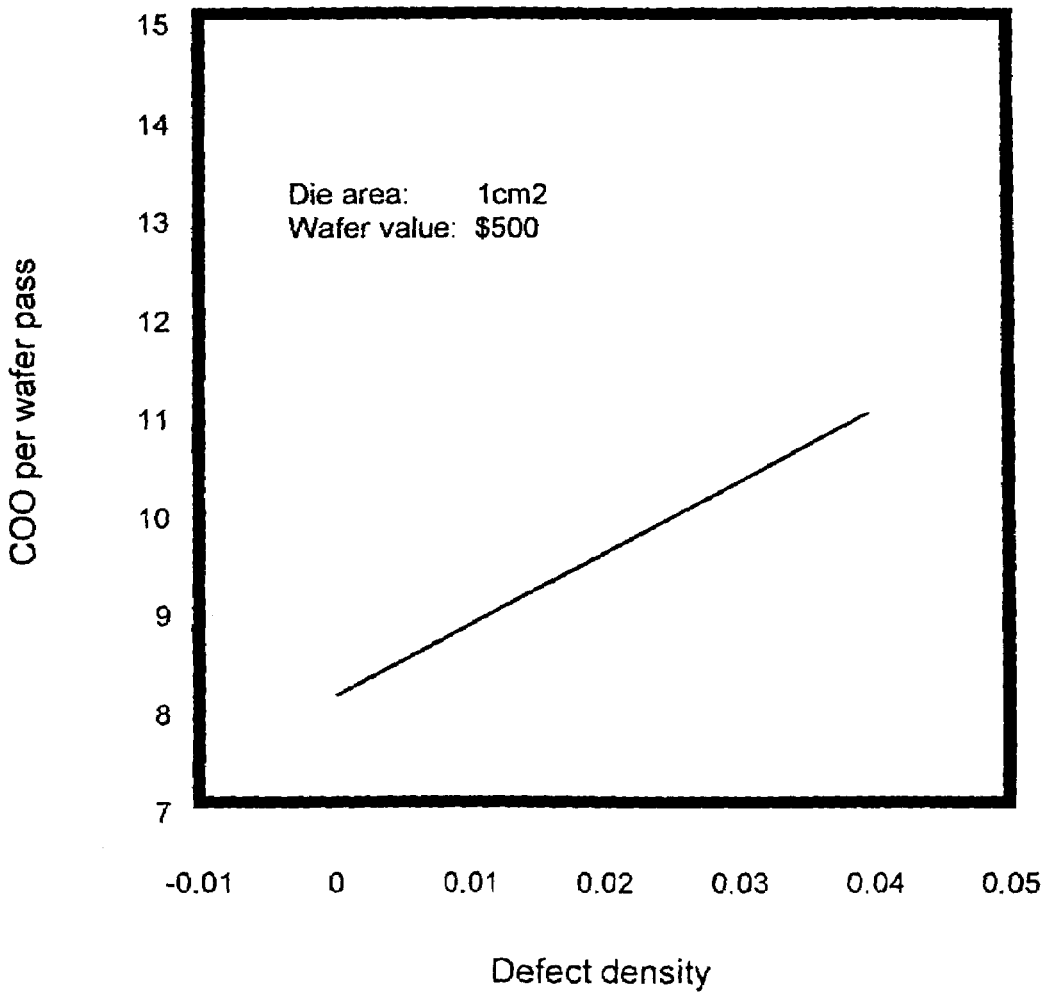
FIG. 6 is a plot of cost of ownership Vs defect density
Figure 7:
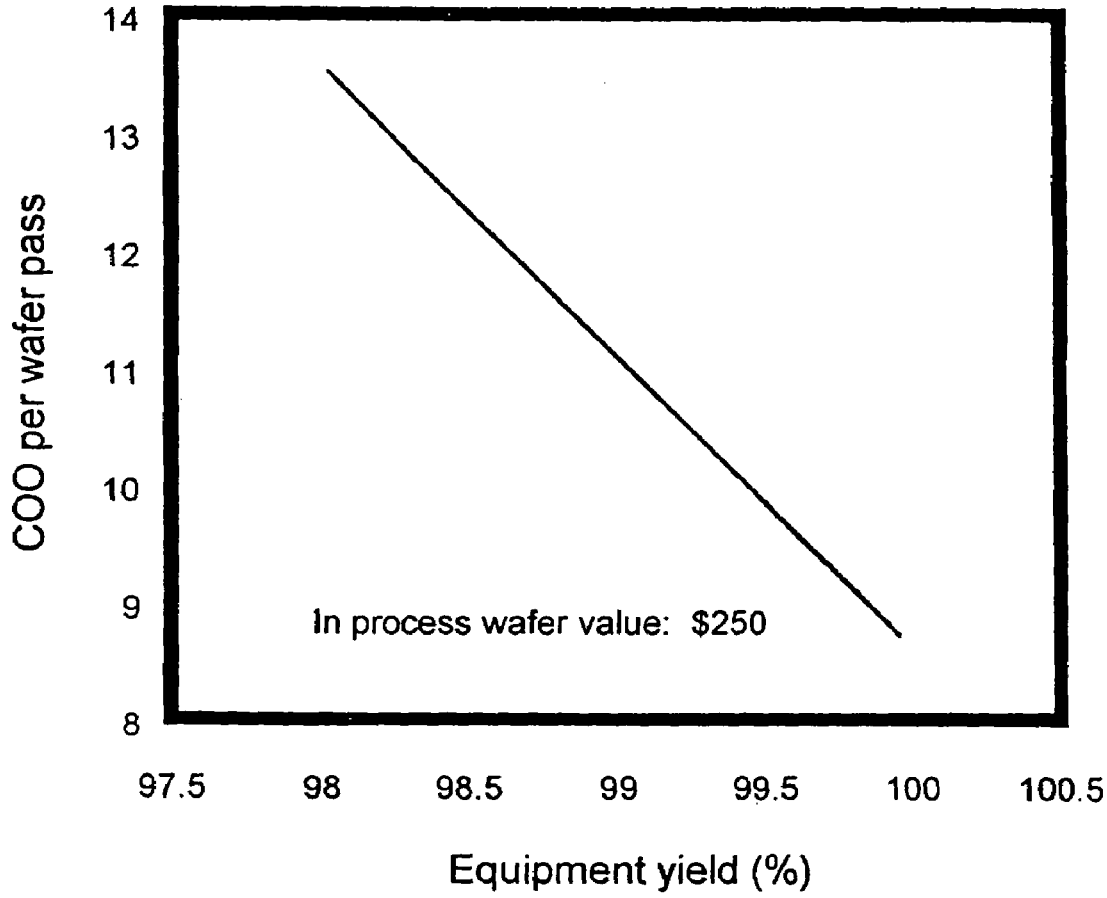
FIG. 7 is a plot of cost of ownership Vs equipment yield
Figure 8:
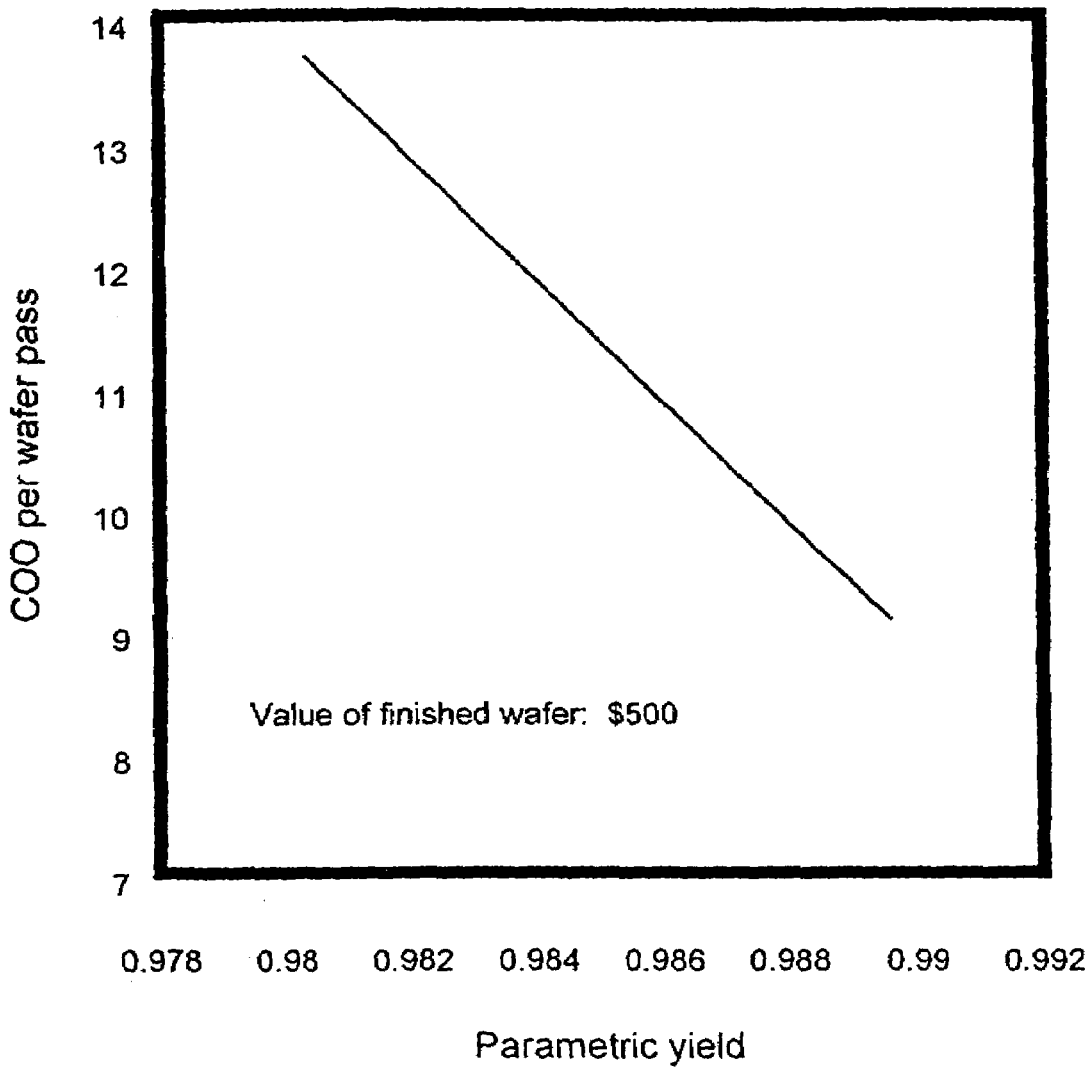
FIG. 8 is a plot of cost of ownership Vs parametric yield loss
Figure 9:
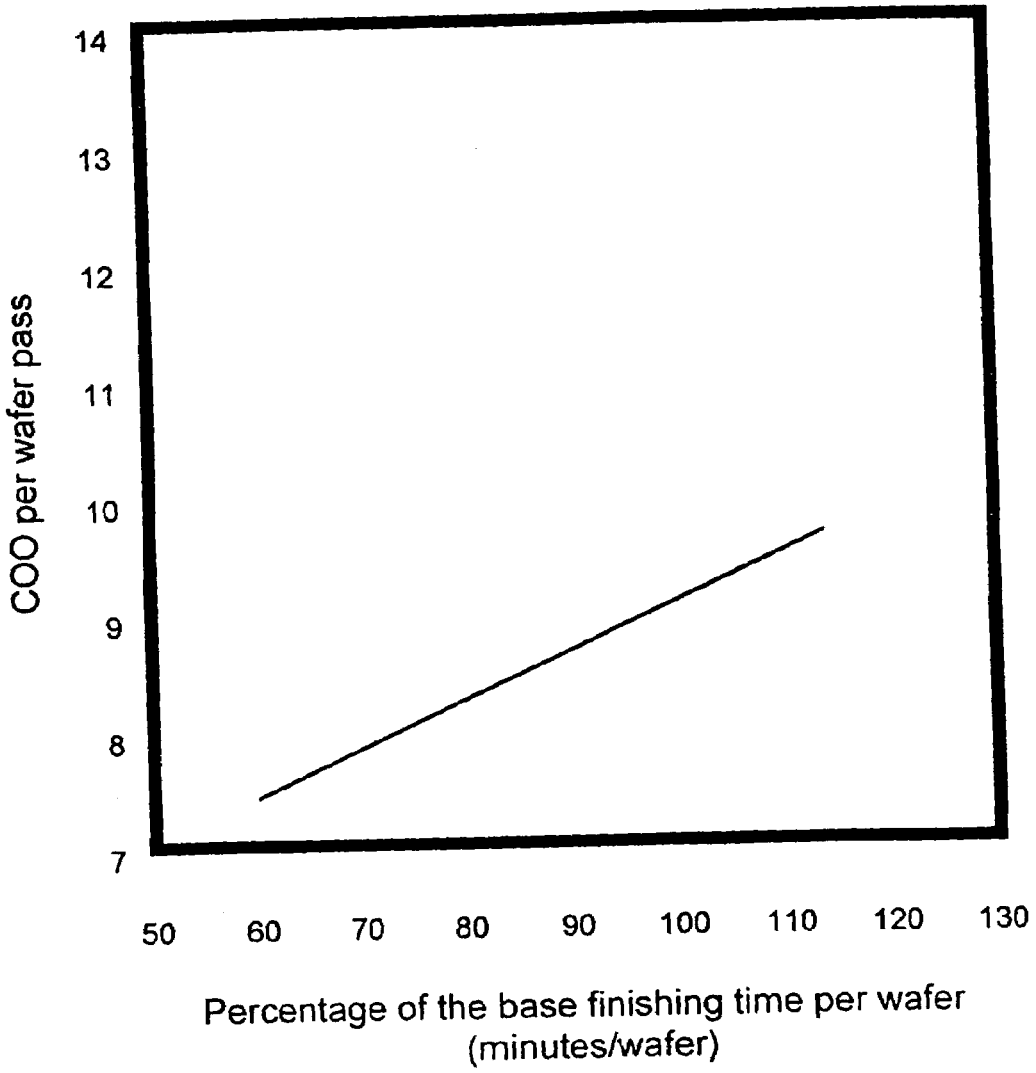
FIG. 9 is a plot of finishing rate effect on cost of ownership
Figure 10:
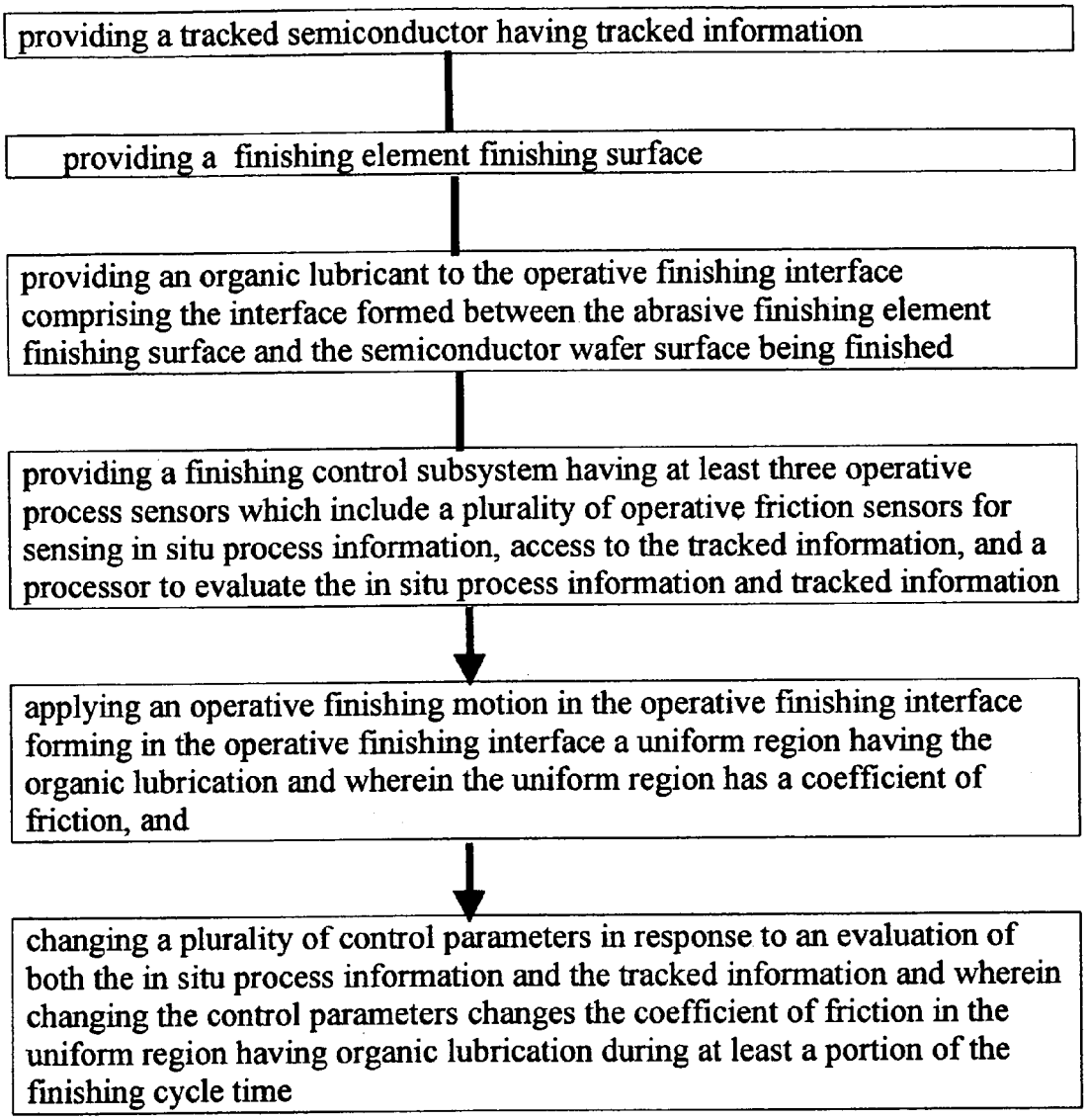
FIGS. 10–13 examples of preferred steps in illustrative embodiments of a method to control workpiece finishing FIGS. 14*a* & *b* examples of networked control subsystems and apparatus
Figure 11:
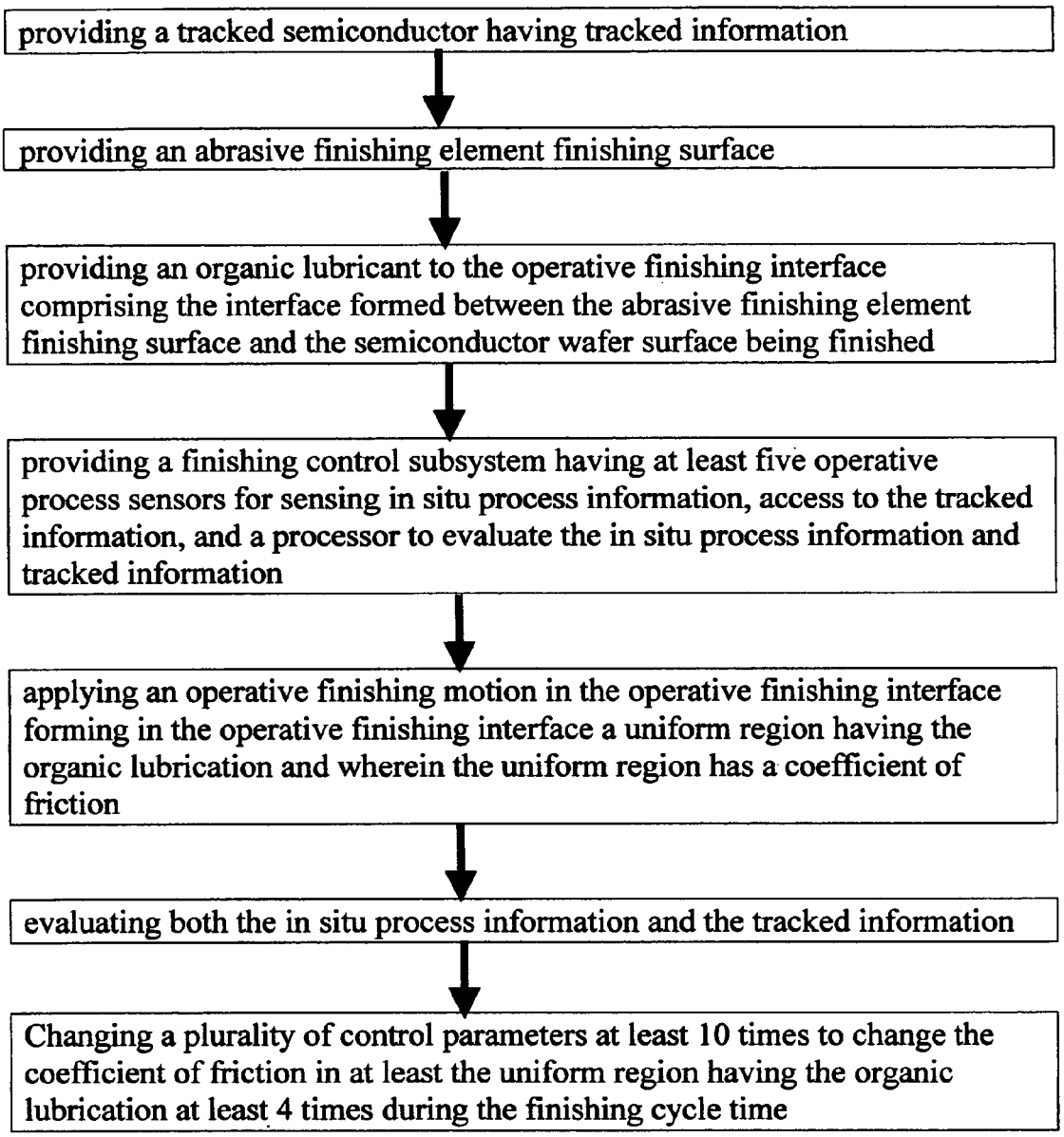
Figure 12:
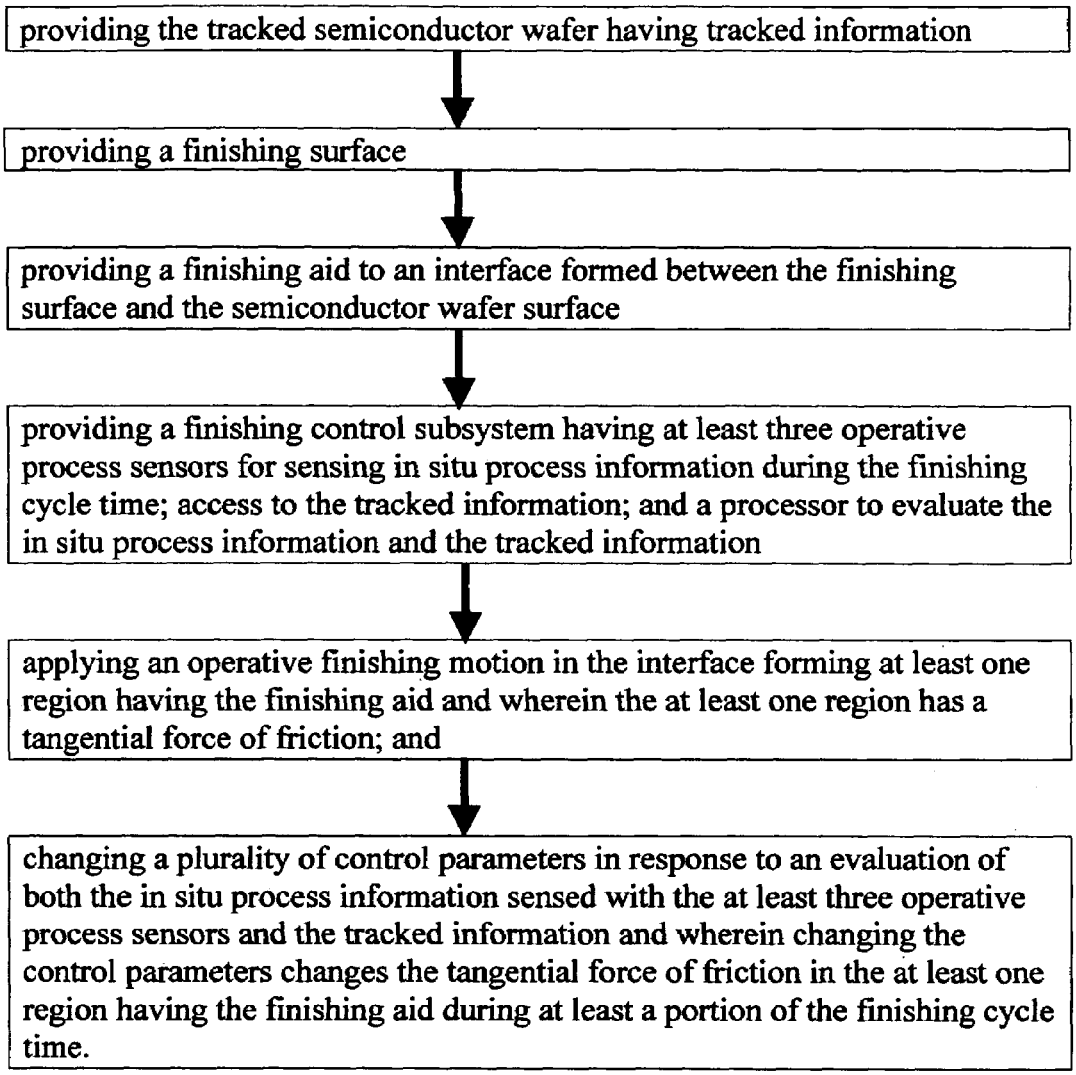
Figure 13:
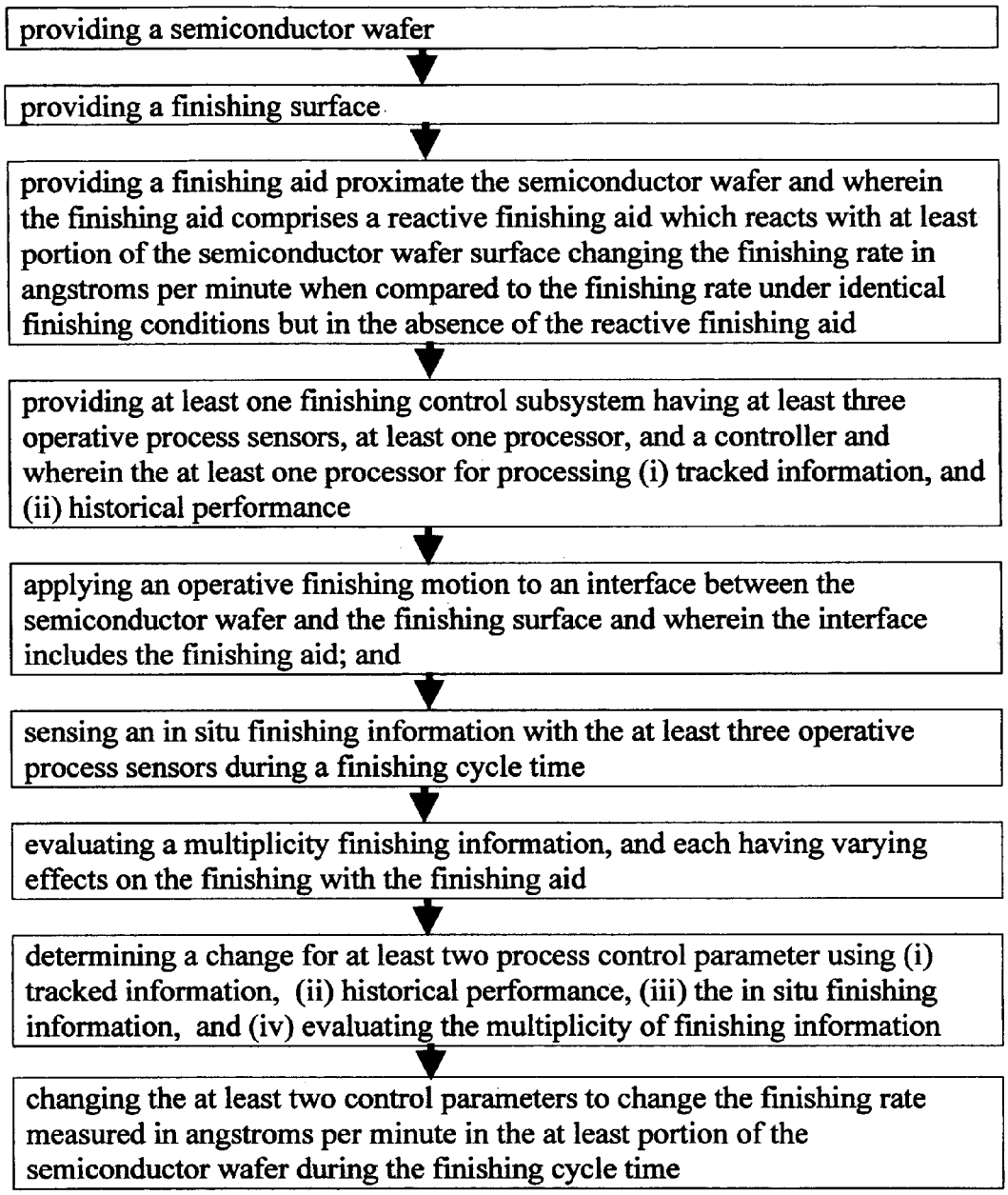

Cost of manufacture parameters for chemical mechanical finishing are very complex. To applicant's knowledge, because of their complexity they have not been used for in situ process improvement. Applicant has now found unexpectedly that cost of manufacture parameters can be used to advantage to improve both finishing control and cost of manufacture during real-time finishing. Particular cost of manufacture parameters are preferred because they have a large impact on efficiency and effectiveness of chemical mechanical finishing as well as the proper selection of improved process control parameters and their selected values. A preferred cost of manufacture parameter is the defect density. FIG. 6 illustrates the effect of defect density on the cost of manufacture for a particular semiconductor wafer (finished wafer valued of $500). Note that an increase of defect density from 0.01 to 0.03 can increase the cost of manufacture for finishing by about $1.50. Another preferred cost of manufacture parameter is equipment yield. FIG. 7 illustrates the effect of a decrease of 1% in equipment yield can increase the cost of manufacture by $2.50 (in process wafer valued of $250). Another preferred cost of manufacture parameter for in situ process control is the parametric yield. FIG. 8 illustrates the effect of a decrease of 1% in parametric yield which can increase the cost of manufacture by $5.00 (finished wafer valued of $500). Another preferred cost of manufacture parameter for in situ process control is the finishing rate. FIG. 9 illustrates the effect of a finishing rate improvement on the cost of manufacture. FIGS. 6–9 represent illustrative graphs and equations which can be used to improve finishing with tracked information such as cost of manufacture parameters. Tracked information for specific workpieces and/workpiece batches can generally improve in situ finishing control by, for example, improving cost information. Depending on the particular finishing conditions, an increase in finishing rate can have a lowering effect on cost of manufacture due to an increase in throughput and can simultaneously increase the cost of manufacture by increasing the yield loss due to increased defect density. By using a processor, appropriate calculations can be made in situ to improve cost of manufacture in real-time. Without the processor and the ready access to preferred cost of manufacture parameters, it is difficult to properly improve the process control parameters during real-time finishing. Cost of manufacture parameters and Cost of Ownership metrics are generally known by those skilled in the semiconductor arts. Some preferred examples of cost of manufacture parameters comprise at least one parameter(s) selected from the group consisting of equipment cost ($), spares cost ($), consumables costs (such as abrasives, slurry, and/or finishing elements in $), MTBF (mean time between failure in hours), MTTR (mean time to repair in hours), scheduled preventive maintenance, raw product throughput (workpieces per hour), production tests (hours), mean time to test (hours), systems/operator, equipment yield, incoming wafer value ($), density defect, faulty probability, device area, and completed workpiece value ($). Another set of preferred examples of cost of manufacture parameters comprise at least one parameter(s) selected from the group consisting of fixed costs, recurring costs, yield costs, tool life, throughput, composite yield, and utilization. SEMATECH has published generally widely accepted cost of manufacture parameters and Cost of Ownership metrics which are included herein by reference in their entirety for guidance and use of those skilled in the semiconductor art. Further, Wright Williams and Kelly of Dublin, Calif. have published a manual entitled "Understanding and Using Cost of Ownership" (rev. 0595-1) containing cost of manufacture parameters and equations for cost of manufacture calculation which is also included herein by reference in its entirety for guidance and use of those skilled in the semiconductor arts. Where specific reference is made herein to a specific definition of a particular cost of manufacture metric, applicant will use for instance the Wright Williams and Kelly parametric yield or the SEMATECH equipment yield naming for additional specificity. Where further specificity is desirable, the Wright Williams and Kelly definition shall be used for that term for claim interpretation for that term (unless the term is expressly defined in the claim).

A nonlimiting example of methods to make available preferred cost of manufacture information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. A memory device is preferred for memory look-tables and/or databases and the like. Memory devices are generally known to those skilled in the art such as volatile and nonvolatile memory devices. It is also to be understood that often a single semiconductor wafer can undergo multiple wafer finishing steps. Each time the semiconductor wafer is finished in a wafer pass, the value of the semiconductor wafer increases due to multiple processing steps and thus the value of the equipment yield changes. A method which updates the cost of manufacture parameters consistent with the current manufacturing step is preferred. Current cost of manufacture parameters can be stored in memory look-up tables or databases. Those skilled in the arts of activity based accounting can generally setup appropriate look-up tables containing appropriate cost of manufacture parameters to use for in situ process control given the teachings and guidance herein. The semiconductor wafer can be tracked during processing with a tracking code. Tracked process and/or tracked cost of manufacture information stored by semiconductor wafer (or workpiece) with this technology in a memory device such as a memory look-up table when used with the new disclosures herein.

A method of finishing of a semiconductor wafer surface being finished wherein a mathematical formula is used to calculate in situ at least one improved process control parameter value based at least in part upon at least one cost of manufacture parameter selected from the group consisting of parametric yield, equipment yield, defect density, and finishing rate and then adjusting in situ at least one improved process control parameter is preferred. A method of finishing wherein at least one cost of manufacture parameter is evaluated in situ for improvement and used at least in part to improve control is preferred and a method of finishing wherein at least two cost of manufacture parameters are evaluated in situ for improvement and used at least in part to improve control is more preferred and a method of finishing wherein at least three cost of manufacture parameters are evaluated in situ for improvement and used at least in part to improve control is even more preferred. A method of finishing of a semiconductor wafer surface being finished wherein a mathematical formula is used to calculate in situ at least one improved process control parameter value based at least in part upon at least two cost of manufacture parameters selected from the group consisting of parametric yield, equipment yield, defect density, and finishing rate and then adjusting in situ at least one improved process control parameter is more preferred. A method of finishing of a semiconductor wafer surface being finished wherein a mathematical formula is used to calculate in situ at least one improved process control parameter value based at least in part upon at least three cost of manufacture parameters selected from the group consisting of parametric yield, equipment yield, defect density, and finishing rate and then adjusting in situ at least one improved process control parameter is even more preferred. A method of finishing of a semiconductor wafer surface being finished wherein a mathematical formula is used to calculate in situ at least two improved process control parameter values based at least in part upon at least two cost of manufacture parameters selected from the group consisting of parametric yield, equipment yield, defect density, and finishing rate and then adjusting in situ at least those two improved process control parameters is even more particularly preferred. These preferred cost of manufacture parameters are relatively difficult to improve during in situ processing because of their complexity and because they can have opposite effects on the cost of manufacture and thus a processor is generally quite effective for these calculations. Preferably, the calculation to improve cost of manufacture using the cost of manufacture parameters can be completed at least 4 times during the finishing cycle time and more preferably the calculations can be completed at least 6 times during the finishing cycle time and even more preferably the calculations can be completed at least 10 times during the finishing cycle time and even more particularly preferably the calculations can be completed at least 20 times during the finishing cycle time. Preferably, the calculation to improve finishing using the in situ process information and the tracked information can be completed at least 4 times during the finishing cycle time and more preferably the calculations can be completed at least 6 times during the finishing cycle time and even more preferably the calculations can be completed at least 10 times during the finishing cycle time and even more particularly preferably the calculations can be completed at least 20 times during the finishing cycle time. Preferably, the in situ process control parameter value can be adjusted at least 4 times during the finishing cycle time and more preferably at least 6 times during the finishing cycle time and even more preferably at least 10 times during the finishing cycle time and even more particularly preferably at least 20 times during the finishing cycle time. Preferably, the in situ process control parameter value is controlled at least 4 times during the finishing cycle time and more preferably at least 6 times during the finishing cycle time and even more preferably at least 10 times during the finishing cycle time and even more particularly preferably at least 20 times during the finishing cycle time. Currently, a finishing cycle time of at most 6 minutes is preferred and of at most 4 minutes is more preferred and of at most 3 minutes is even more preferred and of at most 2 minutes is even more particularly preferred. Generally shorter cycle times are preferred because this generally increases throughput and reduces costs. Currently, a finishing cycle time of at least one half minute is preferred. Finishing cycle time is a preferred cost of manufacture parameter for optimization. By repeatedly calculating and adjusting the process control parameter(s) value(s), better process control and improved cost of manufacture can be effected. By repeatedly calculating and adjusting the process control parameter(s) value(s) using in situ process information and tracked information, better process control, improved finishing, and improved cost of manufacture can generally be effected. Generally, a maximum of one hundred calculations and process control parameter adjustments during a finishing cycle time are preferred although more can be used for particularly critical semiconductor wafer finishing. A process control parameter which changes the friction during finishing is a preferred process control parameter and a process control parameter which changes the coefficient of friction is a more preferred process control parameter. As will generally be apparent to those skilled in the art, these are non-limiting illustrative embodiments.

A processor can evaluate input signals rapidly with the cost of manufacture parameters with algorithms, look-up tables, fuzzy logic, iterative calculation methods, and/or solving multiple simultaneous equations to develop an improved output control signal from the controller and/or subsystem controller.

The semiconductor industry is in a relentless journey to increase computing power and decrease costs. Finishing of a semiconductor wafer using in situ calculations of cost of manufacture parameters to improve finishing control parameters can help simultaneously to decrease cost and reduce unwanted defects. Using current cost of manufacture parameters along with a friction sensing method to evaluate and adjust the boundary layer lubrication in a manner that adjustably controls the coefficient of friction in the operative finishing interface can be particularly effective at reducing unwanted surface defects such as microscratches and microchatter. This system is particularly preferred for finishing with fixed abrasive finishing elements. In addition generally helping to improve such parameters as equipment yield, parametric yield, and defect density, the "cuttability" or cut rate of the fixed abrasive finishing element can generally be extended which improves uptime or equipment utilization. The coefficient of friction in the operative finishing interface can change any number of times during a relatively short finishing cycle time making manual calculations ineffective. Further, the semiconductor wafer cost of manufacture parameters are relatively complex to calculate and the finishing process is relatively short thus manual calculations for equipment adjustment and control are even more difficult and ineffective. Rapid, multiple adjustments of process control parameters using process sensors operatively connected to a processor with access to cost of manufacture parameters are particularly preferred for the rapid in situ process control which helps to increase computing power in the finished semiconductor wafer and decrease manufacturing costs. Thus one can more effectively control, preferably in situ, finishing during changes in lubricating aid changes (like composition, concentration, or operating condition changes) and as applied pressure or operative finishing motion changes by using the systems taught herein. Optimizing the cost of manufacture during real time with preferred operative friction sensor(s) information and useful cost of manufacture information such as current cost of manufacture information, preferably derived from individual and/or semiconductor wafer cost tracking information during manufacture, can aid in reducing costs on this relentless journey. Control of the coefficient of friction in the operative finishing interface is particularly useful and effective to help reduce unwanted surface defects, preferably when combined with real time cost of manufacture information, information processing capability, and real time finishing control capability. Tracked information such as cost of manufacture information can aid in improved effectiveness of in situ control of lubrication in the operative finishing interface.

A model for process control is generally preferred. An empirically based process model can be preferred for some applications. A model using a quantity of historical performance can be a preferred model. A first principles-based process model can also be used for control. A model for predictive control can also be preferred for some application. Using at least in part a first principles process model and at least in part an empirically based process model can be preferred for process control. A yield model can also be preferred for process control. A yield model based at least in part on historical performance is currently preferred. A recipe for finishing a semiconductor wafer can also be used. A recipe can be developed and/or modified based on historical performance. Multiple recipes stored in the look-up tables are preferred. A process model, more preferably multiple process models can be stored in the look-up tables. A processor having access to the look-up tables is preferred. A control subsystem having access to least one process model is preferred and access to at least two process models is more preferred and access to at least three process models is even more preferred. Yield models are generally known to those skilled in the semiconductor wafer manufacturing arts. Process models are generally known to those skilled in the semiconductor wafer manufacturing arts.

Connecting this process control technology, especially non-steady state process to control, in a networking fashion to other equipment in a factory can be preferred. Information on layer thickness, processing times, uniformity, and the like can be shared between equipment to further change and/or improve cost of manufacture. Connecting this process control technology, especially non-steady state process to control, in a networking fashion to other equipment in a factory can be preferred. Information on layer thickness, processing times, uniformity, and the like can be shared between equipment to further change and/or improve business performance and/or profits. For instance, if the layer added is thicker or thinner than target processing conditions for that station, the next station of finishing can be adjusted accordingly to change the finishing recipe and/or conditions. For instance, if the layer is too thick, the next station (if removing material) can be adjusted to remove material more aggressively or for a longer processing period. An apparatus for finishing connected to a multiplicity of other workpiece fabrication machinery, and information derived therefrom in an operative computerized network, the control subsystem having access to at least a portion of the other workpiece fabrication machinery, metrology equipment, and information derived therefrom is preferred. An apparatus for finishing connected to a multiplicity of other workpiece fabrication machinery, and information derived therefrom in an operative computerized network, the control subsystem having access to the other workpiece fabrication machinery, metrology equipment, and information derived therefrom for feedforward and feedback control while applying the finishing energy to the workpiece is also preferred. A process model is preferred for improved process control. A cost of manufacture model is preferred for improved process cost awareness and control thereof. An activity based cost of manufacture model is more preferred for improved process cost awareness and control thereof.

Storing information for later use including information selected from the group consisting of a sales cost, revenue, a customer, customer order, and a model along with a cost of manufacture parameter in a processor readable memory device is preferred. Storing information including information selected from the group consisting of a sales cost, a revenue, a customer, customer order, and a model along with a cost of manufacture parameter and a workpiece tracking code in a processor readable memory device for later use is preferred. Storing information for later use including information selected from the group consisting of a sales cost, a revenue, a customer, customer order, and a model along with cost of manufacture information including at least a cost of manufacture parameter in a processor readable memory device is preferred. Storing information for later use including information selected from the group consisting of a sales cost, a revenue, a customer, customer order, and a model along with cost of manufacture information including at least a cost of manufacture parameter and a workpiece tracking code in a processor readable memory device is preferred. Storing information for later use including information selected from the group consisting of a sales cost, a revenue, a customer, customer order, and a model along with cost of manufacture information including at least a cost of manufacture parameter and a workpiece tracked information in a processor readable memory device is preferred. Storing information for later use including information selected from the group consisting of a sales cost, a revenue, a customer, customer order, and a model along with cost of manufacture information including at least three cost of manufacture parameters and workpiece tracking code in a processor readable memory device is preferred. Storing information for later use including information selected from the group consisting of a sales cost, a revenue, a customer, customer order, and a model along with cost of manufacture information including at least three cost of manufacture parameters and workpiece tracked information in a processor readable memory device is preferred. Storing information for later use including information selected from the group consisting of a sales cost, a revenue, a customer, customer order, and a model along with in situ process information and workpiece tracked information in a processor readable memory device is preferred. A workpiece tracking code is a preferred example of workpiece tracked information. Determining a change for at least one model with the stored information is preferred. Determining a change for a process model with the stored information is preferred and for at least two process models is more preferred and for at least three process models is even more preferred. Determining a change for at least one cost model with the stored information is preferred and for at least two cost models is more preferred and for at least three cost models is even more preferred. Determining a change for a cost of manufacture model with the stored information is preferred and for at least two cost of manufacture models is more preferred and for at least three cost of manufacture models is even more preferred. Determining for a change a business model with the stored information is preferred and for at least two business models is more preferred and for at three business models is even more preferred. Changing a model after determining a change is preferred and changing a model at two separate times is more preferred and changing a model at three separate times is even more preferred. Using the changed model for feedforward control is preferred. Using the changed model for feedback control is preferred. Using the changed model for real time control is more preferred. Determining a change for a process control parameter with the stored information is preferred. Changing a process control parameter after determining a change is preferred.

Reducing the processor readable storage space used for the stored information is preferred. Reducing the computer readable storage space used for the stored information is preferred. Reducing the stored information using a computer algorithm is preferred. Reducing the stored information using a computer algorithm is preferred. Reducing the stored information using at least one mathematical algorithm is preferred. By reducing the stored information, the costs can be reduced. Determining a change for a model with the reduced stored information is preferred. Determining a change for a process model with the reduced stored information is preferred. Determining a change for a cost model with the reduced stored information is preferred. Determining a change for a cost of manufacture model with the reduced stored information is preferred. Determining for a change a business model with the reduced stored information is preferred. Changing a model after determining a change is preferred. Using the changed model for feedforward control is preferred. The storage space is preferably processor readable. The storage space is preferably computer readable. Using the changed model for feedback control is preferred. Using the changed model for real time control is more preferred. Determining a change for a process control parameter with the reduced stored information is preferred. Changing a process control parameter after determining a change is preferred.

A run to run, batch to batch, and in situ process control method having the features and benefits of the preferred embodiment of this invention are new and useful. The feedforward and feedback process control method having features and benefits of the preferred embodiments of this invention are new and useful. The networking of process equipment and methods of control have features and benefits of the preferred embodiments of this invention are new and useful.

In process costs tracked with an activity based cost model can be preferred. An activity based information is a preferred information for process control. Historical performance including activity based cost information is a more preferred information for process control. Historical performance including activity based cost information on the current workpiece is a even more preferred example of example of information for process control. Historical performance including activity based cost information on prior workpiece(s) is an even more preferred example of example of information for process control. Historical performance including activity based cost information the current workpiece and on prior workpiece(s) is an even more preferred example of information for process control. Activity based cost can measure a cost (or costs) by following activities along with their associated costs (resources used) during manufacture. Activity costs comprise resource related costs including labor, material, consumable, and equipment related activities which consume the costs. As a nonlimiting example, a resource can be refining equipment useful for planarizing, polishing, and buffing activities. The finishing equipment cost can be related to the cost drivers of finishing including for instance planarizing and polishing activities by an output quantity (for example hours) consumed in each of finishing or planarizing or polishing by cost driver per unit cost rate (for instance, $/hour of refining equipment used). In a similar manner, labor costs, material costs, and consumable costs can be assigned to activities using an appropriate cost driver(s) and output quantities. The activity costs can then be further related to the style, type, or intermediate stage of manufacture of a workpiece. Different types and/or different stages of manufacture of a semiconductor wafer use different amounts of different cost drivers (such as differences in planarizing, polishing, and buffing drivers). An activity based cost model having a multiple of different level of activity costs and a multiple of different cost drivers in each of the multiple of different levels of activity costs is preferred for semiconductor wafer refining process control. An activity cost is a preferred cost of manufacture parameter for process control. An activity cost and/or cost driver which is a mathematical composite derived from refining a multiplicity of workpieces are preferred. A mode, median or mean value of an activity cost and/or cost driver is a preferred example of a mathematical composite derived from refining a multiplicity of workpieces (or more preferably, workpiece batches). A multi-point moving mathematical composite (for instance a five point or ten point moving average) is a preferred example mathematical composite derived from refining a multiplicity of workpieces (or more preferably, workpiece batches). A preferred mathematical composite is derived, at least in part, mathematical expressions. Using a mathematical composite can facilitate process control using statistical methods to reduce short term noise which can adversely affect process control. An activity cost of the incremental costs associated with the specific step for instance, ILD finishing or planarizing is a preferred activity cost for process control. An activity cost of the cumulative costs associated up to and/or up to and including the specific step for instance, ILD finishing or planarizing is a preferred activity cost for process control. Each can give useful information for controlling the process control parameters. A multistage activity cost model is preferred for refining control during semiconductor wafer manufacture. An activity cost model based at least in part on the manufacturing sequential process activities is very preferred because this can aid in further evaluating the change(s) to a process control parameter when evaluating an activity based cost of manufacture parameter. Historical information including activity cost information is preferred stored in look-up tables. Cost drivers, activity functions, activity costs, and different activity cost models represent nonlimiting preferred historical information relating to activity costs for storing in a look-up table. An activity cost model based at least in part on the manufacturing process activities occurring chronologically in time is very preferred because this facilitates time sensitive process control with chronological activity costs. An activity cost model based at least in part on the manufacturing process activities occurring chronologically in time and further having a yield model is very preferred because this facilitates time sensitive process control with chronological activity costs including considerations of product yields.

Storing historical information including at least one cost of manufacture parameter in at least one lookup-table is preferred and storing historical information including at least two cost of manufacture parameters in at least one lookup-table is more preferred and storing historical information including at least five cost of manufacture parameters in at least one lookup-table is even more preferred and storing historical information including at least a majority of cost of manufacture parameters in at least one lookup-table is even more particularly preferred. Storing historical information including at least one process control parameter in at least one lookup-table is preferred and storing historical information including at least three process control parameters in at least one lookup-table is more preferred and storing historical information including at least five process control parameters in at least one lookup-table is even more preferred and storing historical information including a majority of the process control parameters in at least one lookup-table is even more particularly preferred. Historical information stored with tracking information related to individual workpieces is preferred and historical information stored with tracking information related to semiconductor wafer batches can also be preferred. Data mining can be accomplished on information used previously for process control. This reduces the cost of creating a new table or database for data mining. Further, the data mining results can be more readily applied to new, advanced process control algorithm(s). A cost of manufacture forecasting model can be accomplished on information used previously for process control. By having the cost of manufacture parameters stored in this manner, an improved cost of manufacture forecasting model can be developed and implemented. The new cost of manufacture models can be used when transitioning from a ramp-up phase of development to a commercial phase of development. Modified and/or new process control algorithm(s) can be determined and/or developed by evaluating ramp-up historical information including process control parameters and cost of manufacture parameters and then applying the new process control algorithm for commercial manufacture. Modified and/or new process control algorithm(s) can be determined and/or developed by evaluating previous historical information including process control parameters and cost of manufacture parameters and then applying the new process control algorithm for future commercial manufacture. Thus the historical information which is stored in a look-table is preferably used for a plurality of purposes to reduce the cost of manufacture and/or improved the enterprise profitability. By using the historical information used for initial process control multiple times, additional costs to collect information for data mining, cost of manufacture modeling, and process control algorithm improvement is accomplished in a new, more effective manner to give a new lower cost result.

An finishing control subsystem can improve finishing control and versatility of finishing using models, cost of manufacture parameters, cost models, and/or business models in a new and unexpected manner giving new, unexpected results.

The illustrative use of an algorithm, data mining, fuzzy logic, a mathematical formula, and neural network can also, and preferably be applied determining process control algorithms and process control models for finishing methods using a finishing aid using generally known modifications to the illustrative examples.

Process Control Parameters

Preferred process control parameters include those control parameters which can be changed during processing and affect workpiece finishing. A preferred process control parameter include a control parameter which when changed during processing changes the workpiece finishing, more preferably the workpiece finishing rate as measured in angstroms per minute, and even more preferably changes the quality of the workpiece surface after finishing. Control of the finishing motion, more preferably an operative finishing motion, is a preferred process control parameter. Examples of preferred operative finishing motions include relative velocity, pressure, and type of motion. Examples of preferred types of operative finishing motion include tangential motion, planar finishing motion, linear motion, vibrating motion, oscillating motion, and orbital motion. Finishing temperature is a preferred process control parameter. Finishing temperature can be controlled by changing the heat supplied to the platen or heat supplied to the finishing composition. Alternately, friction can also change the finishing temperature and can be controlled by changes in lubrication, applied pressure during finishing, and relative operative finishing motion velocity. Changes in lubricant can be effected by changing finishing composition(s) and/or feed rate(s). A preferred group of process control parameters consists of parameters selected from the group consisting of wafer relative velocity, platen velocity, polishing pattern, finishing temperature, force exerted on the operative finishing interface, finishing composition, finishing composition feed rate, and finishing pad conditioning. Each of these process control or finishing control parameters can be used singularly or in combination with a plurality control parameters.

Processor

A processor is preferred to help evaluate the workpiece finishing sensor information. A processor can be a microprocessor, an ASIC, or some other processing means. Processor preferably has computational and digital capabilities. Non limiting examples of processing information include use of various mathematical equations, calculating specific parameters, memory look-up tables or databases for generating certain parameters such as historical performance or preferred parameters or constants, neural networks, fuzzy logic techniques for systematically computing or obtaining preferred parameter values. Input parameter(s) can include information on current wafers being polished such as uniformity, expected polish rates, preferred lubricants(s), preferred lubricant concentrations, entering film thickness and uniformity, workpiece pattern. Further preferred non-limiting processor capabilities including adding, subtracting, multiplying, dividing, use functions, look-up tables, noise subtraction techniques, comparing signals, and adjusting signals in real time from various inputs and combinations thereof. Memory look-up tables and databases are generally made accessible through memory devices. The memory devices can be integral with the process or operatively connected to the processor.

Historical performance can be used for determining advantages changes to finishing control when using a finishing aid. For example a process model developed using historical performance can be a preferred for some applications. For example a cost of manufacture model developed using historical performance can also be a preferred for some applications. A historical performance including a quantity of historical information is a preferred illustrative example of historical performance. A historical performance including a quantity of historical information of a workpiece is a more preferred illustrative example of historical performance. A historical performance including a quantity of historical information of a current workpiece is a more preferred illustrative example of historical performance. A historical performance including a quantity of historical information of prior workpieces is a more preferred illustrative example of historical performance. A historical performance including a quantity of historical information of the workpiece and a quantity of historical information of prior workpieces is an even more preferred illustrative example of historical performance. A historical performance including a quantity of historical tracked information is a preferred illustrative example of historical performance. A historical performance including a quantity of historical tracked information of a workpiece is a more preferred illustrative example of historical performance. A historical performance including a quantity of historical tracked information of a current workpiece is a more preferred illustrative example of historical performance. A historical performance including a quantity of historical tracked information of prior workpieces is a more preferred illustrative example of historical performance. A historical performance including a quantity of historical tracked information of the workpiece and a quantity of historical tracked information of prior workpieces is an even more preferred illustrative example of historical performance. A quantity of historical tracked information which has been tracked by a batch(s) of workpeices is a preferred illustrative example of a quantity of historical tracked information. A quantity of historical tracked information which has been tracked by an individual workpeice is a preferred illustrative example of a quantity of historical tracked information. A quantity of historical tracked information which has been tracked for a multiplicity of individual workpeices is a particularly preferred illustrative example of a quantity of historical tracked information. Tracked information of the finishing element is an illustrative example of preferred tracked information. Tracked information of the finishing control subsystem is an illustrative example of preferred tracked information. Tracked information of a finishing apparatus having finishing control subsystem is an illustrative example of preferred tracked information. The finishing element, finishing control subsystem, and/or the finishing apparatus having tracking codes are preferred. Using historical tracked information for finishing with finishing aids can generally be used to advantageously change finishing during the finishing cycle time or at least a portion of the finishing cycle time. Using historical tracked information for finishing with finishing aids during the finishing cycle time can generally be used to advantageously change finishing during the finishing cycle time or at least a portion of the finishing cycle time.

Cost of manufacture information is preferred for determining changes to process control parameters. Historical performance including a quantity of historical cost of manufacture information is preferred and historical performance including a quantity of cost of manufacture information from the current workpiece is more preferred and historical performance including a quantity of cost of manufacture information from the current workpiece and prior workpieces is even more preferred. Cost of manufacture information including a quantity of historical cost of manufacture information is preferred and cost of manufacture information including a quantity of cost of manufacture information from the current workpiece is more preferred and cost of manufacture information including a quantity of cost of manufacture information from the current workpiece and prior workpieces is even more preferred. Storing cost of manufacture information is preferred and storing cost of manufacture information including a quantity of cost of manufacture information from the current workpiece is more preferred and storing cost of manufacture information including a quantity of cost of manufacture information from the current workpiece and prior workpieces is even more preferred. Storing a portion of the cost of manufacture information is also preferred. The stored information can be used for current and future process control and data mining.

Further general computing techniques such neural networks and statistical process control are generally known to those skilled in the semiconductor wafer processing arts. General computing techniques such as neural networks (including examples learning neural networks), fuzzy logic, data mining, model control, and statistical process control (including examples of nonconstant mean of response variables) are generally known to those skilled in the various arts. Non-limiting illustrative examples of neural networks, fuzzy logic, data mining, use of cost of manufacture information, and statistical process control are found in U.S. Pat. No. 5,774,833 to Baba et. al., U.S. Pat. No. 5,809,699 to Wong et al., U.S. Pat. No. 5,813,002 to Agrawal et al., U.S. Pat. No. 5,813,002 to Agrawal et al., U.S. Pat. No. 5,818,714 to Zou et al., U.S. Pat. No. 5,822,220 to Baines, U.S. Pat. No. 5,828,812 to Khan et al., U.S. Pat. No. 5,830,955 to Takeda et al., U.S. Pat. No. 5,832,468 to Miller et al., U.S. Pat. No. 5,832,466 to Feldgajer, U.S. Pat. No. 5,841,671 to Furumoto, U.S. Pat. No. 5,841,651 to Fu, U.S. Pat. No. 5,978,398 to Halverson and U.S. Pat. No. 6,568,989 to Molnar and are included herein by reference in their entirety for all purposes and for general guidance and modification by those skilled in the arts using the teachings herein.

Use of Information for Feedback, Feedforward and Controller

Controllers to control the finishing of workpieces are generally known in the art. Controllers generally use information at least partially derived from the processor to make changes to the process control parameters. A processor is preferably operatively connected to a sensor to gain current information about the process and the processor is also operatively connected to a controller which preferably controls the finishing control parameters. As used herein, a control subsystem is a combination of an operative sensor operatively connected to a processor which is operatively connected to a controller which in turn can change finishing control parameters. A preferred finishing control subsystem has real time access to tracked information on the workpiece being finished to improve control of finishing control parameters in real time (in situ) during the finishing cycle time (or a portion of the finishing cycle time). A finishing control subsystem having at least three operative process sensors for sensing in situ process information, access to the tracked information; and a processor to evaluate the in situ process information and tracked information is preferred.

An advantage of this invention is the additional degree of control it gives to the operator performing planarization and/or polishing. To better utilize this control, the use of feedback information to control the finishing control parameters is preferred and in situ control is more preferred. Controlling the finishing control parameters selected from the group consisting of finishing composition feed rates, finishing composition concentration, operative finishing motion, and operative finishing pressure is preferred to improve control of the finishing of the workpiece surface being finished and in situ control is more particularly preferred. Another preferred example of an finishing control parameter is to use a different finishing element for a different portion the finishing cycle time such as one finishing element for the planarizing cycle time and a different finishing element for the polishing cycle time. Workpiece film thickness, measuring apparatus, and control methods are preferred methods of control. Mathematical equations including those developed based on process results can be used. Finishing uniformity parameters selected from the group consisting of Total Thickness Variation (TTV), Focal plane deviation (FPD), Within-Wafer Non-Uniformity (WIW NU), and surface quality are preferred. Average cut rate is a preferred finishing rate control parameter. Average finishing rate is a preferred finishing rate control parameter. Controlling finishing for at least a portion of the finishing cycle time with a finishing sensor subsystem to adjust in situ at least one finishing control parameter that affect finishing results is a preferred method of control finishing. Information feedback subsystems are generally known to those skilled in the art. Illustrative non limiting examples of wafer process control methods include U.S. Pat. No. 5,483,129 to Sandhu issued in 1996, U.S. Pat. No. 5,483,568 to Yano issued in 1996, U.S. Pat. No. 5,627,123 to Mogi issued in 1997, U.S. Pat. No. 5,653,622 to Drill issued in 1997, U.S. Pat. No. 5,657,123 to Mogi issued in 1997, U.S. Pat. No. 5,667,629 to Pan issued in 1997, and U.S. Pat. No. 5,695,601 to Kodera issued in 1997 are included herein for guidance and modification by those skilled in the art and are included herein by reference in their entirety.

Controlling at least one of the finishing control parameter based on using an operative sensor information, more preferably a secondary friction sensor information, combined with workpiece sensor information is preferred and controlling at least two of the finishing control parameters using an operative sensor information, more preferably a secondary friction sensor information, combined with workpiece sensor information is more preferred. Using control subsystem or an electronic finishing sensor subsystem to control the finishing control parameters is preferred. Feedback information selected from the group consisting of finishing rate information and product quality information such as surface quality information is preferred. Non-limiting preferred examples of process rate information include polishing rate, planarizing rate, and workpiece finished per unit time. Non-limiting preferred examples of quality information include first pass first quality yields, focal plane deviation, total thickness variation, measures of non uniformity. Non-limiting examples particularly preferred for electronics parts include Total Thickness Variation (TTV), Focal plane deviation (FPD), Within-Wafer Non-Uniformity (WIW NU), and surface quality. Cost of manufacture information is also preferred information for control. Cost of manufacture information comprises preferred information for tracking. Finishing uniformity parameters selected from the group consisting of Total Thickness Variation (TTV), Focal plane deviation (FPD), Within-Wafer Non-Uniformity (WIW NU), and surface quality can be information for tracking. Total Thickness Variation (TTV), Focal plane deviation (FPD), Within-Wafer Non-Uniformity (WIW NU), and surface quality are illustrative preferred data types for tracking, particularly for multi-level semiconductor wafers where one levels data can be helpful for in situ control while finishing a different level. Types of cost of manufacture information can be preferred data types. Semiconductor wafer film or layer thickness is another illustrative example of data type of tracked information for in situ control since this can also help optimizing the in situ adjustment of finishing control parameters which change the local and/or macro coefficient of friction can generally aid finishing control.

The use of aqueous lubricating compositions in finishing, particularly those having boundary lubricants, in a preferred embodiment including secondary friction sensor(s), friction sensor controllers, and friction sensor subsystems can be used to improve finishing. Supplying a marginal lubricant, preferably a lubricating film, and more preferably an organic lubricating boundary layer, with in situ process control to control the fraction of semiconductor wafer surface area free of organic boundary layer lubrication is preferred.

A friction sensor subsystem which uses a processor which uses at least in part a mathematical equation to aid control is preferred. A mathematical equation developed from laboratory experience, semiworks experience, test wafer experience, and/or actual production can be preferred. Curve fitting to determine mathematical equations based on laboratory experience, semiworks experience, test wafer experience, and/or actual production are generally known to those skilled in the semiconductor arts. Mathematical equations can be used also generally for interpolation and extrapolation. Multiple mathematical equations with multiple unknowns can be solved or resolved in real time for improved process control with a processor. Differential information from multiple workpiece sensors and/or friction sensors can generally be used to improve real time (in situ) control with a processor. A lubrication control subsystem, a friction sensor subsystem, a finishing control subsystem, and a control subsystem can generally use mathematical equations to aid control. A friction sensor subsystem having at least one friction sensors is preferred and having at least two friction sensors is more preferred. A friction sensor subsystem having at least one friction sensor probe is preferred and having at least two friction sensor probes is more preferred.

A control subsystem which uses a processor which uses at least in part a mathematical equation to aid control is preferred. A mathematical equation and/or formula developed from laboratory experience, semiworks experience, test wafer experience, and/or actual production can be preferred. Curve fitting to determine mathematical equations based on laboratory experience, semiworks experience, test wafer experience, and/or actual production are generally known to those skilled in the semiconductor arts. Mathematical equations can be used also generally for interpolation and extrapolation. Multiple mathematical equations with multiple unknowns can be solved or resolved in real time for improved process control with a processor. Differential information from multiple workpiece sensors and/or friction sensors can generally be used to improve real time (in situ) control with a processor. A lubrication control subsystem, a friction sensor subsystem, a finishing control subsystem, and a control subsystem can generally use mathematical equations to aid control. A friction sensor subsystem having at least one friction sensors is preferred and having at least two friction sensors is more preferred. A friction sensor subsystem having at least one friction sensor probe is preferred and having at least two friction sensor probes is more preferred.

A model to aid process control can be preferred which uses cost of manufacture parameters for process control. A process model is a preferred example of a model, which can be used in some embodiments for a process control and a process model which includes differential lubrication is a more preferred example of a model, each of which can be used in some embodiments for process control. A cost model is a preferred example of a model which can be used in some embodiments for a process control. A business model which determines profit using costs and revenue is a preferred example of a model which can be used in some embodiments for a process control. A business model having costs and revenue is a preferred example of a model which can be used in some embodiments for a process control. A business model using activity based accounting having costs and revenue is a preferred example of a model which can be used in some embodiments for a process control. A business model using activity based accounting which determines profit using costs and revenue is a preferred example of a model which can be used in some embodiments for a process control. A business model having access to a cost model and a sales model is a preferred example of a model which can be used in some embodiments for a process control. A business model having access to at least one cost of manufacture parameter, a cost model, and a sales model is a preferred example of a model which can be used in some embodiments for a process control. A business model having access to at least three cost of manufacture parameters, a cost model, and a sales model is a more preferred example of a model which can be used in some embodiments for a process control. A cost model using activity accounting is a preferred example of a model which can be used in some embodiments for process control. An activity based cost model is a preferred example of a model which can be used in some embodiments for a process control. A cost of manufacture model is a preferred example of a cost model which can be used in some embodiments for a process control. A cost of manufacture model using activity accounting is a preferred example of a cost model, which can be used in some embodiments for a process control. An activity based cost of manufacture model is a preferred example of a cost model which can be used in some embodiments for a process control. A sales model is a preferred example of a cost model which can be used in some embodiments for a process control. An activity based cost of sales model is a preferred example of a cost model which can be used in some embodiments for process control. An activity based cost of sales model which assigns activity costs by customer is a more preferred example of a cost model which can be used in some embodiments for process control. An activity based cost of sales model which assigns activity costs by customer and order is an even more preferred example of a cost model which can be used in some embodiments for process control. An empirically-based model can be preferred. An empirically-based model developed at least in part on stored historical performance is preferred. Process models are generally known to those skilled in the semiconductor wafer manufacturing arts. Determining a change for at least one process control parameter using at least one model disclosed herein for changing and/or controlling the method of making a workpiece is preferred. Cost models can, given the guidance and teachings herein, cost models can generally be developed by those generally skilled in the art and used for process control as used herein. Business models can, given the guidance and teachings herein, cost models can generally be developed by those generally skilled in the art and used for process control as used herein. Methods to compute cost of manufacture parameter(s) and/or activity based cost(s) with cost of manufacture information are generally well known. Methods to calculate cost of manufacture parameter(s) and/or activity based cost(s) with cost of manufacture information are generally well known. Methods to determine cost of manufacture parameter(s) and/or activity based cost(s) with cost of manufacture information are generally well known. Additional general helpful guidance on business, cost, and profit models along with generally useful calculations, mathematical algorithms, formulas, and other useful computing methods can be found in the books *Principles of Corporate Finance* by Richard A. Bealey and Stewart C. Myers, McGraw-Hill Companies, 1996, *Activity-based Cost Management Making* Work by Gary Cokins, McGraw-Hill Companies, 1996 and *Pricing for Profitability* by John L. Daly, John Wiley & Sons, Inc., 2002 and are included herein in their entirety for general guidance and modification by those skilled in the arts.

An empirically-based process model can be preferred. An empirically based process model developed at least in part on historical performance is preferred. A mathematical equation and/or formula developed from laboratory experience, semiworks experience, test wafer experience, and/or actual production can be preferred. Curve fitting to determine a mathematical equation and/or formula based on laboratory experience, semiworks experience, test wafer experience, and/or actual production is generally known to those skilled in the semiconductor arts. Curve fitting to determine mathematical formulas using historical performance can be preferred. Mathematical equations generally can be used also for interpolation and extrapolation. Multiple mathematical equations with multiple unknowns can be solved or resolved in real time for improved process control with a processor. A first principles-based process model can also be used for control. Using at least in part a first principles process model and at least in part an empirically based process model can be preferred for process control. A yield model can also be preferred for process control. A yield model based at least in part on historical performance is currently preferred. A recipe for finishing a semiconductor wafer can also be used. A recipes can be developed and/or modified based on historical performance. Multiple recipes stored in the look-up tables is preferred. A process model, more preferably multiple process models can be stored in the look-up tables. A processor having access to the look-up tables is preferred. A control subsystem having access to least one process model is preferred and access to at least two process models is more preferred and access to at least three process models is even more preferred. Yield models are generally known to those skilled in the semiconductor wafer manufacturing arts. Process models are generally known to those skilled in the semiconductor wafer manufacturing arts.

Connecting this process control technology, especially non-steady state process to control, in a networking fashion to other equipment in a factory can be preferred. Information on layer thickness, processing times, uniformity, and the like can be shared between equipment to further change and/or improve cost of manufacture. Connecting this process control technology, especially non-steady state process to control, in a networking fashion to other equipment in a factory can be preferred. Information on layer thickness, processing times, uniformity, and the like can be shared between equipment to further change and/or improve business performance and/or profits. For instance, if the layer added is thicker or thinner than target processing conditions for that station, the next station of finishing can be adjusted accordingly to change the finishing recipe and/or conditions. For instance, if the layer is too thick, the next station (if removing material) can be adjusted to remove material more aggressively or for a longer processing period. An apparatus for finishing connected to a multiplicity of other workpiece fabrication machinery, and information derived therefrom in an operative computerized network, the control subsystem having access to at least a portion of the other workpiece fabrication machinery, metrology equipment, and information derived therefrom is preferred. An apparatus for finishing connected to a multiplicity of other workpiece fabrication machinery, and information derived therefrom in an operative computerized network, the control subsystem having access to the other workpiece fabrication machinery, metrology equipment, and information derived therefrom for feedforward and feedback control while applying the finishing energy to the workpiece is also preferred. A process model is preferred for improved process control. A cost of manufacture model is preferred for improved process cost awareness and control thereof. An activity based cost of manufacture model is more preferred for improved process cost awareness and control thereof.

Storing information for later use including information selected from the group consisting of a sales cost, revenue, a customer, customer order, and a model along with a cost of manufacture parameter in a processor readable memory device is preferred. Storing information including information selected from the group consisting of a sales cost, a revenue, a customer, customer order, and a model along with a cost of manufacture parameter and a workpiece tracking code in a processor readable memory device for later use is preferred. Storing information for later use including information selected from the group consisting of a sales cost, a revenue, a customer, customer order, and a model along with cost of manufacture information including at least a cost of manufacture parameter in a processor readable memory device is preferred. Storing information for later use including information selected from the group consisting of a sales cost, a revenue, a customer, customer order, and a model along with cost of manufacture information including at least a cost of manufacture parameter and a workpiece tracking code in a processor readable memory device is preferred. Storing information for later use including information selected from the group consisting of a sales cost, a revenue, a customer, customer order, and a model along with cost of manufacture information including at least a cost of manufacture parameter and a workpiece tracked information in a processor readable memory device is preferred. Storing information for later use including information selected from the group consisting of a sales cost, a revenue, a customer, customer order, and a model along with cost of manufacture information including at least three cost of manufacture parameters and workpiece tracking code in a processor readable memory device is preferred. Storing information for later use including information selected from the group consisting of a sales cost, a revenue, a customer, customer order, and a model along with cost of manufacture information including at least three cost of manufacture parameters and workpiece tracked information in a processor readable memory device is preferred. Determining a change for at least one model with the stored information is preferred. Determining a change for a process model with the stored information is preferred and for at least two process models is more preferred and for at least three process models is even more preferred. Determining a change for at least one cost model with the stored information is preferred and for at least two cost models is more preferred and for at least three cost models is even more preferred. Determining a change for a cost of manufacture model with the stored information is preferred and for at least two cost of manufacture models is more preferred and for at least three cost of manufacture models is even more preferred. Determining for a change a business model with the stored information is preferred and for at least two business models is more preferred and for at three business models is even more preferred. Changing a model after determining a change is preferred and changing a model at two separate times is more preferred and changing a model at three separate times is even more preferred. Using the changed model for feedforward control is preferred. Using the changed model for feedback control is preferred. Using the changed model for real time control is more preferred. Determining a change for a process control parameter with the stored information is preferred. Changing a process control parameter after determining a change is preferred.

Reducing the processor readable storage space used for the stored information is preferred. Reducing the computer readable storage space used for the stored information is preferred. Reducing the stored information using a computer algorithm is preferred. Reducing the stored information using a computer algorithm is preferred. Reducing the stored information using at least one mathematical algorithm is preferred. By reducing the stored information, the costs can be reduced. Determining a change for a model with the reduced stored information is preferred. Determining a change for a process model with the reduced stored information is preferred. Determining a change for a cost model with the reduced stored information is preferred. Determining a change for a cost of manufacture model with the reduced stored information is preferred. Determining for a change a business model with the reduced stored information is preferred. Changing a model after determining a change is preferred. Using the changed model for feedforward control is preferred. The storage space is preferably processor readable. The storage space is preferably computer readable. Using the changed model for feedback control is preferred. Using the changed model for real time control is more preferred. Determining a change for a process control parameter with the reduced stored information is preferred. Changing a process control parameter after determining a change is preferred.

A run to run, batch to batch, and in situ process control method having the features and benefits of the preferred embodiment of this invention are new and useful. Process control during the finishing cycle time is preferred. Process control using real time finishing information (or progress of finishing information) during the finishing cycle time is more preferred. The feedforward and feedback process control method having features and benefits of the preferred embodiments of this invention are new and useful. The networking of process equipment and methods of control have features and benefits of the preferred embodiments of this invention are new and useful.

Figure 14A:
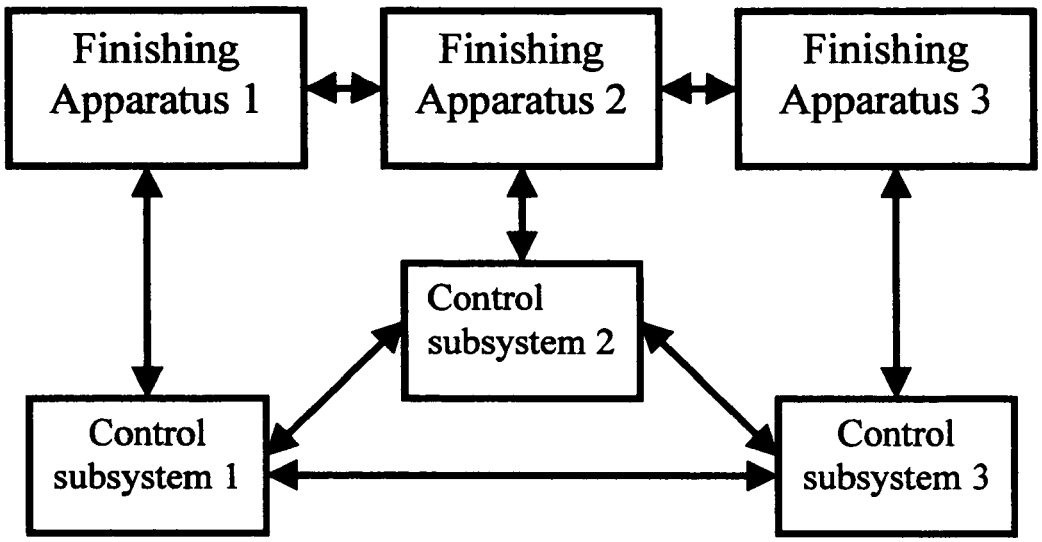
Figure 14B:
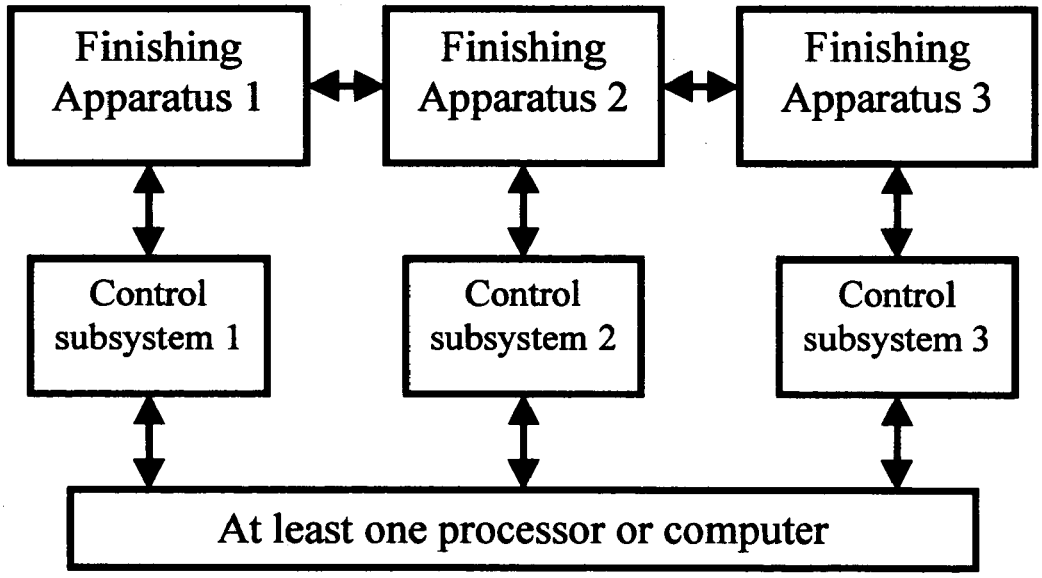

FIGS. 10–13 illustrate preferred methods of finishing. FIG. 14*a* are a nonlimiting illustrative of control subsystems which are networked to each other and to their respective process equipment (multiple finishing apparatus). As indicated by the arrows the apparatus can exchange information. Not illustrated but generally understood, the process and communication can also include proceeding equipment and other process steps and/or apparatus can downfield of this equipment. Further the as is generally known in the semiconductor industry, some steps or groups of steps can be repeated during the manufacture of a semiconductor wafer (such as finishing and/or planarization). FIG. 15*b* is a nonlimiting illustrative of a control subsystem which is networked to each other through a more central computer unit and directly to their respective process equipment (such as finishing apparatus as shown). Other apparatus such as patterning apparatus and cleaning apparatus can also be networked as will generally known to those skilled in the arts. As indicated by the arrows information can be exchanged with the different apparatus. To simplify the illustration, not shown, communication between this equipment and other process steps and apparatus such as those upfield or downfield of this equipment can generally be implemented by those skilled in the communication arts. Further the as is generally known in the semiconductor industry, some steps or groups of steps can be repeated during the manufacture of a semiconductor wafer. Still further, there are many generally known operative networking systems which are generally known in the computer art field and process control field which will be functional and useful. For instance, the control subsystems can be embedded or remote or some combination thereof. Networks and operative connections can be direct or indirect and/or some combination thereof. An operative network can aid in the process control using information selected from the group consisting of tracking codes, tracking information, cost of manufacture parameters, and models and combinations thereof. An operative communications network between apparatus, preferably at three apparatus, is preferred for process control when using finishing aids and/or cost of manufacture information for process control. Improved historical performance information can is generally available for improved process control, particularly if tracked information is also available.

The real time or in situ process control methods having features and benefits of the preferred methods of this invention are new and useful in the finishing industry.

Finishing Element Conditioning

A finishing element can be conditioned before use or between the finishing of workpieces. Conditioning a finishing element is generally known in the CMP field and generally comprises changing the finishing element finishing surface in a way to improve the finishing of the workpiece. As an example of conditioning, a finishing element having no basic ability or inadequate ability to absorb or transport a finishing composition can be modified with an abrasive finishing element conditioner to have a new texture and/or surface topography to absorb and transport the finishing composition. As a non-limiting preferred example, an abrasive finishing element conditioner having a mechanical mechanism to create a finishing element finishing surface which more effectively transports the finishing composition is preferred. The abrasive finishing element conditioner having a mechanical mechanism to create a finishing element finishing surface which more effectively absorbs the finishing composition is also preferred. A abrasive finishing element conditioner a having mechanical mechanism comprising a plurality of abrasive points which through controlled abrasion can modify the texture or surface topography of a finishing element finishing surface to improve finishing composition absorption and/or transport is preferred. An abrasive finishing element conditioner having a mechanical mechanism comprising a plurality of abrasive points comprising a plurality of diamonds which through controlled abrasion can modify the texture and/or surface topography of a finishing element finishing surface to improve finishing composition absorption and/or transport is preferred.

Modifying a virgin finishing element finishing surface with a finishing element conditioner before use is generally preferred. Modifying a finishing element finishing surface with a finishing element conditioner a plurality of times is also preferred, conditioning a virgin finishing element finishing surface can improve early finishing performance of the finishing element such as by exposing the lubricants. Modifying a finishing element finishing surface with a finishing element conditioner a plurality of times during it useful life in order to improve the finishing element finishing surface performance over the finishing cycle time by exposing new, unused lubricant, particularly new lubricant particles, is preferred. Conditioning a finishing surface by cleaning is preferred. Nondestructive conditioning is a preferred form of conditioning. Conditioning a finishing element finishing surface a plurality of times during it useful life can keep the finishing element finishing surface performance higher over its useful lifetime by exposing fresh lubricant particles to improve finishing performance is also preferred. Using feedback information, preferably information derived from a friction sensor probe, to select when to modify the finishing element finishing surface with the finishing element conditioner is preferred. Using feedback information, preferably information derived from a friction sensor probe, to optimize the method of modifying the finishing element finishing surface with the finishing element conditioner is more preferred. Use of feedback information is discussed further herein in other sections. When using a fixed abrasive finishing element, a finishing element having three dimensionally dispersed lubricants is preferred because during the finishing element conditioning process, material is often mechanically removed from the finishing element finishing surface and preferably this removal exposes fresh lubricants, particularly lubricant particulates, to improve finishing.

Nonlimiting examples of textures and topographies useful for improving transport and absorption of the finishing composition and/or finishing element conditioners and general use are given in U.S. Pat. No. 5,216,843 to Breivogel, U.S. Pat. No. 5,209,760 to Wiand, U.S. Pat. No. 5,489,233 to Cook et. al., U.S. Pat. No. 5,664,987 to Renteln, U.S. Pat. No. 5,655,951 to Meikle et. al., U.S. Pat. No. 5,665,201 to Sahota, and U.S. Pat. No. 5,782,675 to Southwick and are included herein by reference in their entirety for general background and guidance and modification by those skilled in the art.

Cleaning Composition

After finishing the workpiece such as a electronic wafer, the workpiece is generally carefully cleaned before the next manufacturing process step. A lubricant or abrasive particles remaining on the finished workpiece can cause quality problems later on and yield losses.

A lubricant which can be removed from the finished workpiece surface by supplying a water composition to the finished workpiece is preferred and a lubricant which can be removed from the finished workpiece surface by a hot water composition to the finished workpiece is also preferred. An example of a water composition for cleaning is a water solution comprising water soluble surfactants. An effective amount of lubricant which lowers the surface tension of water to help clean abrasive and other adventitious material from the workpiece surface after finishing is particularly preferred.

A lubricant which can be removed from the finished workpiece surface by supplying deionized water to the finished workpiece to substantially remove all of the lubricant is preferred and a lubricant which can be removed from the finished workpiece surface by supplying hot deionized water to the finished workpiece to substantially remove all of the lubricant is also preferred. A lubricant which can be removed from the finished workpiece surface by supplying a deionized water to the finished workpiece to completely remove the lubricant is more preferred and a lubricant which can be removed from the finished workpiece surface by supplying hot deionized water to the finished workpiece in to completely remove the lubricant is also more preferred. Supplying a cleaning composition having a surfactant which removes lubricant from the workpiece surface just polished is a preferred cleaning step. A lubricant which lowers the surface tension of the water and thus helps remove any particles from the finished workpiece surface is preferred.

By using water to remove lubricant, the cleaning steps are lower cost and generally less apt to contaminate other areas of the manufacturing steps. A water cleaning based process is generally compatible with many electronic wafer cleaning process and thus is easier to implement on a commercial scale.

Further Comments on Method of Operation

Boundary lubricants form lubricating boundary layers between two surfaces when the surfaces are in operative friction contact. Lubricating boundary layers can be controlled by changing the boundary layer control parameters. A preferred group of lubricating boundary layer control parameters consists of parameters selected from the group consisting of operative finishing motion, boundary lubricant concentration, boundary lubricant feed rate, chemistry of the boundary lubricant, and temperature. A preferred group of operative finishing motions consists of motions selected from the group consisting of continuous motion, discontinuous motion, and velocity of the motion. A preferred group of operative finishing motions consists of motions selected from the group consisting of continuous motion, intermittent motion, and velocity of the motion. Vibrating motion, linear motion, and circular motion are preferred motions for changing or controlling the lubricating boundary layer performance. Changing the pressure at the operative finishing interface can change the lubricating boundary layer performance. Changing the motion such as speed or type of motion can change the lubricating boundary layer performance. Changing the feed rate of the boundary lubricant can change the lubricating boundary performance. Changing the pressure applied in the operative finishing interface, either total pressure or regional pressure can change the lubricating boundary layer performance. Changing the temperature in the operative finishing interface, either average or regional temperatures can change the lubricating boundary layer performance. Changing the chemistry of the boundary lubricant can change the lubricating boundary performance. The above parameters comprise preferred lubricating boundary layer control parameters and can be used to effect changes in the finishing of the workpiece surface being finished. Changing a lubricating boundary layer control parameter to change the tangential force of friction at the operative finishing interface is preferred and changing a lubricating boundary layer control parameter to change the tangential force of friction at a region in the operative finishing interface is more preferred and changing a lubricating boundary layer control parameter to change the tangential force of friction in at least two regions of the operative finishing interface is even more preferred. Changing a control parameter to change the tangential force of friction at the operative finishing interface is preferred and changing a control parameter to change the tangential force of friction at a region in the operative finishing interface is more preferred and changing a control parameter to change the tangential force of friction in at least two regions of the operative finishing interface is even more preferred. Changing the lubricating boundary control parameters at least once during the finishing cycle time is preferred and changing the lubricating control parameters at least twice during the finishing cycle time is more preferred. Changing the lubricating boundary layer control parameters in situ is preferred and changing the lubricating boundary layer control parameters in situ with a subsystem controller is more preferred and changing the lubricating boundary layer control parameters in situ with a controller based on a secondary friction sensor signal is even more preferred. Changing at least one control parameter in situ is preferred and changing at least one control parameter in situ with a subsystem controller is more preferred and changing at least one control parameter in situ with a controller based on a secondary friction sensor signal is even more preferred. Controlling at least one control parameter in situ is preferred and controlling at least one control parameter in situ with a subsystem controller is more preferred and controlling at least one control parameter in situ with a controller based on a secondary friction sensor signal is even more preferred.

A finishing aid selected from the group consisting of a lubricating aid and chemically reactive aid is preferred. A finishing aid which reacts with the workpiece surface being finished is preferred and which reacts with a portion of the workpiece surface being finished is more preferred and which differentially reacts with heterogeneous portions of a workpiece surface being finished is even more preferred. By reacting with the workpiece surface, control of finishing rates can be improved and some surface defects minimized or eliminated. A finishing aid which reacts chemically with the workpiece surface is preferred. A finishing aid which reduces friction during finishing is also preferred because surface defects can be minimized.

Supplying an effective amount of finishing aid, preferably a lubricating aid, more preferably a reactive finishing aid, which reduces the coefficient of friction between the finishing element finishing surface and the workpiece surface being finished is preferred. Supplying an effective amount of finishing aid, more preferably a lubricating aid, which reduces the unwanted surface damage to the surface of the workpiece being finished during finishing is preferred. Supplying an effective amount of finishing aid, more preferably a lubricating aid, which differentially lubricates different regions of the work piece and reduces the unwanted surface damage to at least a portion of the surface of the workpiece being finished during finishing is preferred. Providing an effective amount of a finishing aid which reduces the coefficient of friction between the finishing element finishing surface and the workpiece surface being finished is preferred. Providing an effective amount of a finishing aid which reduces the unwanted surface damage to the surface of the workpiece being finished during finishing is preferred. Providing an effective amount of a finishing aid which differentially lubricates different regions of the work piece and reduces the unwanted surface damage to at least a portion of the surface of the workpiece being finished during finishing is preferred. Sensing the change in friction and/or finishing rates with the operative process sensors can be accomplished using technology disclosed herein. At least one processor sensor is preferred and at least two processor sensors are more preferred and at least three process sensors are even more preferred and at least five process sensors is even more preferred for control finishing. A preferred operative process sensor is an operative friction sensor. A preferred operative process sensor is an operative workpiece sensor. Sensing a change in friction of an operative process sensor is preferred and sensing a change in friction with a plurality of operative process sensors is more preferred. Sending the information sensed from an operative process sensor about finishing to a processor having access to cost of manufacture parameters is preferred and sending the information sensed from a plurality of operative process sensors about finishing to a processor having access to cost of manufacture parameters is more preferred. Sensing a change in friction of an operative friction sensor is preferred and sensing a change in friction with a plurality of operative friction sensors is more preferred. Sending the information sensed from an operative process sensor about finishing to a processor having access to tracked information is preferred and sending the information sensed from a plurality of operative process sensors about finishing to a processor having access to tracked information is more preferred and sending the information sensed from at least three operative process sensors about finishing to a processor having access to tracked information is more preferred. Sending the information sensed from an operative friction sensor about finishing to a processor having access to cost of manufacture parameters is preferred and sending the information sensed from a plurality of operative friction sensors about finishing to a processor having access to cost of manufacture parameters is more preferred. An optical friction sensor is a preferred friction sensor. Non-limiting preferred examples of optical friction sensors is an infrared thermal sensing unit such as a infrared camera and a laser adjusted to read minute changes of movement friction sensor probe to a perturbation. A non-optical sensing friction sensor is a preferred friction sensor. Non-limiting preferred examples of non-optical friction sensors include thermistors, thermocouples, diodes, thin conducting films, and thin metallic conducting films. Changing a control parameter to change the tangential force of friction in the operative finishing interface is preferred and changing a control parameter to change the tangential force of friction at a region in the operative finishing interface is more preferred and changing a control parameter to change the tangential force of friction in at least two regions of the operative finishing interface is even more preferred. Control of the tangential force of friction and/or the coefficient of friction in the operative finishing interface is particularly useful and effective to help reduce unwanted surface defects.

A preferred friction sensor subsystem has access to cost of manufacture parameters, preferably useful cost of manufacture parameters, and even more preferably trackable and useful cost of manufacture parameters. A preferred example of generally useful cost of manufacture information is current cost of manufacture information which has been tracked and more preferably updated using generally known activity based accounting techniques. Another preferred example of useful cost of manufacture parameters is the cost of manufacture of manufacturing steps which preceded the current finishing step such as prior finishing steps, metallization steps, or interlayer dielectric steps. Another preferred example of useful cost of manufacture parameters is the cost of manufacturing steps which occur after the current finishing step such as later finishing steps, metallization steps, or interlayer dielectric steps. The current finishing step can affect the cost of manufacture of a later step because some defects such generally poor planarity can adversely impact latter manufacturing step costs such as by negativity impacting latter step yields. A finishing control subsystem and/or a friction sensor subsystem having access to cost of manufacture parameters is preferred and having access to current cost of manufacture parameters is more preferred and having trackable information is even more preferred.

Evaluating finishing control parameters in situ for improved adjustment using finishing control is preferred and using the finishing control parameters in situ at least in part for this improved adjustment of finishing control is more preferred. Evaluating finishing control parameters in situ with tracked information for improved adjustment of finishing control is preferred and using the finishing control parameters in situ at least in part for this improved adjustment of finishing control is more preferred. Cost of manufacture information is an example of preferred tracked information. Prior steps such as metallizing steps, annealing steps, insulating layers steps include nonlimiting examples of preferred tracked information. Prior steps can impact the preferred in situ control of finishing control parameters such as, but not limited to, lubricating changes to the operative finishing interface, preferred pressures, and preferred coefficient of friction (either regional or across the operative finishing interface. For instance, if the metal layer has larger crystals due to the type of annealing which are subject to "pickout defects", lower a lower coefficient of friction in the conductive region (such as copper or copper alloy) can be preferred. In another application, the semiconductor can have multiple layers of porous low-k insulating layers which have lower tensile strengths and can form unwanted defects if subjected to high forces of friction during finishing. Changing the lubricating of the operative finishing interface can reduce unwanted damage to the porous low-k layers. In another application, the interface between a conductive layer and a nonconductive layer can be of lower strength and thus again high forces of friction in the operative finishing interface can form unwanted defects which can cause unwanted yield losses during manufacture. Changing the finishing control parameters to reduce the coefficient of friction can aid in reducing unwanted yield losses. Thus tracked information can be used in situ to improve process control during finishing with a finishing control subsystem. Providing a lubricant to the operative finishing interface comprising the interface formed between the abrasive finishing element finishing surface and the semiconductor wafer surface being finished is preferred. Providing a finishing control subsystem having at least two operative process sensors for sensing in situ process information and having access to the tracking information is preferred and providing a finishing control subsystem having at least three operative process sensors for sensing in situ process information and having access to the tracking information is more preferred and providing a finishing control subsystem having at least five operative process sensors for sensing in situ process information and having access to the tracking information is even more preferred. Changing a control parameter in response to the in situ process information and tracking information which changes the coefficient of friction and/or tangential force of friction during at least a portion of the finishing cycle time is preferred and which changes the coefficient of friction and/tangential force of friction in a uniform region of the workpiece surface is more preferred and which changes the coefficient of friction and/tangential force of friction in a plurality uniform regions of the workpiece surface is even more preferred.

A method which updates the memory look-up tables, algorithms, or control logic consistent with the current manufacturing step is preferred. A method which updates the cost of manufacture control parameters, look-up tables, algorithms, or control logic consistent with the current manufacturing step is preferred. A method which updates the tracked information including memory look-up tables, algorithms, or control logic consistent with the current manufacturing step while evaluating prior manufacturing steps (such as completed manufacturing steps) is more preferred. A method which updates the tracked information such as the cost of manufacture control parameters, look-up tables, algorithms, or control logic consistent with the current manufacturing step while evaluating prior manufacturing steps (such as completed manufacturing steps) is more preferred. A method which updates with tracked information including memory look-up tables, algorithms, or control logic consistent with the current manufacturing step while evaluating future manufacturing steps is even preferred. A method which updates with tracked information such as the cost of manufacture control parameters, look-up tables, algorithms, or control logic consistent with the current manufacturing step while evaluating future manufacturing steps is even preferred. A method which updates with tracked and/or trackable information (such as projectable information) such as the cost of manufacture control parameters, look-up tables, algorithms, or control logic consistent with the current manufacturing step while evaluating both prior and future manufacturing steps is even more preferred. Memory look-up tables and databases can have preferred data types. A tracking code is a preferred method to aid evaluation of prior, current, and future manufacture steps. The tracking code (and/or tracked information) can be by individual semiconductor wafer and/or by semiconductor wafer batch. This can facilitate low cost manufacture and/or improved control of finishing using finishing aids, preferably during the finishing cycle time. For instance, a finishing rate (local, regional, and/or average finishing rates) can generally be changed to generally improve finishing by lowering cost of manufacture and/or improving workpiece quality. This can facilitate low cost manufacture and improved in situ control of finishing aid use (such as reactive finishing aids, lubricating aids, lubricating films and/or active lubrication). This can facilitate low cost manufacture and improved in situ control of lubrication (such as lubricating films and/or active lubrication). This is preferred for multi-level semiconductor wafer processing because one level finishing can affect the next level finishing. This is because a defect formed on one layer can generally affect (usually adversely) the next level(s). Further, the type and composition of each layer can impact the improved real time control of finishing such as where a particular layer has a reduced strength due to porosity.

A process control parameter which changes the friction during finishing is a preferred process control parameter and a process control parameter which changes the coefficient of friction is a more preferred process control parameter. Supplying and controlling a finishing aid to the workpiece surface being finished having a property selected from the group consisting of changing the workpiece surface coefficient of friction, changing workpiece surface average cut rate, and changing the cut rate of a specific material of the workpiece surface being finished is particularly preferred. Supplying and controlling a finishing aid to the workpiece surface being finished having a property selected from the group consisting of changing the workpiece surface coefficient of friction, changing workpiece surface finishing rate, and changing the finishing rate of a specific material of the workpiece surface being finished is particularly preferred. Providing a finishing aid to the workpiece surface being finished having a property selected from the group consisting of changing the workpiece surface coefficient of friction, changing workpiece surface finishing rate, and changing the finishing rate of at least a first chemical composition of a heterogeneous workpiece surface having at least a first chemical composition and a second chemical composition is particularly preferred and changing the finishing rate of at least a first chemical composition and a second chemical composition of a heterogeneous workpiece surface having at least a first chemical composition and a second chemical composition is more particularly preferred. Changing the pressure at the operative finishing interface to detect potential changes in the coefficient of friction is preferred and changing the pressure at least four times at the operative finishing interface to detect potential changes in the coefficient of friction is more preferred and changing the pressure at least ten times at the operative finishing interface to detect potential changes in the coefficient of friction is more preferred and changing the pressure at least twenty times at the operative finishing interface to detect potential changes in the coefficient of friction is more preferred. Changing the pressure at the operative finishing interface to detect potential changes in the effective coefficient of friction is preferred and changing the pressure at least four times at the operative finishing interface to detect potential changes in the effective coefficient of friction is more preferred and changing the pressure at least ten times at the operative finishing interface to detect potential changes in the effective coefficient of friction is more preferred and changing the pressure at least twenty times at the operative finishing interface to detect potential changes in the effective coefficient of friction is more preferred. Changing the effective coefficient of friction by at least in part changing the pressure applied to the friction sensor is a preferred embodiment. Controlling at least one finishing control parameter changing the effective coefficient of friction in the operative finishing interface is preferred. Providing an effective amount of an aqueous lubricating composition between the finishing element surface and the workpiece being finished for at least a portion of the finishing time in order to reduce the coefficient of friction or a calculated effective coefficient of friction between the finishing element surface and the workpiece being finished and providing a separate alternate finishing composition between the finishing element finishing surface and the workpiece being finished for at least a portion of the finishing time is also preferred. By determining changes to control parameters while using finishing aids, unwanted workpiece defects can be generally be reduced. By determining and/or evaluating changes to control parameters using real time progress of finishing information and tracked information, unwanted workpiece defects can generally be reduced further. By determining and/or evaluating changes to control parameters using real time progress of finishing information, tracked information and cost of manufacture information, the cost of manufacture and unwanted workpiece can generally be improved. For instance, the information can be used develop and/or improve a process model and/or an algorithm used for controlling finishing with a finishing aid(s).

As used herein, a finishing sensor subsystem preferably has at least one operative friction sensor and a finishing sensor subsystem having at least two operative friction sensors is more preferred and a finishing sensor subsystem having at least one friction sensor and at least one workpiece sensor is also more preferred and a finishing sensor subsystem having at least two friction sensors and at least one workpiece sensor is particularly preferred for controlling finishing of semiconductor wafers. A preferred finishing sensor subsystem has access to cost of manufacture parameters, preferably current cost of manufacture parameters, and even more preferably, trackable current cost of manufacture parameters.

Applying higher pressure in the unwanted raised region on the semiconductor wafer surface compared to pressure applied to the region below the unwanted raised region causing the organic lubricating film thickness to be less on the unwanted raised region and the organic lubricating film thickness to be greater on at least portion of the semiconductor wafer surface below the raised region is a preferred method for differential finishing rates. Applying higher pressure in the unwanted raised region on the semiconductor wafer surface compared to pressure applied to the region below the unwanted raised region causing the organic lubricating film thickness to be less on the unwanted raised region and a higher temperature on the unwanted raised region and the organic lubricating film thickness to be greater on at least portion of the semiconductor wafer surface below the raised region and a lower temperature is more preferred method for differential finishing rates.

A preferred finishing aid control parameter is a parameter which affects the finishing aid in the operative finishing interface. A lubrication control parameter is a parameter which affects the lubrication of the operative finishing interface. A lubrication control parameter is a preferred process control parameter. A lubricating control parameter is a parameter which affects the lubrication in the operative finishing interface—such as regional lubrication or average lubrication. A lubricating control parameter selected from the group consisting of the lubricant chemistry, lubricant concentration, lubricant transfer rate, operative finishing interface temperature, operative finishing interface pressure, and operative finishing interface motion is a preferred group of lubricating boundary layer control parameters. A parameter selected from the group consisting of the local lubricant chemistry, local lubricant concentration, local lubricant feed rate, local operative finishing interface temperature, local operative finishing interface pressure, and local operative finishing interface motion is also a preferred group of lubricating control parameters.

A method of finishing wherein the controlling and adjusting the process control parameters changes either one or both the tangential force of friction or the coefficient of friction in the operative finishing interface is preferred and wherein adjusting the process control parameters change one or both the tangential force of friction or the coefficient of friction two times in the operative finishing interface during the finishing cycle time is more preferred and wherein adjusting the process control parameters change one or both the tangential force of friction or the coefficient of friction four times in the operative finishing interface during the finishing cycle time is even more preferred. A plurality of friction sensors generally aids this advanced control. Use of a plurality of cost of manufacture parameters also generally aids this advanced control to reduce the finishing cost of the semiconductor wafer. Some further nonlimiting examples follow. A method of finishing wherein the semiconductor wafer surface has at least one uniform region and controlling and adjusting at least 4 times a minimum of three process control parameters changes a coefficient of friction in at least the uniform region of the semiconductor wafer surface at least two times during the finishing cycle time is preferred. A method of finishing wherein the semiconductor wafer surface has at least one uniform region wherein the controlling and adjusting at least 4 times a minimum of two process control parameters changes in a tangential force of friction in at least a region of the operative finishing interface at least two times during the finishing cycle time is preferred.

Controlling the thickness of the organic lubricating boundary layer by changing at least one lubrication control parameter in a manner that changes the coefficient of friction in at least two different regions in the operative finishing interface in response to an in situ control signal is preferred.

Controlling the thickness of the lubricating boundary layer by changing at least two process control parameters in situ based on feed back information from a lubrication control subsystem having a friction sensor is also preferred. Controlling at least once the thickness of the organic lubricating boundary layer which changes the coefficient of friction in the operative finishing interface by changing at least one process control parameter in situ based on feed back information from a control subsystem during the finishing cycle time is preferred. A semiconductor wafer surface having at least a first region wherein the lubricating boundary layer thickness is at most one half the molecular layer thickness compared to the lubricating boundary layer thickness on a second, different region is preferred and a semiconductor wafer surface having at least a first region wherein the lubricating boundary layer thickness is at most one third the molecular layer thickness compared to the lubricating boundary layer thickness on a second, different region is more preferred when controlling the coefficient of friction, particularly when controlling the changes in the coefficient of friction. Controlling the thickness of the organic lubricating boundary layer by changing at least one process control parameter in situ based on feed back information from a control subsystem during the finishing cycle time and wherein the control subsystem tracks and updates the feed back information for finishing a plurality of the metal layers is even more preferred for semiconductor wafers having multiple functional levels.

Controlling the thickness and/or formation of a finishing aid film is preferred. Controlling the thickness and/or formation of a finishing aid film and/or lubricating film by changing at least one lubrication control parameter in a manner that changes the coefficient of friction in at least two different regions in the operative finishing interface in response to an in situ control signal is preferred. Controlling the thickness of the lubricating film by changing at least two process control parameters in situ based on feed back information from a lubrication control subsystem having a friction sensor is also preferred. Controlling at least once the thickness of the lubricating film which changes the coefficient of friction in the operative finishing interface by changing at least one process control parameter in situ based on feed back information from a control subsystem during the finishing cycle time is preferred. A semiconductor wafer surface having at least a first region wherein the lubricating film is at most one half the molecular layer thickness compared to the lubricating film thickness on a second, different region is preferred and a semiconductor wafer surface having at least a first region wherein the lubricating film thickness is at most one third the molecular layer thickness compared to the lubricating film on a second, different region is more preferred when controlling the coefficient of friction, particularly when controlling the changes in the coefficient of friction. Controlling the thickness of the lubricating film by changing at least one process control parameter in situ based on feed back information from a control subsystem during the finishing cycle time and wherein the control subsystem tracks and updates the feed back information for finishing a plurality of the metal layers is even more preferred for semiconductor wafers having multiple functional levels. An organic lubricating film is preferred.

A multiplicity of operative process sensors which includes a plurality of operative friction sensors is preferred and which includes at least three operative friction sensors is more preferred and which includes at least four operative friction sensors is even more preferred and which includes at least five operative friction sensors is even more particularly preferred. Comparing the in situ process information obtained from a plurality of the operative friction sensors is a preferred and comparing the in situ process information obtained from at least three of the operative friction sensors is more preferred and comparing the in situ process information obtained from at least four of the operative friction sensors is even more preferred and comparing the in situ process information obtained from at least five of the operative friction sensors is even more particularly preferred. By having multiple operative friction sensor information compared, preferably with mathematical expressions, algorithms, memory look-up tables and/or with data bases, differential localized lubrication such as on uniform regions in the operative finishing interface can better be detected, quantified, and controlled by controlling the finishing control parameters in real time. Preferred control of the finishing control parameters can reduce unwanted surface defects and increase manufacturing yields.

Changing at least one lubricating boundary layer control parameter during the finishing cycle time in order to change the lubricating boundary layer in a manner that changes the tangential force of friction in at least one region of the semiconductor wafer surface in the operative finishing interface is preferred. Changing at least one of the lubricating boundary layer control parameters which is in response to an in situ control signal is also preferred. Changing at least one lubricating boundary layer control parameter during the finishing cycle time changing the lubricating boundary layer in a manner that changes the tangential force of friction in at least two different regions of the semiconductor wafer surface in the operative finishing interface is more preferred. Changing of at least one lubricating layer control parameter in a manner that changes the lubricating boundary layers in at least two of different regions of the semiconductor wafer in response to an in situ control signal is also more preferred. Using a secondary friction sensor signals to aid in changing the lubricating boundary layer control parameters is even more preferred.

Applying higher pressure in the unwanted raised region on the semiconductor wafer surface compared to pressure applied to the region below the unwanted raised region causing the boundary layer lubrication thickness to be less on the unwanted raised region and the boundary lubrication thickness to be greater on at least portion of the semiconductor wafer surface below the raised region is a preferred method for differential finishing rates. Applying higher pressure in the unwanted raised region on the semiconductor wafer surface compared to pressure applied to the region below the unwanted raised region causing the boundary layer lubrication thickness to be less on the unwanted raised region and a higher temperature on the unwanted raised region and the boundary lubrication thickness to be greater on at least portion of the semiconductor wafer surface below the raised region and a lower temperature is more preferred method for differential finishing rates.

Supplying a lubricant to the workpiece surface being finished which changes the rate of a chemical reaction is preferred. Supplying a lubricant to the workpiece surface being finished having a property selected from the group consisting of workpiece surface coefficient of friction, workpiece finish rate change, a heterogeneous workpiece surface having differential coefficient of friction, and a heterogeneous workpiece surface having differential finishing rate change which reduces unwanted damage to the workpiece surface is particularly preferred. Supplying a lubricant to the workpiece surface being finished having a property selected from the group consisting of lubricant type, lubricant concentration, lubricant feed rate, lubricant effectiveness, and lubricant time period.

Using the method of this invention to finish a workpiece, especially a semiconductor wafer, by polishing for a period of time at a finishing rate and finishing uniformity according to a controllable set of at least one operational parameter that upon variation change the polishing rate and/or polishing uniformity and wherein the operational parameters are selected from the group consisting of the lubricant type, lubricant concentration, lubricant activity, and lubricating time period is preferred. Using the method of this invention to finish a workpiece, especially a semiconductor wafer, by finishing for a period of time wherein an electronic control subsystem connected electrically to the lubricant control mechanism to adjust in situ at least one operational parameter that affect the finishing rate and/or the finishing uniformity and wherein the operational parameters are selected from the group consisting of the lubricant type, lubricant concentration, lubricant activity, and lubricating time period change at the workpiece surface being finished is preferred. The electronic control subsystem is operatively connected electrically to the lubrication control mechanism. A preferred method to measure finishing rate is to measure the change in the amount of material removed in angstroms per unit time in minutes (.ANG./min). Guidance on the measurement and calculation for polishing rate for semiconductor part is found in U.S. Pat. No. 5,695,601 to Kodera et. al. issued in 1997 and is included herein in its entirety for illustrative guidance.

An average finishing rate range is preferred, particularly for workpieces requiring very high precision finishing such as in process electronic wafers. Average cut rate is used as a preferred metric to describe preferred finishing rates. Average cut rate is metric generally known to those skilled in the art. For electronic workpieces, such as wafers, a cut rate of from 100 to 25,000 Angstroms per minute on at least a portion of the workpiece is preferred and a cut rate of from 200 to 15,000 Angstroms per minute on at least a portion of the workpiece is more preferred and a cut rate of from 500 to 10,000 Angstroms per minute on at least a portion of the workpiece is even more preferred and a cut rate of from 500 to 7,000 Angstroms per minute on at least a portion of the workpiece is even more particularly preferred and a cut rate of from 1,000 to 5,000 Angstroms per minute on at least a portion of the workpiece is most preferred.

Using finishing of this invention to remove raised surface perturbations and/or surface imperfections on the workpiece surface being finished is preferred. Using the method of this invention to finish a workpiece, especially a semiconductor wafer, at a planarizing rate and/or planarizing uniformity according to a controllable set of operational parameters that upon variation change the planarizing rate and/or planarizing uniformity and wherein the operational parameters of at least two operational parameters are selected from the group consisting of the type of lubricant, quantity of lubricant, and time period lubrication is preferred. Using the method of this invention to polish a workpiece, especially a semiconductor wafer, wherein an electronic control subsystem connected electrically to an operative lubrication feed mechanism adjusts in situ the subset of operational parameters that affect the planarizing rate and/or the planarizing uniformity and wherein the operational parameters are selected from the group consisting of the type of lubricant, quantity of lubricant, and time period lubrication is preferred. The electronic control subsystem is operatively connected electrically to the operative lubrication feed mechanism.

Applying an operative finishing motion in the operative finishing interface forming an organic lubricating layer such that a tangential friction force is created in the operative finishing interface which is dependent on lubricant properties other than lubricant viscosity is preferred. Applying an operative finishing motion in the operative finishing interface forming an organic lubricating layer such that a tangential friction force is created in the operative finishing interface which depends on lubricant properties other than lubricant viscosity is preferred. Applying an operative finishing motion in the operative finishing interface forming a differential organic lubricating layer such that a plurality of different tangential friction forces are created in different regions of the operative finishing interface and wherein the plurality of the different tangential friction forces are dependent on lubricant properties other than lubricant viscosity is more preferred. Applying the greater tangential friction force in the unwanted raised region of the semiconductor wafer surface being finished and also applying the lower tangential friction force to a region below and proximate to the unwanted raised region of the semiconductor wafer surface being finished is also more preferred. By creating this type of lubricating layer, finishing of the semiconductor wafer can be accomplished with good finishing rates and reduced unwanted surface defects. Planarization can be improved. Within die nonuniformity can be improved.

Using the method of this invention to polish or planarize a workpiece, especially a semiconductor wafer, supplying lubrication moderated by a finishing element having at least two layers is preferred. More preferably the finishing element having at least two layers has a finishing surface layer which has a higher hardness than the subsurface layer. A finishing element having at least two layers has a finishing surface layer which has a lower hardness than the subsurface layer is preferred, particularly for polishing. By having layers in the finishing element, additional control of the polishing and planarizing can be had. Harder layers reduce the tendency of the finishing element to follow the precise contours of the surface defects in a workpiece being finished and, especially planarized. Preferably the finishing element having at least two layers has a polishing surface layer which has a higher tensile strength than the subsurface layer. More preferably the finishing element having at least two layers has a polishing surface layer which has a lower tensile strength than the subsurface layer. By optimizing tensile strength of the layers of the finishing element, the amount of material in the finishing element can generally be reduced and longevity increased.

Changing the lubrication control parameters at least once during workpiece finishing is preferred and changing the lubrication control parameters at least twice during workpiece finishing is more preferred. Changing the lubrication control parameters in steps is preferred. Changing the lubrication control parameters based on feedback information is preferred and changing the lubrication control parameters in situ based on feed back information with an lubrication control subsystem is more preferred. Changing the lubrication control parameters such as concentration and time period (or some combination thereof) can improve the quality of the final finishing step. Supplying a plurality of lubricants during finishing can be preferred for some applications. Depending on the application and the particular surface at the moment being finished, the plurality of lubricants can be supplied simultaneously or sequentially. For instance, one can supply a planarizing lubricant and then later a polishing lubricant. A lubrication control parameter is a parameter which affects the lubrication of the operative finishing interface. A boundary lubrication control parameter is a parameter which affects the boundary lubrication in the operative finishing interface. A parameter selected from the group consisting of the lubricant chemistry, lubricant concentration, lubricant feed rate, operative finishing interface temperature, operative finishing interface pressure, and operative finishing interface motion is a preferred group of lubricating boundary layer control parameter. A parameter selected from the group consisting of the local lubricant chemistry, local lubricant concentration, local lubricant feed rate, local operative finishing interface temperature, local operative finishing interface pressure, and local operative finishing interface motion is a preferred group of local lubricating boundary layer control parameters. A local operative finishing interface pressure and local lubricating boundary layer is the local pressure and lubrication as illustrated and described in FIGS. 4 and 5 herein.

Supplying an organic lubricant for a portion of finishing cycle time is preferred. Supplying an organic lubricant for a secondary finishing step after a first finishing step free of lubricant can be preferred. Using two finishing steps, one with lubricant and one free of lubricant can reduce unwanted surface damage when finishing a semiconductor wafer. Using two finishing steps can also increase the finishing rate.

Providing a separate water borne lubricant and a separate slurry proximate to workpiece heterogeneous workpiece surface being finished for use between the finishing element surface and the workpiece being finished is a preferred step in the method. Providing an effective amount of a lubricant between the finishing element surface and the workpiece being finished for at least a portion of the finishing time in order to reduce the coefficient of friction between the finishing element surface and the workpiece being finished and providing a separate finishing composition between the finishing element finishing surface and the workpiece being finished for at least a portion of the finishing time is also preferred. Separate and distinct feed lines and reservoirs for the finishing composition and the alternate finishing composition and each separate system delivers their product near or proximate to the point of use are preferred.

A preferred embodiment of this invention is directed to a method of finishing a semiconductor wafer surface having a uniform region and a finishing cycle time comprising a step 1) of providing a tracked semiconductor having tracked information; a step 2) of providing a finishing element finishing surface; a step 3) of providing an organic lubricant to the operative finishing interface comprising the interface formed between the finishing element finishing surface and the semiconductor wafer surface being finished; a step 4) of providing a finishing control subsystem having at least three operative process sensors which include at least two operative friction sensors for sensing in situ process information, access to the tracked information, and a processor to evaluate the in situ process information and tracked information; a step 5) of applying an operative finishing motion in the operative finishing interface forming in the operative finishing interface a uniform region having the organic lubrication and wherein the uniform region has a coefficient of friction; and a step 6) of changing a plurality of control parameters in response to an evaluation of both the in situ process information and the tracked information, wherein changing the control parameters changes the coefficient of friction in the uniform region having organic lubrication during at least a portion of the finishing cycle time.

A preferred embodiment of this invention is directed to a method of finishing a semiconductor wafer surface having a uniform region and a finishing cycle time comprising a step 1) of providing a tracked semiconductor having tracked information; a step 2) of providing a finishing element finishing surface; a step 3) of providing an organic lubricant to the operative finishing interface comprising the interface formed between the finishing element finishing surface and the semiconductor wafer surface being finished; a step 4) of providing a finishing control subsystem having at least three operative process sensors for sensing in situ process information, access to the tracked information, and a processor to evaluate the in situ process information and tracked information; a step 6) of applying an operative finishing motion in the operative finishing interface forming a first uniform region having a first organic lubrication and a second uniform region having a second organic lubrication in the operative finishing interface and wherein the first and the second uniform regions have different coefficients of friction; and a step 7) of changing a plurality of control parameters in response to an evaluation of both the in situ process information and the tracked information, wherein changing the control parameters changes the coefficient of friction in at least one uniform region during at least a portion of the finishing cycle time.

A preferred embodiment of this invention is directed to a method of finishing a semiconductor wafer surface having a uniform region and a finishing cycle time comprising a step 1) of providing a tracked semiconductor having tracked information; a step 2) of providing a finishing element finishing surface; a step 3) of providing an organic lubricant to the operative finishing interface comprising the interface formed between the finishing element finishing surface and the semiconductor wafer surface being finished; a step 4) of providing a finishing control subsystem having at least three operative process sensors for sensing in situ process information, access to the tracked information, and a processor to evaluate the in situ process information and tracked information; a step 5) of applying an operative finishing motion in the operative finishing interface forming a first uniform region having a first organic lubrication and a second uniform region having a second organic lubrication in the operative finishing interface and wherein the first and the second uniform regions have different coefficients of friction; a step 6) of evaluating both the in situ process information and the tracked information; and a step 7) of changing a plurality of control parameters at least 4 times to change the coefficient of friction in at least one the uniform regions at least 4 times during the finishing cycle time.

A preferred embodiment of this invention is directed to a method of finishing a semiconductor wafer surface having a uniform region and a finishing cycle time comprising a step of 1) of providing a tracked semiconductor having tracked information; a step 2) of providing a finishing element finishing surface; a step 3) of providing a reactive lubricant to the operative finishing interface comprising the interface formed between the finishing element finishing surface and the semiconductor wafer surface being finished; a step 3) of providing a finishing control subsystem having at least three operative process sensors for sensing in situ process information, access to the tracked information, and a processor to evaluate the in situ process information and tracked information; a step 4) of applying an operative finishing motion in the operative finishing interface forming a uniform region having reactive lubrication having a coefficient of friction; a step 5) of evaluating both the in situ process information and the tracked information; and a step 6) of changing a plurality of control parameters at least 10 times to change the coefficient of friction in at least one uniform region having reactive lubrication at least 4 times during the finishing cycle time.

A preferred embodiment of this invention is directed to a method of finishing a semiconductor wafer surface having a uniform region and a finishing cycle time comprising a step 1) of providing a tracked semiconductor having tracked information; a step 2) of providing a finishing element finishing surface; a step 3) of providing a finishing aid to the operative finishing interface comprising the interface formed between the finishing element finishing surface and the semiconductor wafer surface being finished; a step 4) of providing a finishing control subsystem having at least three operative process sensors for sensing in situ process information, access to the tracked information, and a processor to evaluate the in situ process information and tracked information; a step 5) of applying an operative finishing motion in the operative finishing interface forming a uniform region having the finishing aid with a coefficient of friction; a step 6) of evaluating both the in situ process information and the tracked information; and a step 7) of changing with the finishing control subsystem a plurality of control parameters to change finishing at least 4 times during at least a portion of the finishing cycle time.

A preferred embodiment of this invention is directed to a method of finishing a semiconductor wafer surface having a uniform region and a finishing cycle time comprising a step 1) of providing a tracked semiconductor having tracked information; a step 2) providing a finishing element finishing surface; a step 3) of providing an organic lubricant to the operative finishing interface comprising the interface formed between the finishing element finishing surface and the semiconductor wafer surface being finished; a step 4) of providing a finishing control subsystem having at least five operative process sensors for sensing in situ process information, access to the tracked information, and a processor to evaluate the in situ process information and tracked information; a step 4) of applying an operative finishing motion in the operative finishing interface forming a uniform region in the operative finishing interface having the organic lubrication and wherein the uniform region has a coefficient of friction; and a step 5) of evaluating both the in situ process information and the tracked information; and a step 6) of changing a plurality of control parameters at least 10 times to change the coefficient of friction in at least the uniform region having the organic lubrication at least 4 times during the finishing cycle time.

A preferred embodiment of this invention is directed to a method of finishing of a semiconductor wafer surface being finished comprising the step of providing a fixed abrasive finishing element finishing surface; the step of providing an organic lubricant to an operative finishing interface; and the step of applying an operative finishing motion to the operative finishing interface in a manner that forms a lubricating boundary layer of from 1 to 6 molecules thick in the operative finishing interface.

A preferred embodiment of this invention is directed to method of finishing a tracked semiconductor wafer having a semiconductor wafer surface and a finishing cycle time, the method comprising a step 1) of providing the tracked semiconductor wafer having tracked information; a step 2) of providing a finishing surface; a step 3) of providing a finishing aid to an interface formed between the finishing surface and the semiconductor wafer surface; a step 4) of providing a finishing control subsystem having at least three operative process sensors for sensing in situ process information during the finishing cycle time; access to the tracked information; and a processor to evaluate the in situ process information and the tracked information; a step 5) of applying an operative finishing motion in the interface forming at least one region having the finishing aid and wherein the at least one region has a tangential force of friction; and a step 6) of changing a plurality of control parameters in response to an evaluation of both the in situ process information sensed with the at least three operative process sensors and the tracked information and wherein changing the control parameters changes the tangential force of friction in the at least one region having the finishing aid during at least a portion of the finishing cycle time.

During a finishing cycle time providing a finishing composition which is substantially free of abrasive particles is preferred and free of abrasive particles is more preferred. During a finishing cycle time providing a finishing composition which chemically reacts preferentially with a portion of and/or a region the semiconductor wafer surface is preferred. During a finishing cycle time providing a finishing composition which is free of abrasive particles and wherein applying the operative finishing motion comprises applying an operative finishing motion between the finishing element finishing surface and the semiconductor wafer surface and induces tribochemical reactions on the semiconductor wafer surface is more preferred. A tracked information which includes tracked information for future manufacturing steps of the semiconductor wafer is preferred for process control. A tracked information which includes tracked information for for prior and future manufacturing steps of the semiconductor wafer is preferred for process control. A tracked information which includes feedback information is preferred. Tracked information which includes feedforward information is preferred. Tracked information which includes both feedback and feedforward information is more preferred for process control.

The use of finishing aids is generally known to those skill in the workpiece finishing arts. Illustrative nonlimiting background information can be found in U.S. Pat. No. 6,267,644 to Molnar, U.S. Pat. No. 6,283,829 to Molnar, U.S. Pat. No. 6,291,349 to Molnar, U.S. Pat. No. 6,293,851 to Molnar, U.S. Pat. No. 6,346,202 to Molnar, U.S. Pat. No. 6,390,890 to Molnar, U.S. Pat. No. 6,413,153 to Molnar, U.S. Pat. No. 6,428,388 to Molnar, U.S. Pat. No. 6,435,948 to Molnar, U.S. Pat. No. 6,641,463 to Molnar, U.S. Pat. No. 6,551,933 to Molnar, U.S. Pat. No. 6,568,989 to Molnar, U.S. Pat. No. 6,634,927 to Molnar, U.S. Pat. No. 6,641,463 to Molnar, and U.S. Pat. No. 6,656,023 to Molnar and they are included by reference in their entirety for all purposes and for all reasons and for general guidance and appropriate modification by those skilled in the arts.

Summary

Particularly preferred embodiments are summarized herein as for example in the brief summary of the invention. FIGS. 10–13 show some particularly preferred embodiments. As is generally known in the semiconductor wafer art, development of actual preferred embodiments is generally accomplished in stages along with numerous process and design specific information. For example, dielectric layer composition, conductor layer composition, and feature sizes can change the precise optimum finishing control parameters and/or refining method. Given the teachings and guidance contained herein, preferred embodiments are generally implemented in stages with various workpiece manufacturers while taking into account numerous business, process, and product specific information by those generally skilled in the semiconductor wafer arts. Although the implementation of a preferred embodiment may have generally numerous steps while taking into account the numerous business, process, and product specific information, implementation merely requires routine experimentation and effort given the teachings and guidance contained herein. Thus although the implementation may be somewhat time-consuming, it is nevertheless a generally routine undertaking for those of ordinary skill in the art having the benefit of the information and guidance contained herein. In some discussion herein, generally known information, processes, procedures, and apparatus have not been belabored so as not to obscure preferred embodiments of the present invention.

Illustrative non-limiting examples of useful technology have been referenced by their patents numbers and all of these patents are included herein by reference in their entirety for all purposes and for further general guidance and modification by those skilled in the arts. The scope of the invention should be determined by the appended claims and their legal equivalents, rather than by the preferred embodiments and non-limiting illustrative detail is discussed herein.

I claim:

1. A method of finishing a tracked semiconductor wafer having a semiconductor wafer surface and a finishing cycle time, the method comprising the steps of:

providing the tracked semiconductor wafer having tracked information;

providing a finishing surface;

providing a finishing aid to an interface formed between the finishing surface and the semiconductor wafer surface;

providing a finishing control subsystem having:

at least three operative process sensors for sensing in situ process information during the finishing cycle time;

access to the tracked information; and a processor to evaluate the in situ process information and the tracked information;

applying an operative finishing motion in the interface forming at least one region having the finishing aid and wherein the at least one region has a tangential force of friction; and changing a plurality of control parameters in response to an evaluation of both the in situ process information sensed with the at least three operative process sensors and the tracked information and wherein changing the control parameters changes the tangential force of friction in the at least one region having the finishing aid during at least a portion of the finishing cycle time.

2. The method of finishing according to claim 1 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

3. The method of finishing according to claim 2 wherein the semiconductor wafer has at least 3 metal layers.

4. A processor-readable, program storage device encoded with instructions that, when executed by a processor, performs the method of claim 3.

5. The method of finishing according to claim 1 wherein:

the finishing aid comprises the finishing aid which at least in part reduces friction; and the semiconductor wafer comprises a semiconductor wafer having at least three metal layers.

6. The method of finishing according to claim 1 wherein the finishing aid comprises a finishing aid having a property selected from the group consisting of changing the coefficient of friction, changing average cut rate, and changing the cut rate of a specific material in the semiconductor wafer surface.

7. The method of finishing according to claim 1 wherein the finishing aid comprises a finishing aid comprising an organic lubricant.

8. The method of finishing according to claim 1 wherein the finishing aid comprises an organic lubricating film which adheres to the semiconductor wafer surface.

9. The method of finishing according to claim 1 wherein the finishing aid comprises an organic lubricating film which interacts with and adheres to the semiconductor wafer surface.

10. The method of finishing according to claim 1 wherein:

the semiconductor wafer has at least one uniform region on the semiconductor wafer surface; and the finishing aid comprises an organic lubricating film which interacts with the uniform region of the semiconductor wafer surface.

11. The method of finishing according to claim 1 wherein:

the semiconductor wafer has at least one uniform region on the semiconductor wafer surface; and the finishing aid comprises an organic lubricating film which interacts with and adheres to the uniform region of the semiconductor wafer surface.

12. A method of finishing a tracked semiconductor wafer having a semiconductor wafer surface and a finishing cycle time, the method comprising the steps of:

providing the tracked semiconductor wafer having tracked information;

providing a finishing surface;

providing a finishing aid to an interface formed between the finishing surface and the semiconductor wafer surface;

providing a finishing control subsystem having:

at least three operative process sensors for sensing in situ process information during the finishing cycle time;

access to the tracked information; and a processor to evaluate the in situ process information and the tracked information;

applying an operative finishing motion in the interface formed between the finishing surface and the semiconductor wafer surface forming at least one region having the finishing aid which reacts with the semiconductor wafer surface and wherein the at least one region has a tangential force of friction; and changing a plurality of control parameters in response to an evaluation of both the in situ process information sensed with the at least three operative process sensors and the tracked information and wherein changing the control parameters changes the tangential force of friction in the at least one region having the finishing aid which reacts with the semiconductor wafer surface during at least a portion of the finishing cycle time.

13. The method of finishing according to claim 12 wherein the finishing aid comprises the finishing aid selected from the group consisting of a lubricating aid and a chemically reactive aid.

14. The method of finishing according to claim 13 wherein the semiconductor wafer has at least 3 metal layers.

15. A processor-readable, program storage device encoded with instructions that, when executed by a processor, performs the method of claim 14.

16. A process controller at least in part controlled by a processor having access to a processor readable medium with processor readable instructions for performing the method of claim 14.

17. The method of finishing according to claim 14 wherein:

the finishing aid comprises the finishing aid which at least in part reduces friction; and the semiconductor wafer comprises a semiconductor wafer having at least three metal layers.

18. The method of finishing according to claim 17 wherein the semiconductor wafer has at least 3 metal layers.

19. A method for finishing a semiconductor wafer having tracked information, the method comprising:

a step (A) providing a semiconductor wafer having a heterogeneous semiconductor wafer surface comprising at least a first uniform region and a second uniform region;

a step (B) providing a finishing surface;

a step (C) providing a finishing aid proximate the semiconductor wafer;

a step (D) providing at least one finishing control subsystem having at least three operative process sensors, at least one processor, and a controller and wherein the at least one processor for processing:

(i) the tracked information, and (ii) historical performance including a quantity of historical performance of prior semiconductor wafers;

a step (E) applying an operative finishing motion to an interface between the heterogeneous semiconductor wafer surface and the finishing surface and wherein the interface includes at least one uniform region having the finishing aid;

a step (F) sensing an in situ finishing information with the at least three operative process sensors during a finishing cycle time;

a step (G) evaluating a multiplicity of finishing information, and each having varying effects on the finishing with the finishing aid;

a step (H) determining a change for at least two process control parameters using:

(i) the tracked information, (ii) the historical performance including the quantity of historical performance of prior semiconductor wafers, (iii) the in situ finishing information, and (iv) the step (G) of evaluating the multiplicity of finishing information; and a step (I) changing the at least two control parameters changes the tangential force of friction in the at least one uniform region having the finishing aid during at least a portion of the finishing cycle time.

20. The method of finishing according to claim 19 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

21. The method of finishing according to claim 19 wherein the finishing aid comprises the finishing aid selected from the group consisting of a lubricating aid and a chemically reactive aid.

22. The method of finishing according to claim 21 wherein the semiconductor wafer has at least 3 metal layers.

23. The method of finishing according to claim 22 wherein the step (H) of determining a change comprises using a mathematical expression.

24. The method of finishing according to claim 22 wherein the step (H) of determining a change comprises using neural networks.

25. A processor-readable, program storage device encoded with instructions that, when executed by a processor, performs the method of claim 22.

26. A process controller at least in part controlled by a processor having access to a processor readable medium with processor readable instructions for performing the method of claim 22.

27. The method of finishing according to claim 19 wherein the finishing surface comprises the finishing surface of a finishing element and the finishing element includes the finishing aid.

28. The method of finishing according to claim 19 wherein:

the finishing aid comprises the finishing aid which at least in part reduces friction; and the semiconductor wafer has at least three metal layers.

29. The method of finishing according to claim 19 wherein the finishing aid comprises a finishing aid having a property selected from the group consisting of changing the coefficient of friction, changing average cut rate, and changing the cut rate of a specific material in the semiconductor wafer surface.

30. The method of finishing according to claim 19 wherein the finishing aid comprises an organic lubricant.

31. The method of finishing according to claim 19 wherein the finishing aid comprises an organic lubricating film which adheres to the semiconductor wafer surface.

32. The method of finishing according to claim 19 wherein the finishing aid comprises an organic lubricating film which interacts with and adheres to the semiconductor wafer surface.

33. The method of finishing according to claim 19 wherein the finishing aid comprises an organic lubricating film which interacts with the first uniform region.

34. The method of finishing according to claim 33 wherein the semiconductor wafer comprises a semiconductor wafer having a diameter of at least 300 millimeters.

35. The method of finishing according to claim 19 wherein the finishing aid comprises an organic lubricating film which interacts with and adheres to the first uniform region.

36. The method of finishing according to claim 35 wherein the semiconductor wafer comprises the semiconductor wafer having a diameter of at least 300 millimeters.

37. A method of finishing a tracked semiconductor wafer having a semiconductor wafer surface and a finishing cycle time, the method comprising the steps of:

providing the tracked semiconductor wafer having tracked information;

providing a finishing surface;

providing a finishing aid to an interface formed between the finishing surface and the semiconductor wafer surface having a first uniform region and a second uniform region;

providing a finishing control subsystem having:

at least three operative process sensors for sensing in situ process information during the finishing cycle time;

access to the tracked information; and a processor to evaluate the in situ process information and the tracked information;

applying an operative finishing motion in the interface forming a first uniform region having the finishing aid and wherein the first and the second uniform regions have different finishing rates measured in angstroms per minute; and changing a plurality of control parameters in response to an evaluation of both the in situ process information sensed with the at least three operative process sensors and the tracked information and wherein changing the control parameters changes the a finishing rate measured in angstroms per minute in at least one uniform region during at least a portion of the finishing cycle time.

38. The method of finishing according to claim 37 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

39. The method of finishing according to claim 38 wherein the evaluation comprises using an algorithm and memory look-up tables to evaluate the in situ process information and the tracked information.

40. The method of finishing according to claim 37 wherein the finishing aid comprises the finishing aid selected from the group consisting of a lubricating aid and a chemically reactive aid.

41. The method of finishing according to claim 40 wherein the evaluation comprises using an algorithm and memory look-up tables to evaluate the in situ process information and the tracked information.

42. The method of finishing according to claim 40 wherein the evaluation comprises using a neural network and memory look-up tables to evaluate the in situ process information and the tracked information.

43. The method of finishing according to claim 37 wherein the evaluation comprises using an algorithm, a model, a historical performance including a quantity of tracked historical performance, and memory look-up tables to evaluate the in situ process information and the tracked information.

44. A processor-readable, program storage device encoded with instructions that, when executed by a processor, performs the method of claim 43.

45. The method of finishing according to claim 37 wherein the semiconductor wafer has a diameter of at least 300 millimeters.

46. The method of finishing according to claim 37 wherein the finishing aid comprises the finishing aid which at least in part reduces friction.

47. The method of finishing according to claim 37 wherein:

the finishing aid comprises the finishing aid which at least in part reduces friction; and the semiconductor wafer has at least three metal layers.

48. The method of finishing according to claim 37 wherein the finishing aid comprises a finishing aid having a property selected from the group consisting of changing the coefficient of friction, changing average cut rate, and changing the cut rate of a specific material in the semiconductor wafer surface.

49. The method of finishing according to claim 37 wherein the finishing aid comprises an organic lubricant.

50. The method of finishing according to claim 37 wherein the finishing aid comprises an organic lubricating film which adheres to the semiconductor wafer surface.

51. The method of finishing according to claim 37 wherein the finishing aid comprises an organic lubricating film which interacts with and adheres to the semiconductor wafer surface.

52. The method of finishing according to claim 37 wherein the finishing aid comprises an organic lubricating film which interacts with the first uniform region.

53. The method of finishing according to claim 52 wherein the semiconductor wafer has a diameter of at least 300 millimeters.

54. The method of finishing according to claim 37 wherein the finishing aid comprises an organic lubricating film which interacts with and adheres to the first uniform region.

55. The method of finishing according to claim 52 wherein the semiconductor wafer has a diameter of at least 300 millimeters.

56. A method of finishing a tracked semiconductor wafer having a semiconductor wafer surface and a finishing cycle time, the method comprising the steps of:

providing the tracked semiconductor wafer having tracked information;

providing a finishing surface;

providing a finishing aid to an interface formed between the finishing surface and the semiconductor wafer surface;

providing a finishing control subsystem having:

at least three operative process sensors for sensing in situ process information during the finishing cycle time;

access to the tracked information; and a processor to evaluate the in situ process information and the tracked information;

applying an operative finishing motion in a finishing interface having a first region and a second region and wherein at least the first uniform region has a finishing aid and wherein the first and the second regions have different finishing rates measured in angstroms per minute;

evaluating both the in situ process information sensed with the at least three operative process sensors and the tracked information; and changing a plurality of control parameters to change the finishing rate measured in angstroms per minute in at least one of the regions during the finishing cycle time.

57. The method of finishing according to claim 56 wherein:

changing the plurality of control parameters comprises using an algorithm to evaluate the in situ process information having a multiplicity of data and the tracked information having a multiplicity of data types; and wherein the plurality of control parameters are changed at least ten times during the finishing cycle time.

58. The method of finishing according to claim 57 wherein the semiconductor wafer has a diameter of at least 300 millimeters.

59. A method of finishing a tracked semiconductor wafer having a semiconductor wafer surface and a finishing cycle time, the method comprising the steps of:

providing the tracked semiconductor wafer having tracked information;

providing a finishing surface;

providing a finishing aid to an interface formed between the finishing surface and the semiconductor wafer surface;

providing a finishing control subsystem having:

at least five operative process sensors for sensing in situ process information during the finishing cycle time;

access to the tracked information; and a processor to evaluate the in situ process information and the tracked information;

applying an finishing motion in the interface forming at least one uniform region having the finishing aid and a differential finishing rate measured in angstroms per minute on the semiconductor wafer surface;

evaluating both the in situ process information sensed with the at least five operative process sensors and the tracked information; and changing a plurality of control parameters to change the differential finishing rate measured in angstroms per minute on the semiconductor wafer surface during the finishing cycle time.

60. A process controller at least in part controlled by a processor having a processor readable medium with processor readable instructions for performing the method of claim 59.

61. A method for finishing a semiconductor wafer having at least one uniform region and having tracked information, the method comprising:

a step (A) providing a semiconductor wafer;

a step (B) providing a finishing surface;

a step (C) providing a finishing aid proximate the semiconductor wafer and wherein the finishing aid comprises a reactive finishing aid which reacts with at least portion of the semiconductor wafer surface changing the finishing rate in angstroms per minute when compared to the finishing rate under identical finishing conditions but in the absence of the reactive finishing aid;

a step (D) providing at least one finishing control subsystem having at least three operative process sensors, at least one processor, and a controller and wherein the at least one processor for processing:

(i) tracked information, and (ii) historical performance;

a step (E) applying an operative finishing motion to an interface between the semiconductor wafer and the finishing surface and wherein the interface includes the finishing aid;

a step (F) sensing an in situ finishing information with the at least three operative process sensors during a finishing cycle time;

a step (G) evaluating a multiplicity of finishing information, and each having varying effects on the finishing with the finishing aid;

a step (H) determining a change for at least two process control parameters using:

(i) tracked information, (ii) historical performance, (iii) the in situ finishing information, and (iv) the step (G) of evaluating the multiplicity of finishing information; and a step (I) changing the at least two control parameters changes the finishing rate measured in angstroms per minute in the at least portion of the semiconductor wafer during the finishing cycle time.

62. The method of finishing according to claim 61 wherein the reactive finishing aid comprises the reactive finishing aid selected from the group consisting of a lubricating aid and a chemically reactive aid.

63. The method according to claim 62 wherein the tracked information comprises individually tracked information belonging to the semiconductor wafer.

64. The method according to claim 62 wherein the tracked information comprises a batch tracked information belonging to a batch of semiconductor wafers and including the semiconductor wafer.

65. The method according to claim 62 wherein the tracked information comprises an individually tracked information belonging to the semiconductor wafer and the batch of tracked information belonging to a batch of semiconductor wafers including the semiconductor wafer.

66. A process controller having access to a manufactured article having a processor readable medium with processor readable instructions for performing the methods of claim 65.

67. An apparatus for planarizing a workpiece having a process controller, the process controller having access to a manufactured article having a computer readable medium with computer readable instructions for performing the method of claim 65.

68. A processor-readable, program storage device encoded with instructions that, when executed by a processor, performs the method of claim 65.

69. The method according to claim 61 comprising further steps:

a step (J) storing at a least a portion of the information in the step (H) forming a family of stored information;

a step (K) using the family of stored information to determine a change for at least one particular member of the family of stored information; and a step (L) changing the at least one particular member of the family of stored information.

70. The method according to claim 61 comprising further steps:

a step (J) storing at a least a portion of the information in the step (H) forming a family of stored information;

a step (K) using the family of stored information to determine a change for at least one particular member of the family of stored information;

a step (L) changing the at least one particular member in the family of stored information forming a changed family of stored information; and a step (M) using the changed family of stored information.

71. A process controller having access to a manufactured article having a processor readable medium with processor readable instructions for performing the method of claim 70.

72. A processor-readable, program storage device encoded with instructions that, when executed by a processor, performs the method of claim 70.

73. The method according to claim 61 comprising further steps:

a step (J) storing at a least a portion of the information in the step (H) forming a family of stored information;

a step (K) using the family of stored information to determine a change for at least one particular member of the family of stored information with data mining;

a step (L) changing the at least one particular member in the family of stored information forming a changed family of stored information; and a step (M) using the changed family of stored information.

74. The method of finishing according to claim 73 wherein the finishing aid comprises the finishing aid which at least in part reduces friction.

75. The method according to claim 74 comprising further steps:

a step (J) storing at a least a portion of the information in the step (H) forming a family of stored information;

a step (K) using the family of stored information to determine a change for at least one particular member of the family of stored information with data mining;

a step (L) changing the at least one particular member in the family of stored information forming a changed family of stored information; and a step (M) using the changed family of stored information.

76. A method for finishing a semiconductor wafer having tracked information, the method comprising:

a step (A) providing a semiconductor wafer;

a step (B) providing a finishing surface;

a step (C) providing a finishing aid proximate the semiconductor wafer and wherein the finishing aid differentially reacts with heterogeneous regions of a semiconductor wafer surface being finished;

a step (D) providing at least one finishing control subsystem having at least three operative process sensors, at least one processor, and a controller and wherein the at least one processor for processing:

(i) the tracked information, and (ii) historical performance including a quantity of historical performance of prior semiconductor wafers;

a step (E) applying an operative finishing motion to an interface between the semiconductor wafer and the finishing surface and wherein the interface includes the finishing aid;

a step (F) sensing an in situ finishing information with the at least three operative process sensors during a finishing cycle time;

a step (G) evaluating a multiplicity of finishing information, and each having varying effects on the finishing with the finishing aid;

a step (H) determining a change for at least two process control parameters using:

(i) the tracked information, (ii) the historical performance including the quantity of historical performance of prior semiconductor wafers, (iii) the in situ finishing information, and (iv) the step (G) of evaluating the multiplicity of finishing information; and a step (I) changing the at least two of control parameters to change a finishing rate measured in angstroms per minute on at least one region of semiconductor wafer surface during the finishing cycle time.

77. The method of finishing according to claim 76 wherein the finishing aid comprises the finishing aid selected from the group consisting of a lubricating aid and a chemically reactive aid.

78. The method of finishing according to claim 76 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

79. The method according to claim 76 wherein the multiplicity of finishing information includes at least in part finishing rate information measured in angstroms per minute.

80. The method according to claim 76 wherein the multiplicity of finishing information includes at least in part surface defect information on the semiconductor wafer.

81. The method according to claim 76 wherein the multiplicity of finishing information includes at least in part both finishing rate information measured in angstroms per minute and surface defect information on the semiconductor wafer.

82. The method according to claim 76 comprising further steps:

a step (J) storing at a least a portion of the information in the step (H) forming a family of stored information;

a step (K) using the family of stored information to determine a change for at least one particular member of the family of stored information; and a step (L) changing the at least one particular member of the family of stored information.

83. A process controller having access to a manufactured article having a processor readable medium with processor readable instructions for performing the method of claim 82.

84. The method according to claim 76 comprising further steps:

a step (J) storing at a least a portion of the information in the step (H) forming a family of stored information;

a step (K) using the family of stored information to determine a change for at least one particular member of the family of stored information;

a step (L) changing the at least one particular member in the family of stored information forming a changed family of stored information; and a step (M) using the changed family of stored information.

85. The method according to claim 84 wherein the steps (G) and (H) are performed at least in part during the same time.

86. The method according to claim 84 wherein the steps (G) and (H) are performed at least in part at different times.

87. A process controller having access to a manufactured article having a processor readable medium with processor readable instructions for performing the method of claim 84.

88. A processor-readable, program storage device encoded with instructions that, when executed by a processor, performs the method of claim 84.

89. The method according to claim 76 comprising further steps:

a step (J) of storing at a least a portion of the information in the step (H) forming a family of stored information;

a step (K) of using the family of stored information to determine a change for at least one particular member of the family of stored information with data mining;

a step (L) of changing the at least one particular member in the family of stored information forming a changed family of stored information; and a step (M) of using the changed family of stored information.

90. The method of finishing according to claim 89 wherein the finishing aid comprises the finishing aid which at least in part reduces friction.

91. The method according to claim 90 comprising further steps:

a step (J) of storing at a least a portion of the information in the step (H) forming a family of stored information;

a step (K) of using the family of stored information to determine a change for at least one particular member of the family of stored information;

a step (L) of changing the at least one particular member in the family of stored information forming a changed family of stored information; and a step (M) of using the changed family of stored information.

92. The method of finishing according to claim 91 wherein the finishing surface comprises a wear inducing finishing surface.

93. The method of finishing according to claim 91 wherein the finishing surface comprises a wear inducing finishing surface for inducing tribochemical reactions.

94. The method of finishing according to claim 91 wherein the finishing surface comprises a multiphase polymeric finishing surface having at least two synthetic polymers.

95. The method of finishing according to claim 91 wherein the finishing aid comprises at least in part a plurality of organic lubricating films and wherein the differential finishing rate comprises at least in part differential lubrication.

96. The method of finishing according to claim 91 wherein the finishing surface comprises the finishing surface of a finishing element and the finishing element includes the finishing aid.

97. A method for finishing a semiconductor wafer having tracked information, the method comprising:

a step (A) providing a semiconductor wafer and wherein the semiconductor wafer surface has a first uniform region and a second uniform region;

a step (B) providing a finishing surface;

a step (C) providing a finishing aid proximate the semiconductor wafer;

a step (D) providing at least one finishing control subsystem having at least three operative process sensors, at least one processor, and a controller and wherein the at least one processor for processing:

(i) the tracked information, and (ii) historical performance including a quantity of historical tracked information of the workpiece and a quantity of historical tracked information of prior workpieces;

a step (E) applying an operative finishing motion to an interface between the semiconductor wafer and the finishing surface and wherein the interface includes the finishing aid in the first uniform region;

a step (F) sensing an in situ finishing information with the at least three operative process sensors during a finishing cycle time;

a step (G) evaluating a multiplicity of finishing information, and each having varying effects on the finishing with the finishing aid;

a step (H) determining a change for at least two process control parameters using:

(i) the tracked information, (ii) historical performance including the quantity of historical tracked information of the workpiece and the quantity of historical tracked information of prior workpieces, (iii) the in situ finishing information, and (iv) the step (G) of evaluating the multiplicity of finishing information; and a step (I) changing the at least two control parameters to change a finishing rate measured in angstroms per minute on at least the first uniform region of semiconductor wafer surface during the finishing cycle time;

a step (J) storing at a least a portion of the information in the step (H) forming a family of stored information;

a step (K) using the family of stored information to determine a change for at least one particular member of the family of stored information;

a step (L) changing the at least one particular member in the family of stored information forming a changed family of stored information; and a step (M) using the changed family of stored information.

98. The method of finishing according to claim 97 wherein the semiconductor wafer has a diameter of at least 300 millimeters.

99. The method of finishing according to claim 97 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

100. The method of finishing according to claim 97 wherein:

the finishing aid comprises the finishing aid which at least in part reduces friction; and the semiconductor wafer has at least three metal layers.

101. The method of finishing according to claim 97 wherein the finishing aid comprises a finishing aid having a property selected from the group consisting of changing the coefficient of friction, changing average cut rate, and changing the cut rate of a specific material in the semiconductor wafer surface.

102. The method of finishing according to claim 97 wherein the finishing aid comprises an organic lubricant.

103. The method of finishing according to claim 97 wherein the finishing aid comprises an organic lubricating film which adheres to the semiconductor wafer surface.

104. The method of finishing according to claim 97 wherein the finishing aid comprises an organic lubricating film which interacts with and adheres to the semiconductor wafer surface.

105. The method of finishing according to claim 97 wherein the finishing aid comprises an organic lubricating film which interacts with the first uniform region.

106. The method of finishing according to claim 97 wherein the finishing aid comprises an organic lubricating film which interacts with and adheres to the first uniform region.

107. The method of finishing according to claim 97 wherein the finishing aid comprises at least in part a plurality of organic lubricating films and wherein the differential finishing rate comprises at least in part differential lubrication.

108. The method of finishing according to claim 97 wherein the finishing surface comprises the finishing surface of a finishing element and the finishing element includes the finishing aid.

109. The method of finishing according to claim 97 wherein the finishing surface comprises a wear inducing finishing surface.

110. The method of finishing according to claim 97 wherein the finishing surface comprises a wear inducing finishing surface for inducing tribochemical reactions.

111. The method of finishing according to claim 97 wherein the finishing surface comprises a multiphase polymeric finishing surface having at least two synthetic polymers.

112. The method of finishing according to claim 97 wherein the finishing aid comprises the finishing aid which differentially reacts with heterogeneous regions of a semiconductor wafer surface.

113. The method of finishing according to claim 97 wherein the finishing aid comprises the finishing aid which differentially reacts with heterogeneous regions of a semiconductor wafer surface forming a differential lubrication.

114. A processor-readable, program storage device encoded with instructions that, when executed by a processor, performs the method of claim 97.

115. A process controller having access to a manufactured article having a processor readable medium with processor readable instructions for performing the methods of claim 97.

116. At least three process controllers according to claim 115 wherein the at least three process controllers are in operative communication with each other.

117. An apparatus for planarizing a workpiece having a process controller, the process controller having access to a manufactured article having a computer readable medium with computer readable instructions for performing the method of claim 97.

118. At least three apparatus for planarizing a workpiece according to claim 117 wherein the at least three process controllers are in operative communication with each other.

119. A method for finishing a semiconductor wafer having tracked information, the method comprising:

a step (A) providing a semiconductor wafer and wherein the semiconductor wafer surface has a first uniform region and a second uniform region;

a step (B) providing a finishing surface;

a step (C) providing a finishing aid proximate the semiconductor wafer;

a step (D) providing at least one finishing control subsystem having at least three operative process sensors, at least one processor, and a controller and wherein the at least one processor for processing:

(i) the tracked information, and (ii) historical performance including a quantity of historical tracked information of the workpiece and a quantity of historical tracked information of prior workpieces;

a step (E) applying an operative finishing motion to an interface between the semiconductor wafer and the finishing surface and wherein the interface includes the finishing aid in the first uniform region;

a step (F) sensing an in situ finishing information with the at least three operative process sensors during a finishing cycle time;

a step (G) evaluating a multiplicity of finishing information, and each having varying effects on the finishing with the finishing aid;

a step (H) determining a change for at least two process control parameters using:

(i) the tracked information, (ii) historical performance including the quantity of historical tracked information of the workpiece and the quantity of historical tracked information of prior workpieces;

(iii) the in situ finishing information, and (iv) the step (G) of evaluating the multiplicity of finishing information; and a step (I) changing the at least two control parameters to change a tangential force of friction in at least the first uniform region of semiconductor wafer surface during the finishing cycle time;

a step (J) storing at a least a portion of the information in the step (H) forming a family of stored information;

a step (K) using the family of stored information to determine a change for at least one particular member of the family of stored information;

a step (L) changing the at least one particular member in the family of stored information forming a changed family of stored information; and a step (M) using the changed family of stored information.

120. The method of finishing according to claim 119 wherein the finishing aid comprises a reactive finishing aid which chemically reacts with at least a portion of the semiconductor wafer surface changing the finishing rate in angstroms per minute when compared to the finishing rate under identical finishing conditions but in the absence of the reactive finishing aid.

121. The method of finishing according to claim 119 wherein:

the finishing aid comprises the finishing aid which at least in part reduces friction; and the semiconductor wafer has at least three metal layers.

122. The method of finishing according to claim 119 wherein the finishing aid comprises a finishing aid having a property selected from the group consisting of changing the coefficient of friction, changing average cut rate, and changing the cut rate of a specific material in the semiconductor wafer surface.

123. The method of finishing according to claim 119 wherein the finishing aid comprises an organic lubricant.

124. The method of finishing according to claim 119 wherein the finishing aid comprises an organic lubricating film which adheres to the semiconductor wafer surface.

125. The method of finishing according to claim 119 wherein the finishing aid comprises an organic lubricating film which interacts with and adheres to the semiconductor wafer surface.

126. The method of finishing according to claim 119 wherein the finishing aid comprises an organic lubricating film which interacts with the first uniform region.

127. The method of finishing according to claim 119 wherein the finishing aid comprises an organic lubricating film which interacts with and adheres to the first uniform region.

128. The method of finishing according to claim 119 wherein the finishing aid comprises at least in part a plurality of organic lubricating films and wherein the differential finishing rate comprises at least in part differential lubrication.

129. The method of finishing according to claim 119 wherein the finishing surface comprises the finishing surface of a finishing element and the finishing element includes the finishing aid.

130. The method of finishing according to claim 119 wherein the finishing surface comprises a wear inducing finishing surface.

131. The method of finishing according to claim 119 wherein the finishing surface comprises a wear inducing finishing surface for inducing tribochemical reactions.

132. The method of finishing according to claim 119 wherein the finishing surface comprises a multiphase polymeric finishing surface having at least two synthetic polymers.

133. The method of finishing according to claim 119 wherein the finishing aid comprises the finishing aid which differentially reacts with heterogeneous regions of a semiconductor wafer surface.

134. The method of finishing according to claim 119 wherein the finishing aid comprises the finishing aid which differentially reacts with heterogeneous regions of a semiconductor wafer surface forming a differential lubrication.

135. A processor-readable, program storage device encoded with instructions that, when executed by a processor, performs the method of claim 119.

136. A process controller having access to a manufactured article having a processor readable medium with processor readable instructions for performing the methods of claim 119.

137. At least three process controllers according to claim 136 wherein the at least three process controllers are in operative communication with each other.

138. An apparatus for planarizing a workpiece having a process controller, the process controller having access to a manufactured article having a computer readable medium with computer readable instructions for performing the method of claim 119.

139. At least three apparatus for planarizing a workpiece according to claim 138 wherein the at least three process controllers are in operative communication with each other.

* * * * *